US008204655B2

(12) United States Patent
Tomita et al.

(10) Patent No.: US 8,204,655 B2
(45) Date of Patent: Jun. 19, 2012

(54) CONSTRUCTION MACHINE

(75) Inventors: Kunitsugu Tomita, Kashiwa (JP); Kazuo Fujishima, Kasumigaura (JP); Akinori Ishii, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 12/907,512

(22) Filed: Oct. 19, 2010

(65) Prior Publication Data

US 2011/0033274 A1 Feb. 10, 2011

Related U.S. Application Data

(63) Continuation of application No. 11/875,037, filed on Oct. 19, 2007, now abandoned.

(30) Foreign Application Priority Data

| | | |
|---|---|---|
| Oct. 19, 2006 | (JP) | 2006-285163 |
| Nov. 16, 2006 | (JP) | 2006-310261 |
| Apr. 3, 2007 | (JP) | 2007-097269 |
| Sep. 10, 2007 | (JP) | 2007-233799 |

(51) Int. Cl.

| | |
|---|---|
| ***G06F 19/00*** | (2011.01) |
| ***F16D 31/02*** | (2006.01) |
| ***B66C 1/00*** | (2006.01) |

(52) U.S. Cl. ..... 701/50; 60/452; 414/730

(58) Field of Classification Search ..... 701/29, 701/30, 50; 414/695.5, 15; 702/182; 60/452, 60/420; 340/439, 425.5, 691.6

See application file for complete search history.

(56) References Cited

U.S. PATENT DOCUMENTS

| | | | | |
|---|---|---|---|---|
| 3,872,670 | A | 3/1975 | Dezelan et al. | |
| 4,046,270 | A | 9/1977 | Baron et al. | |
| 5,992,146 | A | 11/1999 | Hausman | |
| 6,167,701 | B1 | 1/2001 | Hatcher et al. | |
| 6,357,230 | B1 | 3/2002 | A'Hearn et al. | |
| 2004/0020082 | A1 * | 2/2004 | Ariga et al. | 37/236 |
| 2005/0198949 | A1 | 9/2005 | Bitter | |

(Continued)

FOREIGN PATENT DOCUMENTS

| | | | |
|---|---|---|---|
| EP | 0 867 567 | A2 | 9/1998 |

(Continued)

OTHER PUBLICATIONS

European Search Report dated Mar. 18, 2011 (Twenty-one (21) pages).

(Continued)

*Primary Examiner* — James Trammell
*Assistant Examiner* — Muhammad Shafi
(74) *Attorney, Agent, or Firm* — Crowell & Moring LLP

(57) ABSTRACT

A construction machine includes: a work arm rotatably mounted at a construction machine main body; a work tool mounted at the work arm; an attitude decision device that decides an attitude of the work arm or the work tool relative to the construction machine main body; a follow-up enabling device that allows the work arm or the work tool to follow a displacement of a contacting object that comes into contact with the work tool and applies an external force to the work tool, by adjusting the attitude of the work arm or the work tool decided by the attitude decision device; and a switching device that selects whether or not to allow the work arm or the work tool to follow the displacement of the contacting object via the follow-up enabling device.

6 Claims, 38 Drawing Sheets

U.S. PATENT DOCUMENTS

| | | | | |
|---|---|---|---|---|
| 2006/0108185 | A1 | 5/2006 | Bitter | |
| 2006/0179831 | A1 | 8/2006 | Anderson et al. | |
| 2008/0082239 | A1 * | 4/2008 | Anderson | 701/50 |

FOREIGN PATENT DOCUMENTS

| | | | |
|---|---|---|---|
| EP | 1 574 626 | A1 | 9/2005 |
| EP | 1571267 | | 9/2005 |
| EP | 1 659 087 | A2 | 5/2006 |
| JP | 59-11902 | U | 1/1984 |
| JP | 2-186020 | A | 7/1990 |
| JP | 4-73058 | U | 6/1992 |
| JP | 05-295901 | | 11/1993 |
| JP | 8-270001 | | 10/1996 |
| JP | 11-181815 | * | 7/1999 |
| JP | 2000-27239 | | 1/2000 |
| JP | 2002-161546 | A | 6/2002 |
| JP | 2005-206291 | A | 8/2005 |
| JP | 2005-232950 | A | 9/2005 |
| JP | 2005-307631 | A | 11/2005 |
| JP | 2006-70456 | A | 3/2006 |
| WO | WO 2004/110702 | A1 | 12/2004 |
| WO | WO 2005/035883 | A1 | 4/2005 |

OTHER PUBLICATIONS

Japanese Office Action with English translation dated May 17, 2011 (twelve (12) pages).

Japanese Office Action dated Dec. 21, 2010 including English-language translation (Eleven (11) pages).

Partial European Search Report dated Mar. 26, 2010 (nine (9) pages).

* cited by examiner

CONSTRUCTION MACHINE

This application is a continuation of U.S. patent application Ser. No. 11/875,037, filed Dec. 19, 2007, the disclosure of which is expressly incorporated by reference herein.

INCORPORATION BY REFERENCE

The disclosures of the following priority applications are herein incorporated by reference:

Japanese Patent Publication No. 2006-285163 filed Oct. 19, 2006

Japanese Patent Publication No. 2006-310261 filed Nov. 16, 2006

Japanese Patent Publication No. 2007-097269 filed Apr. 3, 2007

Japanese Patent Publication No. 2007-233799 filed Sep. 10, 2007

BACKGROUND OF THE INVENTION

1. Field of the Invention

The present invention relates to a construction machine that includes a work arm.

2. Description of Related Art

There is a construction machine known in the related art capable of performing various types of work with different work tools attached to a base constituted with a hydraulic excavator. As disclosed in Japanese Laid Open Patent Publication No. H 5-295901, a work tool mounted at such a construction machine may include a spring device for reducing the load applied from the work tool to the arm of the construction machine so as to prevent damage to the arm due to an overload.

However, there is a problem to be addressed with regard to work tools in the related art in that the response of the operating force is slow and the work tool operability becomes poor to result in low work efficiency.

SUMMARY OF THE INVENTION

A construction machine according to a 1st aspect of the present invention includes: a work arm rotatably mounted at a construction machine main body; a work tool mounted at the work arm; an attitude decision device that decides an attitude of the work arm or the work tool relative to the construction machine main body; a follow-up enabling device that allows the work arm or the work tool to follow a displacement of a contacting object that comes into contact with the work tool and applies an external force to the work tool, by adjusting the attitude of the work arm or the work tool decided by the attitude decision device; and a switching device that selects whether or not to allow the work arm or the work tool to follow the displacement of the contacting object via the follow-up enabling device.

According to a 2nd aspect of the present invention, in the construction machine according to the 1st aspect, it is preferable that the attitude decision device is a hydraulic cylinder that decides the attitude of the work arm or the work tool by extending/contracting a cylinder rod; and that the follow-up enabling device is an accumulator that adjusts the attitude of the work arm or the work tool by causing the cylinder rod to extend/contract as pressure oil supplied to the hydraulic cylinder is absorbed into or released from the accumulator.

According to a 3rd aspect of the present invention, in the construction machine according to the 2nd aspect, it is preferable that the follow-up switching device is a switching valve disposed in an oil passage connecting the hydraulic cylinder with the accumulator, by which a flow of the pressure oil between the hydraulic cylinder and the accumulator is allowed or disallowed.

According to a 4th aspect of the present invention, the construction machine according to the 2nd aspect may further include an oil chamber selecting device that selects one of a bottom oil chamber and a rod oil chamber at the hydraulic cylinder where the pressure oil has a higher pressure and connecting the selected oil chamber to the accumulator.

According to a 5th aspect of the present invention, the construction machine according to the 1st aspect may further includes a traveling carriage rotatably supports the construction machine main body.

According to a 6th aspect of the present invention, the construction machine according to the 1st aspect may further include a follow-up characteristics adjusting device that adjusts follow-up characteristics achieved with the follow-up enabling device.

According to a 7th aspect of the present invention, in the construction machine according to the 1st aspect, the attitude decision device may be a hydraulic cylinder that decides the attitude of the work tool by extending/contracting a cylinder rod; and the construction machine may further include: oil passages that communicate with a bottom-side oil chamber and a rod-side oil chamber at the hydraulic cylinder; and a switching valve that opens or blocks the oil passages.

A construction machine according to a 8th aspect of the present invention includes: a work arm rotatably mounted at a construction machine main body; a work tool mounted at the work arm; an attitude adjusting device that adjusts an attitude of the work arm or the work tool relative to the construction machine main body; an adjustment enabling device that allows the attitude of the work arm or the work tool to be adjusted by the attitude adjusting device so as to assume an attitude corresponding to an external force applied to the work tool at the work arm or the work tool; an operating state determining device that determines an operating state of the construction machine main body; and a switching device that selects, based upon the operating state determined by the operating state determining device, whether or not the adjustment enabling device is to allow the attitude adjusting device to adjust the attitude of the work arm or the work tool.

According to a 9th aspect of the present invention, in the construction machine according to the 8th aspect, the operating state determining device may determine the operating state based upon at least one of; an operating state of an operation lever by which operation instructions for the work arm or the work tool are issued, a work load applied to the work arm or the work tool and the attitude of the work arm or the work tool.

According to a 10th aspect of the present invention, in the construction machine according to the 9th aspect, it is preferable that: the work tool is a gripping device that grips a target object; the operating state determining device determines the operating state based upon an operating state of an operation lever by which operating instructions for the gripping device are issued; and if the operating state determining device determines that the operation lever has been operated so as to grip the target object with the gripping device, the switching device switches the adjustment enabling device so as to allow the attitude adjusting device to adjust the attitude of the work arm or the work tool.

According to a 11th aspect of the present invention, in the construction machine according to the 9th aspect, it is preferable that: the work tool is a gripping device that grips a target object; the construction machine further comprises a detection device that detects a physical quantity corresponding to a gripping force imparted by the gripping device; the operating state determining device determines the operating state based upon the physical quantity detected by the detection device; and if the operating state determining device determines that the physical quantity detected by the detection device is smaller than a predetermined value, the switching device switches the adjustment enabling device so as to allow the attitude adjusting device to adjust the attitude of the work arm or the work tool.

According to a 12th aspect of the present invention, in the construction machine according to the 9th aspect, it is preferable that if the operating state determining device determines, based upon the attitude of the work tool, that the work tool is positioned facing downward substantially along a vertical direction, the switching device switches the adjustment enabling device so as to allow the attitude adjusting device to adjust the attitude of the work tool.

A construction machine according to a 13th aspect of the present invention includes: a first work arm and a second work arm rotatably mounted at a construction machine main body; a first work tool mounted at the first work arm; a second work tool mounted at the second work arm; a first operation device to be operated by an operator to adjust an attitude of the first work arm or the first work tool relative to the construction machine main body; a second operation device to be operated by the operator to adjust an attitude of the second work arm or the second work tool relative to the construction machine main body; a first attitude decision device that decides the attitude of the first work arm or the first work tool relative to the construction machine main body based upon an operation of the first operation device by the operator; a second attitude decision device that decides the attitude of the second work arm or the second work tool relative to the construction machine main body based upon an operation of the second operation device by the operator; a follow-up enabling device that allows the first work arm or the first tool, or the second work arm or the second work tool to follow a displacement of a contacting object that comes into contact with the first work tool or the second work tool and applies an external force to the first work tool or the second work tool, by adjusting the attitude of the first work arm or the first work tool decided by the first attitude decision device or adjusting the attitude of the second work arm or the second work tool decided by the second attitude decision device; and a switching device that selects whether or not to allow one of the first work arm or the first work tool and the second work arm or the second work tool to follow the displacement of the contacting object via the follow-up enabling device.

According to a 14th aspect of the present invention, in the construction machine according to the 13th aspect, it is preferable that the follow-up enabling device includes a first follow-up enabling device that allows the first work arm or the first work tool to follow the displacement of a contacting object that comes into contact with the first work tool and applies an external force to the first work tool by adjusting the attitude of the first work arm or the first work tool decided by the first attitude decision device and a second follow-up enabling device that allows the second work arm or the second work tool to follow the displacement of a contacting object that comes into contact with the second work tool and applies an external force to the second work tool by adjusting the attitude of the second work arm or the second work tool decided by the second attitude decision device.

According to a 15th aspect of the present invention, in the construction machine according to the 14th aspect, it is preferable that the switching device is capable of selecting whether or not to allow the first work arm or the first work tool to follow the displacement of the contacting object via the first follow-up enabling device in response to an operation performed by the operator and is also capable of selecting whether or not to allow the second work arm or the second work tool to follow the displacement of the contacting object via the second follow-up enabling device in response to an operation performed by the operator.

According to a 16th aspect of the present invention, in the construction machine according to the 13th aspect, it is preferable that the switching device selects whether or not to allow the first work arm or the first work tool to follow the displacement of a contacting object that comes into contact with the first work tool and applies an external force to the first work tool based upon an operation of the second operation device performed by the operator and selects whether or not to allow the second work arm or the second work tool to follow the displacement of a contacting object that comes into contact with the second work tool and applies an external force to the second work tool based upon an operation of the first operation device performed by the operator.

According to a 17th aspect of the present invention, in the construction machine according to the 16th aspect, it is preferable that: the first work tool is a first gripping tool; the second work tool is a second gripping tool; and if the first work arm and the second work arm are judged to have been adjusted to assume substantially identical attitudes based upon operations of the first operation device and the second operation device performed by the operator, the switching device selects a setting at which at least one of; the first work arm, the first gripping tool, the second work arm and the second gripping tool, is allowed to follow the displacement of the contacting object.

According to a 18th aspect of the present invention, in the construction machine according to the 13th aspect, it is preferable that: the first work arm and the second work arm are each allowed to rotate to a left/right direction relative to the construction machine main body; the first operation device and the second operation device are respectively operated by the operator to adjust rotational attitudes assumed by the first work arm and the second work arm along the left/right direction relative to the construction machine main body; the first attitude decision device and the second attitude decision device respectively decide the rotational attitudes of the first work arm and the second work arm relative to the construction machine main body based upon operations of the first operation device and the second operation device performed by the operator; and the follow-up enabling device allows the first work arm and the second work arm to follow the displacement of the contacting object that comes into contact with the first work tool or the second work tool and applies an external force to the first work tool or the second work tool by adjusting the rotational attitudes assumed by the first work arm and the second work arm along the left/right direction relative to the construction machine main body, respectively decided by the first attitude decision device and the second attitude decision device.

DESCRIPTION OF PREFERRED EMBODIMENTS

First Embodiment

Figure 1:
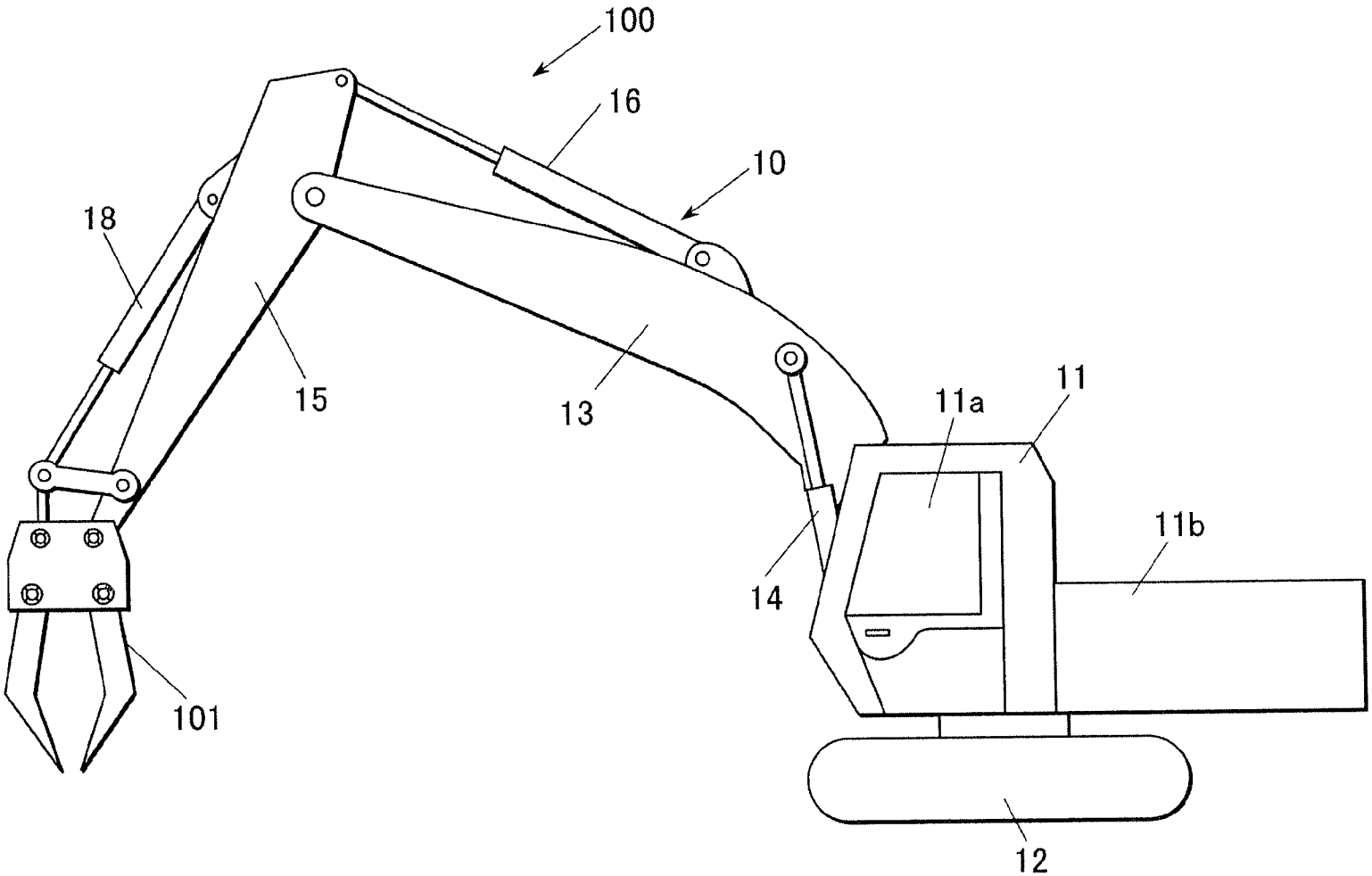
FIG. 1 is an external view of a construction machine.
Figure 2:
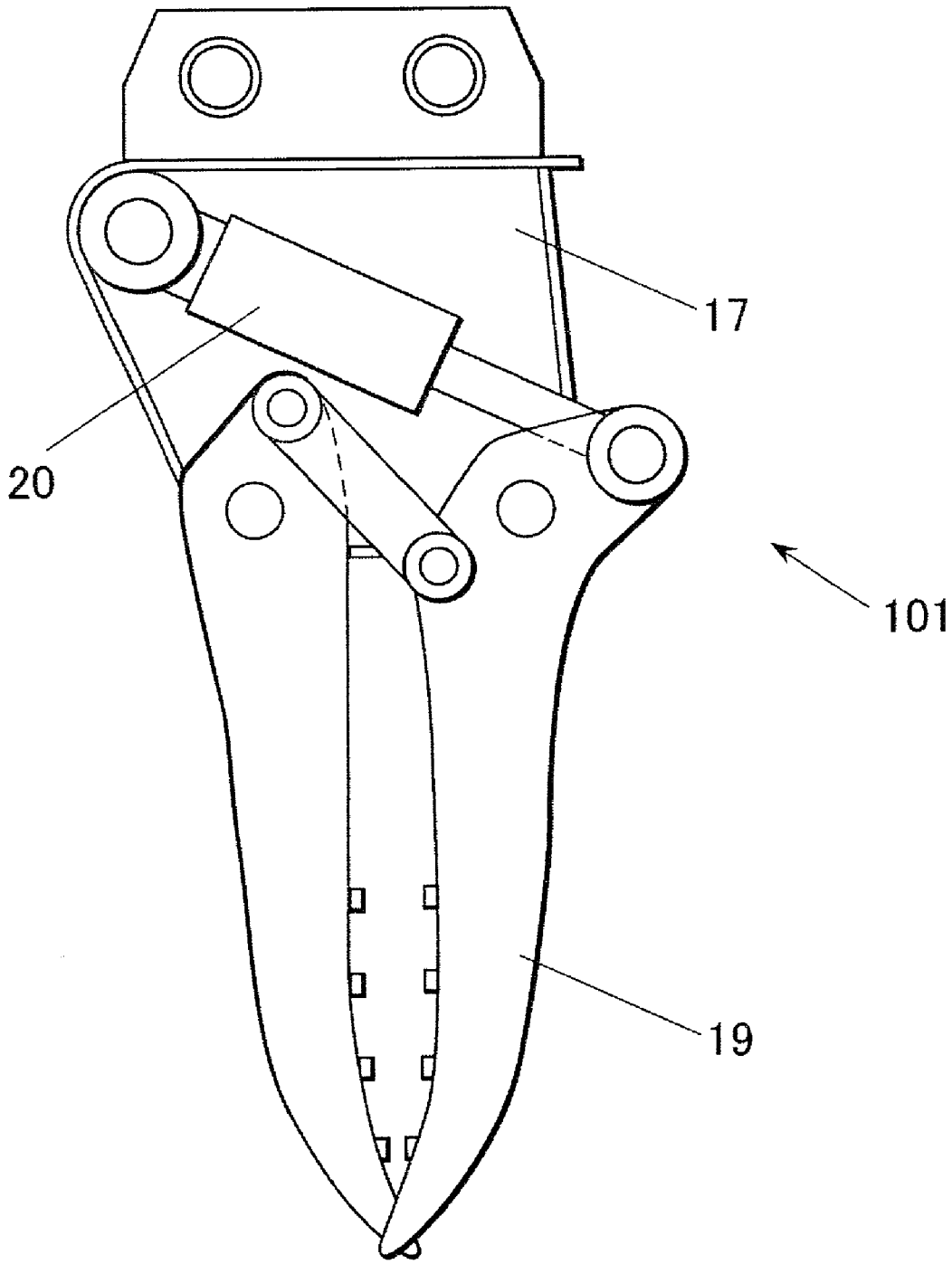
FIG. 2 shows the structure of a gripping device.
Figure 3:
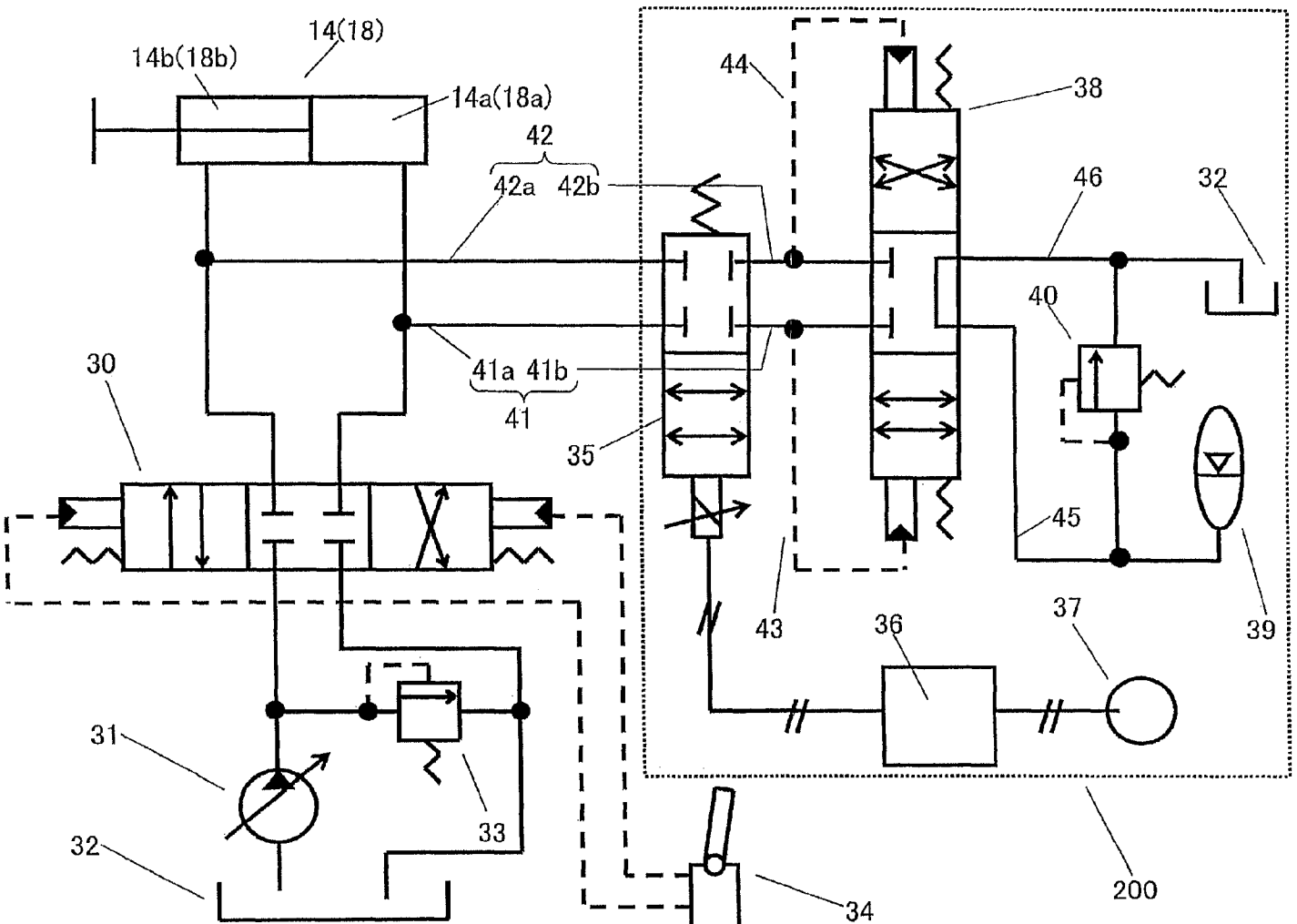
FIG. 3 is a circuit diagram pertaining to the hydraulic circuits that drive a boom cylinder and a work tool cylinder of the construction machine.

In reference to FIGS. 1 through 3, the first embodiment of the construction machine according to the present invention is explained. As shown in FIG. 1, a revolving superstructure 11 is rotatably mounted at a traveling carriage 12 in a construction machine 100 that includes as its base unit a hydraulic excavator. An operator's cab 11*a* is disposed at the front of the revolving superstructure 11. Behind the operator's cab 11*a*, a main drive device 11*b*, which includes an engine and a hydraulic pump, is disposed.

A front work arm 10 constituted with an articulated arm is mounted at the revolving superstructure 11. The front work arm 10 includes a boom 13 attached to the revolving superstructure 11 so as to swing up/down freely via a boom cylinder 14, an arm 15 connected to the boom 13 and mounted so as to swing up/down freely via an arm cylinder 16 and a gripping device 101, which is a work tool connected to the front end of the arm 15 so as to rotate freely along the up/down direction via a work tool cylinder 18.

FIG. 2 shows the structure of the gripping device 101. The gripping device 101 includes a gripping device body 17 attached to the front end of the arm 15, a pair of gripping claws 19 disposed facing opposite each other so as to be able to grasp and hold a target object between the front ends thereof and a cylinder 20 that drives the gripping claws 19 to engage them in opening/closing operation.

FIG. 3 is a circuit diagram pertaining to the hydraulic circuits that drive the boom cylinder 14 and the work tool cylinder 18 in the construction machine 100. While an explanation is given below on the hydraulic circuit that drives the boom cylinder 14, the hydraulic circuit that drives the work tool cylinder 18 assumes an identical structure. A main pump 31, a control valve 30, a main relief valve 33, a hydraulic operating fluid reservoir 32 and a work load follow-up device 200 are installed to form this hydraulic circuit. In addition, the hydraulic circuit includes a pilot pump (not shown) and an operation lever 34 used to control the control valve 30.

As the main pump 31, by which pressure oil is supplied to the various actuators of the construction machine 100, is driven by an engine (not shown), the hydraulic operating fluid in the hydraulic operating fluid reservoir 32 is delivered to the boom cylinder 14 via the control valve 30. The pressure oil from the main pump 31 is also delivered to the arm cylinder 16, the work tool cylinder 18 and the cylinder 20 via corresponding control valves (not shown). The maximum pressure in this hydraulic circuit is defined via the main relief valve 33.

The work load follow-up device 200 includes an electromagnetic switching valve (or solenoid controlled directional control valve) 35, a control valve 38, an accumulator 39 and a relief valve 40. The work load follow-up device 200 further includes a drive circuit 36 and an ON/OFF switch 37, by which the operating position of the electromagnetic switching valve 35 is switched. The electromagnetic switching valve 35, disposed so as to intersect oil passages 41 and 42, communicates the upstream side (oil passages 41*a* and 42*a*) of the oil passages 41 and 42 with the downstream side (oil passages 41*b* and 42*b*) or cuts off the upstream side from the downstream side. The oil passage 41*a* is connected with a bottom-side oil chamber 14*a* of the boom cylinder 14, whereas the oil passage 42*a* is connected to a rod-side oil chamber 14*b* of the boom cylinder 14.

The control valve 38 switches the state of connection of the oil passages 41*b* and 42*b* to oil passages 45 and 46 by selecting a spool position in correspondence to the pressures in the oil passages 41*b* and 42*b*. Namely, the pressure oil from an oil passage 43 connected to the oil passage 41*b* and from an oil passage 44 connected to the oil passage 42*b* as pilot pressure oil at the control valve 38 to drive the spool. When the pressures in the oil passages 41*b* and 42*b* are both low or when the pressures in the oil passages 41*b* and 42*b* are substantially equal to each other, the spool at the control valve 38 assumes the neutral position, disconnecting the oil passages 41*b* and 42*b* from the oil passages 45 and 46.

As the pressure in the oil passage 41*b* increases and the pressure in the oil passage 42*b* decreases, the spool at the control valve 38 shifts from the neutral position and, as a result, the oil passage 41*b* becomes connected to the oil passage 45 and the oil passage 42*b* becomes connected to the oil passage 46. If, on the other hand, the pressure in the oil passage 41*b* becomes lower and the pressure in the oil passage 42*b* becomes higher, the spool at the control valve 38 shifts from the neutral position to connect the oil passage 41*b* to the oil passage 46 and the oil passage 42*b* to the oil passage 45. In other words, when the pressure in either the oil passage 41*b* or the oil passage 42*b* becomes high and the pressure in the other oil passage becomes low, the oil passage where the pressure is high is connected to the oil passage 45 and the oil passage where the pressure is low is connected to the oil passage 46 via the control valve 38.

The accumulator 39 is connected to the oil passage 45 to absorb the pressure oil in the oil passage 45 or release pressure oil it has absorbed into the oil passage 45. Once the pressure in the oil passage 45 exceeds a preset pressure level, the pressure oil in the oil passage 45 is released into the oil passage 46 via the relief valve 40. The pressure level set for the relief valve 40 is lower than the pressure level setting selected for the main relief valve 33. It is to be noted that the oil passage 46 is connected to the hydraulic operating fluid reservoir 32.

The drive circuit 36 switches the operating position of the electromagnetic switching valve 35 based upon the ON/OFF state of the ON/OFF switch 37 installed in the operator's cab 11*a*. As the ON/OFF switch 37 enters an ON state in response to an operator operation, the drive circuit 36 excites the solenoid at the electromagnetic switching valve 35 and drives the solenoid so as to communicate the oil passages 41*a* and 42*a* with the oil passages 41*b* and 42*b* respectively. As the ON/OFF switch 37 enters an OFF state in response to an operator operation, the drive circuit 36 demagnetizes the solenoid at the electromagnetic switching valve 35. As a result, the spool is driven with the force of the spring at the electromagnetic switching valve 35 to disconnect the oil passages 41*a* and 42*a* from the oil passages 41*b* and 42*b*.

As a specific operation lever is operated in the construction machine 100 structured as described above, the spool of the control valve corresponding to the relevant hydraulic cylinder is driven and the hydraulic cylinder is driven at a speed reflecting the extent to which the operation lever is operated. For instance, as the operation lever 34 corresponding to the boom cylinder 14 is operated, the spool at the control valve 30 is driven with the pilot pressure oil from a pilot pump (not shown) assuming a pressure level corresponding to the extent to which the operation lever 34 has been operated and thus, the boom cylinder 14 is driven at a speed reflecting the extent to which the operation lever 34 has been operated.

As pressure oil is delivered into the bottom-side oil chamber 14*a* at the boom cylinder 14, the boom 13 is driven to swing upward relative to the revolving superstructure 11, whereas if pressure oil is delivered into the rod-side oil chamber 14*b* at the boom cylinder 14, the boom 13 is driven to swing downward relative to the revolving superstructure 11. As pressure oil is delivered into a bottom-side oil chamber (not shown) at the arm cylinder 16, the arm 15 is driven to swing downward relative to the boom 13, whereas if pressure oil is delivered into a rod-side oil chamber (not shown) at the arm cylinder 16, the arm 15 is driven to swing upward relative to the boom 13.

As pressure oil is delivered into a bottom-side oil chamber 18*a* at the work tool cylinder 18, the gripping device 101 is driven to swing downward relative to the arm 15, whereas if pressure oil is delivered into a rod-side oil chamber 18*b*, the gripping device 101 is driven to swing upward relative to the arm 15. As pressure oil is delivered to a bottom-side oil chamber (not shown) at the cylinder 20, the pair of gripping claws 19 are driven along the gripping direction, whereas if pressure oil is delivered into a rod-side oil chamber (not shown) at the cylinder, the pair of gripping claws 19 are driven along the releasing direction.

Operations of the Work Load Follow-Up Device 200 and the Boom Cylinder 14

As described above, when the ON/OFF switch 37 is in the ON state, the oil passages 41*a* and 42*a* are made to communicate with the oil passages 41*b* and 42*b* via the electromagnetic switching valve 35, and thus, the pressure oil in the bottom-side oil chamber 14*a* and the rod-side oil chamber 14*b* at the boom cylinder 14 flows into the downstream side of the electromagnetic switching valve 35. In this situation, the behavior of the boom cylinder 14 is affected by the operations of the control valve 38 and the accumulator 39. As explained earlier, when pressure oil is delivered into the bottom-side oil chamber 14*a* in response to an operation of the operation lever 34, the boom 13 is driven to swing upward relative to the revolving superstructure 11, whereas when pressure oil is delivered into the rod-side oil chamber 14*b*, the boom is driven to swing downward relative to the revolving superstructure 11.

As the gripping claws 19 come into contact with the work target object and the swinging motion of the boom 13 stops with the operation lever 34 remaining in the operating state, the pressure in either the oil chamber 14*a* or the oil chamber 14*b*, to which the pressure oil is supplied via the control valve 30, rises in correspondence to the force (work load) with which the gripping claws 19 contact the work target object. Then, as the pressure in either of the oil passages 41*b* and 42*b* in communication with the oil chambers 14*a* and 14*b* becomes high and the pressure in the other oil passage becomes low, the oil passage where the pressure has risen to a high level is connected with the oil passage 45 and the oil passage where the pressure has decreased is connected to the oil passage 46 via the control valve 38. As a result, the pressure oil in either the oil chamber 14*a* or the oil chamber 14*b* (hereafter referred to as the "high-pressure side oil chamber") communicating with the oil passage where the pressure has risen is absorbed by the accumulator 39. Since this allows the accumulator 39 to function as a spring element against the work load, a sudden increase in the work load is prevented.

If the operation lever 34 remains in the operating state after the gripping claws 19 contact the work target object, the pressure oil in the high-pressure side oil chamber (or the pressure oil flowing from the control valve 30 toward the high-pressure side oil chamber) is absorbed and collected at the accumulator 39 until the pressure rises to the pressure level setting selected for the relief valve 40. The pressure oil in the high-pressure side oil chamber (or the pressure oil flowing from the control valve 30 toward the high-pressure side oil chamber) is released via the relief valve 40 into the hydraulic operating fluid reservoir 32 once the pressure rises to the pressure level set for the relief valve 40. Namely, the accumulator 39 is protected via the relief valve 40 which regulates the pressure of the pressure oil applied to the accumulator 39. In addition, the relief valve 40 allows the gripping claws 19 to contact the work target object with a workload (contact force) corresponding to the pressure setting selected for the relief valve 40.

If a swinging motion of the arm 15, for instance, causes the gripping claws 19 to contact the work target object while the operation lever 34 is in a non-operating state, the pressure in either the oil chamber 14*a* or the oil chamber 14*b* at the boom cylinder 14 rises to a level corresponding to the work load. When the operation lever 34 is in the non-operating state, the pressure oil in the high-pressure side oil chamber does not flow to the outside via the control valve 30. However, since the oil passages 41*a* and 42*a* are in communication with the oil passages 41*b* and 42*b* via the electromagnetic switching valve 35, the pressure oil in the high-pressure side oil chamber flows into the accumulator 39 via the control valve 38, as explained earlier.

As a result, the pressure oil in the high-pressure side oil chamber is absorbed and collected at the accumulator 39 in correspondence to the work load, and the boom cylinder 14 extends/contracts in correspondence to the quantity of pressure oil accumulated at the accumulator 39 to cause a swinging motion of the boom 13. As the work load is lessened, the pressure oil having been collected at the accumulator 39 flows back into the high-pressure side oil chamber and thus, the boom cylinder 14 extends/contracts. In other words, the boom 13 swings to an extent corresponding to the level of the workload. Namely, the swinging motion of the boom 13 occurring as the pressure oil in the high-pressure side oil chamber is absorbed and collected at the accumulator 39 and then released from the accumulator 39 in correspondence to the work load, allows the gripping device 101 to follow the displacement of the work target object coming into contact with the gripping claws 19 to apply an external force to the gripping claws 19.

If the pressure in the oil passage 45 is equal to or less than the pressure level setting selected for the relief valve 40 at the time of the work load application, the pressure oil in the high-pressure side oil chamber will not have flowed back into the hydraulic operating fluid reservoir 32 via the relief valve 40. Under these circumstances, as the work load application stops and the pressure oil having been collected at the accumulator 39 flows back to the high-pressure side oil chamber, the cylinder rod at the boom cylinder 14 resumes the pre-work load application extension position.

If the pressure in the oil passage 45 exceeds the pressure level setting selected for the relief valve 40 at the time of the work load application, the pressure oil in the high-pressure side oil chamber flows back into the hydraulic operating fluid reservoir 32 via the relief valve 40. Under these circumstances, as the work load application stops and the pressure oil having been collected at the accumulator 39 flows back into the high-pressure side oil chamber, the cylinder rod at the boom cylinder 14 moves back closer to the pre-work load application extension position but stops at a position short of the full pre-work load application extension position by an extent matching the quantity of pressure oil having flowed back into the hydraulic operating fluid reservoir 32.

As described above, when the oil passages 41*a* and 42*a* are set in communication with the oil passages 41*b* and 42*b* via the electromagnetic switching valve 35, the work load follow-up device 200 is able to affect the operation of the boom cylinder 14. In other words, the ON/OFF switch 37 should be turned on to make the movement of the boom 13 follow the displacement of the work target object which constitutes the work load.

As described above, communication between the oil passages 41*a* and 42*a* and the oil passages 41*b* and 42*b* is cut off via the electromagnetic switching valve 35 when the ON/OFF switch 37 is in the OFF state, and thus, the pressure oil in the bottom-side oil chamber 14*a* and the rod-side oil chamber 14*b* at the boom cylinder 14 does not flow into the downstream side of the electromagnetic switching valve 35. In this situation, the behavior of the boom cylinder 14 is not affected by operations of the control valve 38 or the accumulator 39. Thus, if pressure oil is delivered into the bottom-side oil chamber 14*a* the boom 13 is driven to swing upward relative to the revolving superstructure 11 in response to an operation of the operation lever 34, but if pressure oil is delivered into the rod-side oil chamber 14*b*, the boom is driven to swing downward relative to the revolving superstructure 11, as explained earlier.

As the gripping claws 19 come into contact with the work target object and the swinging motion of the boom 13 stops with the operation lever 34 remaining in the operating state, the pressure of the pressure oil supplied to the boom cylinder 14 rises to the level defined by the main relief valve 33. If a swinging motion of the arm 15, for instance, causes the gripping claws 19 to contact the work target object while the operation lever 34 is in the non-operating state, the pressure in either the oil chamber 14*a* or the oil chamber 14*b* at the boom cylinder 14 rises to a level corresponding to the work load. When the operation lever 34 is in the non-operating state, the flow of pressure oil in the oil chambers 14*a* and 14*b* at the boom cylinder 14 to the outside is blocked at the control valve 30 and the electromagnetic switching valve 35 and thus, the boom 13 does not swing.

As described above, when the oil passages 41*a* and 42*a* are cut off from the oil passages 41*b* and 42*b* by the electromagnetic switching valve 35, the work load follow-up device 200 is not able to affect the operation of the boom cylinder 14. In other words, the ON/OFF switch 37 should be turned off if the movement of the boom 13 is not to follow the displacement of the work target object which constitutes the work load.

The hydraulic circuit that drives the work tool cylinder 18 also includes a work load follow-up device 200 in the construction machine 100 achieved in the embodiment. Since the operation of the work tool cylinder 18 is similar to the operation of the boom cylinder 14 described above, its explanation is omitted. A setting for allowing/not allowing the operation of the boom cylinder 14 to follow the displacement of the work target object which constitutes the work load and a setting for allowing/not allowing the operation of the work tool cylinder 18 to follow the displacement of the work target object which constitutes the work load can be individually selected as desired. For instance, when the operations of both the boom cylinder 14 and the work tool cylinder 18 are set to follow the displacement of the work target object which constitutes the work load, two articulating joints are allowed to rotate in conformance to the displacement of the work target object, doubling the level of freedom of movement. In this case, the front work arm 10 is able to follow a wider range of work target object displacement.

By selecting the settings that allow neither the boom cylinder 14 nor the work tool cylinder 18 to follow the displacement of the work target object which constitutes the work load, the construction machine can be engaged in work operation in much the same way as work machines in the related art that do not include work load follow-up devices 200. In addition, the operation of either the boom cylinder 14 or the work tool cylinder 18 alone may be allowed to follow the displacement of the work target object which constitutes the work load. In short, optimal settings should be selected by operating the individual ON/OFF switches 37 in correspondence to the specific details of the work to be performed.

The following operational advantages can be achieved with the construction machine 100 in the first embodiment of the present invention described above.

(1) The construction machine includes the work load follow-up devices 200, which allow the movement of the front work arm 10 to follow the displacement of the work target object which constitutes the work load and the settings for allowing/not allowing the movement of the front work arm 10 to follow the displacement of the work target object which constitutes the work load can be selected by turning on/off the ON/OFF switches 37. As a result, damage to the front work arm 10 due to an overload is prevented and, at the same time, a delay in the operating force response is prevented, which, in turn, assures the desired level of operability. Thus, the work efficiency is not compromised. In addition, since the movement of the front work arm 10 can follow the displacement of the work target object which constitutes the work load, the gripping device 101 can be engaged in a force following operation over the contour of a wall surface, a base surface or the like to assure a higher level of convenience. For instance, a force following operation such as ground leveling can be executed with ease by mounting a bucket instead of the gripping device 101 as the work tool.

(2) The boom 13 is allowed to follow the displacement of the work target object which constitutes the work load via the work load follow-up device 200 connected to the hydraulic circuit that drives the boom cylinder 14. In addition, the gripping device 101 is allowed to follow the displacement of the work target object which constitutes the work load via the work load follow-up device 200 connected to the hydraulic circuit that drives the work tool cylinder 18. When a work tool includes a spring device attached thereto in the related art, greater load capacity needs to assured and the operability of such a work tool is bound to be poorer due to the presence of the spring device. As a result, a high level of work of cannot be achieved. The operation of the construction machine according to the present invention, however, is not affected by such negative factors. In addition, since damage to the front work arm 10 attributable to the work load applied to the gripping claws 19 is prevented through a simple structure, an increase in the cost can be minimized. It is to be noted that since the present invention may be adopted in an existing construction machine simply by connecting the work load follow-up device 200 in the oil passage to a hydraulic cylinder, a function of following the displacement of the work target object which constitutes the work load can be added at low cost in the existing construction machine.

(3) The setting for allowing/not allowing the operation of the boom cylinder 14 to follow the displacement of the work target object which constitutes the work load and the setting for allowing/not allowing the operation of the work tool cylinder 18 to follow the displacement of the work target object which constitutes the work load can be individually selected as desired. Thus, by selecting the settings for allowing the operations of both the boom cylinder 14 and the work tool cylinder 18 to follow the displacement of the work target object which constitutes the work load, two articulating joints are allowed to rotate in conformance to the displacement of the work target object, doubling the level of freedom of movement. Consequently, the front work arm 10 is able to follow a wider range of work target object displacement and the risk of damage to the front work arm 10 can be greatly reduced. In addition, depending upon the specific details of the work to be performed, the operation of either the boom cylinder 14 or the work tool cylinder 18 alone may be set to follow the displacement of the work target object which constitutes the work load, or the settings not allowing either the boom cylinder 14 or the work tool cylinder 18 to follow the displacement of the work target object which constitutes the work load may be selected. In short, optimal settings can be selected with a high level of flexibility to best suit the specific details of the work to be performed.

(4) As the pressure oil in the high-pressure side oil chambers at the boom cylinder 14 and the work tool cylinder 18 is absorbed and collected in the respective accumulators 39 and then is released from the accumulators 39, the movement of the front work arm 10 is allowed to follow the displacement of the work target object which constitutes the work load. In addition, the setting for allowing or not allowing the pressure oil in a high-pressure side oil chamber to be absorbed at the corresponding accumulator 39 is selected via the electromagnetic switching valve 35. Thus, the cylinder rods of the boom cylinder 14 and the work tool cylinder 18 are allowed to extend/contract so as to follow the displacement of the work target object which constitutes the work load and also the extend/contract allow/disallow settings for the cylinder rods of the boom cylinder 14 and the work tool cylinder 18 to follow the displacement of the work target object which constitutes the work load can be selected through hydraulic circuits adopting a simple circuit structure. This means that stable and reliable operation is assured at low cost.

(5) Since the pressure oil in a high-pressure side oil chamber is guided to the accumulator 39 via the control valve 38, only a single accumulator 39 is required, which contributes to cost reduction. Furthermore, since the spool at the control valve 38 is driven with the pressure oil from the high-pressure side oil chamber used as the pilot pressure oil, a high level of operational reliability is assured through a simple structure.

Second Embodiment

Figure 4:
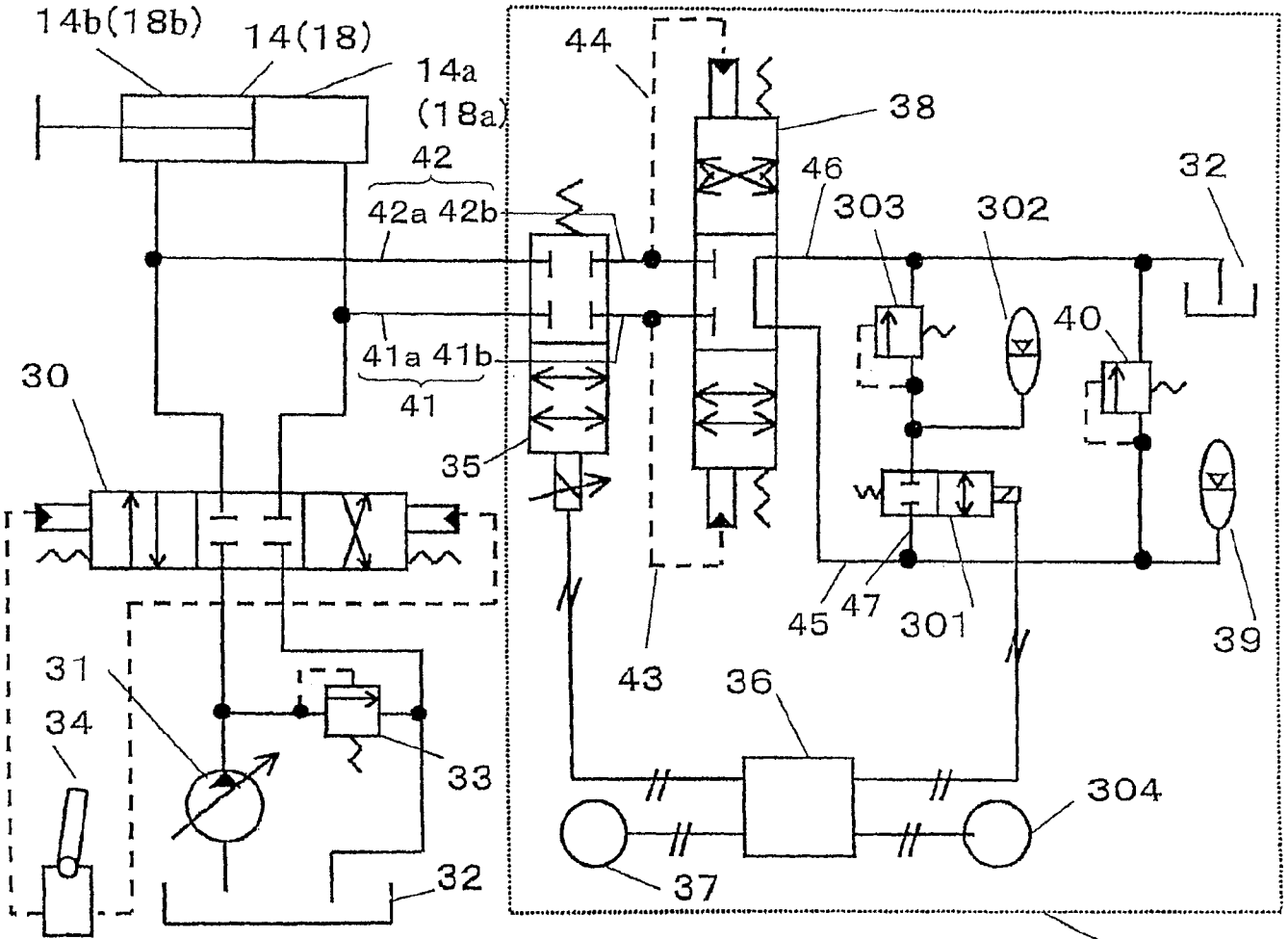
FIG. 4 is a circuit diagram pertaining to the hydraulic circuits that drive the boom cylinder and the work tool cylinder of the construction machine achieved in a second embodiment.

In reference to FIG. 4, the second embodiment of the construction machine according to the present invention is explained. The same reference numerals are assigned to structural elements identical to those in the first embodiment and the following explanation focuses on the differences from the first embodiment. Structural elements that are not specially noted in the following explanation are identical to those in the first embodiment. The second embodiment differs from the first embodiment in that an additional set of an accumulator and a relief valve is disposed between the oil passage 45 and the oil passage 46 within the work load follow-up device 200.

FIG. 4 is a circuit diagram pertaining to the hydraulic circuits that drive the boom cylinder 14 and the work tool cylinder 18 in the construction machine 100 achieved in the second embodiment. While an explanation is given below on the hydraulic circuit that drives the boom cylinder 14, the hydraulic circuit that drives the work tool cylinder 18 assumes an identical structure. The work load follow-up device 200 in the embodiment includes an electromagnetic switching valve 35, a control valve 38, an accumulator 39, a relief valve 40, an electromagnetic switching valve 301, an accumulator 302 and a relief valve 303. The work load follow-up device 200 further includes a drive circuit 36 and ON/OFF switches 37 and 304, by which the operating positions of the electromagnetic switching valves 35 and 301 are switched.

In an oil passage 47 connecting an oil passage 45 and an oil passage 46, the electromagnetic switching valve 301 and the relief valve 303 are disposed in this order in series starting from the side toward the oil passage 45. The accumulator 302 is connected to the oil passage 47 at a position between the electromagnetic switching valve 301 and the relief valve 303. In other words, the electromagnetic switching valve 301, the accumulator 302 and the relief valve 303 are disposed between the oil passage 45 and the oil passage 46, in parallel to the accumulator 39 and the relief valve 40.

The electromagnetic switching valve 301 is a switching valve which allows/disallows a pressure oil flow from the oil passage 45 to the accumulator 302 and the relief valve 303. The operating position of the electromagnetic switching valve 301 is switched by the drive circuit 36 in correspondence to the ON/OFF state of the ON/OFF switch 304 installed in the operator's cab 11*a*. The accumulator 302, connected to the oil passage 45 via the electromagnetic switching valve 301, absorbs the pressure oil in the oil passage 45 or releases pressure oil having been absorbed to the oil passage 45. The accumulator 302 has operating characteristics such that it absorbs pressure oil at a lower pressure compared to the accumulator 39.

The main function of the relief valve 303 is similar to that of the relief valve 40, which is to protect the accumulator 39, i.e., the relief valve 303 is disposed mainly to protect the accumulator 302. The pressure level setting selected for the relief valve 303 is lower than the pressure level setting selected for the relief valve 40.

When the ON/OFF switch 37 is in the ON state and the ON/OFF switch 304 is in the OFF state in the work load follow-up device 200 in the embodiment structured as described above, the oil passages 41*a* and 42*a* are set in communication with the oil passages 41*b* and 42*b* via the electromagnetic switching valve 35, but the oil passage 45 is disconnected from the part of the oil passage 47 located further on the downstream side relative to the electromagnetic switching valve 301. Under these circumstances, the work load follow-up device 200 in the embodiment engages in an operation identical to that executed by the work load follow-up device 200 in the first embodiment.

When both ON/OFF switches 37 and 304 are in the ON state, the oil passages 41*a* and 42*a* are set in communication with the oil passages 41*b* and 42*b* via the electromagnetic switching valve 35 and also, the oil passage 45 is made to communicate with the part of the oil passage 47 located further on the downstream side relative to the electromagnetic switching valve 301. As a result, the pressure oil in the oil passage 45 is allowed to flow into the accumulator 302. Since the accumulator 302 absorbs the pressure oil at a lower pressure level than the accumulator 39, as described earlier, the pressure oil in the oil passage 45 is absorbed more readily at the accumulator 302 than at the accumulator 39.

In addition, since the pressure level setting selected for the relief valve 303 is lower than the pressure level setting selected for the relief valve 40, the pressure oil in the oil passage 45 is released into the oil passage 46 via the relief valve 303 as the pressure in the oil passage 45 rises.

Thus, when the ON/OFF switches 37 and 304 are both in the ON state, it is possible to operate the boom 13 in conformance to the displacement of the work target object which constitutes the work load over a smaller work load range compared to the work load range over which the boom 13 is operated in conformance to the displacement of the work target object when the ON/OFF switch 37 is in an ON state and the ON/OFF switch 304 is in the OFF state. Namely, by opening/closing the electromagnetic switching valve 301 in response to an on/off operation of the ON/OFF switch 304, the follow-up characteristics of the boom 13 with which the boom 13 operates in correspondence to the work load can be switched or adjusted.

As in the first embodiment, the hydraulic circuit that drives the work tool cylinder 18 also includes a work load follow-up device 200 connected therein in the construction machine 100 achieved in the embodiment. Since the operation of the work tool cylinder 18 is similar to that of the boom cylinder 14 explained above, its explanation is omitted.

In the construction machine 100 achieved in the embodiment, the operating characteristics of the accumulator 39 and the pressure level setting selected for the relief valve 40 may be set over a relatively high pressure range so as to effectively prevent damage to the front work arm 10 attributable to the work load. In addition, the operating characteristics of the accumulator 302 and the pressure level setting selected for the relief valve 303 may be set over a relatively low pressure range so as to effectively prevent damage to the gripping target object and enable the work tool to perform an effective force following operation, that is, an effective positional error absorption.

In addition to the advantages of the first embodiment, the following operational advantages can be achieved in the construction machine 100 in the second embodiment of the present invention.

(1) The addition of the electromagnetic switching valve 301, the accumulator 302 and the relief valve 303 allows the movement of the front work arm 10 to follow the displacement of the work target object which constitutes the work load over an even smaller work load range. This means that the operator is able to adjust the follow-up characteristics with which the front work arm 10 operates in correspondence to the work load by operating the ON/OFF switch 304 as appropriate under specific work conditions, which achieves improvements in the operability and the work efficiency.

(2) By selecting optimal operating characteristics for the accumulators 39 and 302 and optimal pressure level settings for the relief valves 40 and 303 to suit specific purposes of use, the durability and the ease of use of the construction machine 100 can be improved.

Third Embodiment

Figure 5:
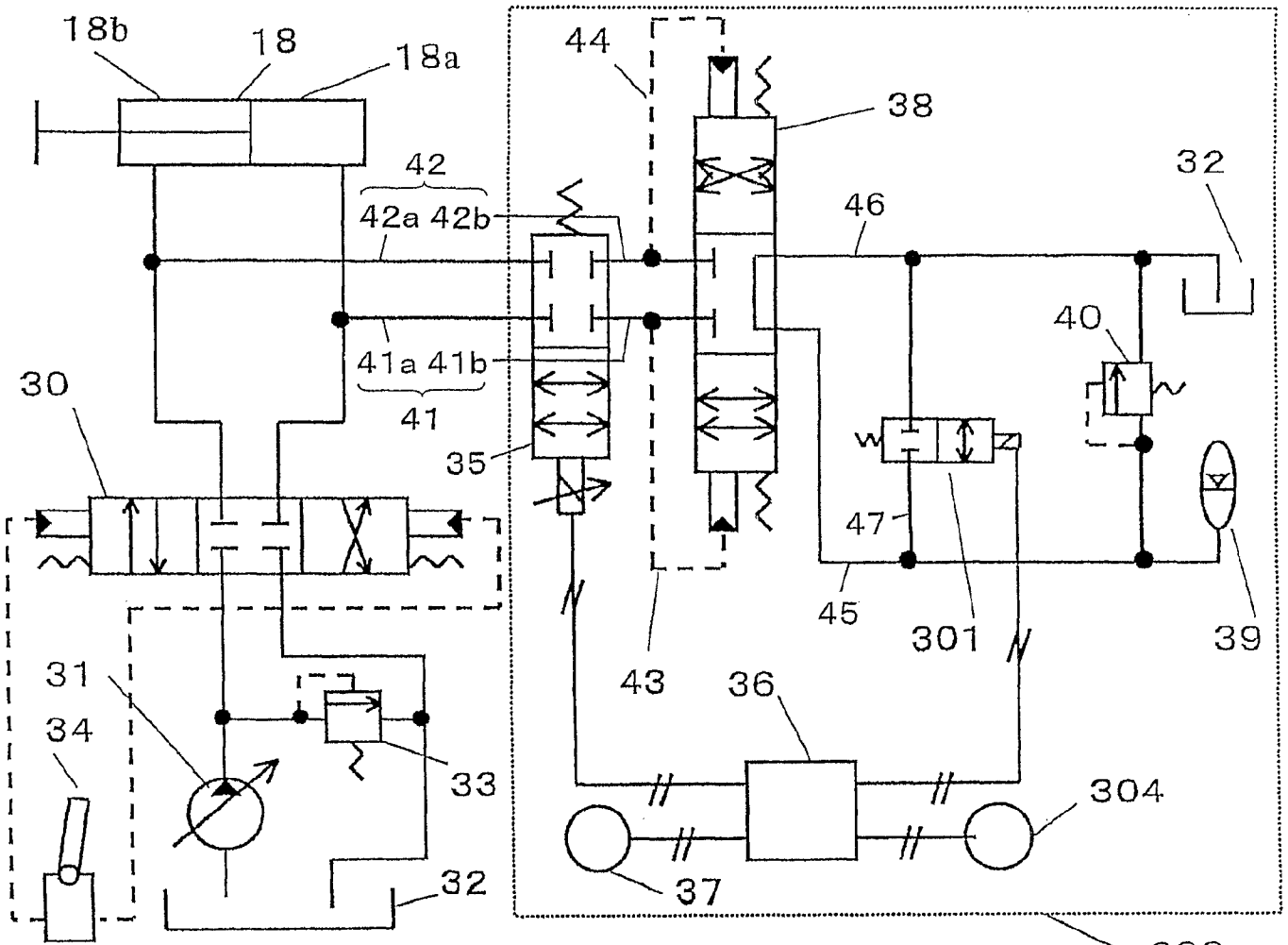
FIG. 5 is a circuit diagram pertaining to the hydraulic circuits that drive the boom cylinder and the work tool cylinder of the construction machine achieved in a third embodiment.

In reference to FIG. 5, the third embodiment of the construction machine according to the present invention is explained. The same reference numerals are assigned to structural elements identical to those in the first and second embodiments and the following explanation focuses on the differences from the first and second embodiments. Structural elements that are not specially noted in the following explanation are identical to those in the first and second embodiments. The third embodiment differs from the first embodiment mainly in that an electromagnetic switching valve is disposed between the oil passage 45 and the oil passage 46 in the work load follow-up device 200 and in that the work load follow-up device 200 is installed only in the hydraulic circuit for driving the work tool cylinder 18.

FIG. 5 is a circuit diagram of the hydraulic circuit that drives the work tool cylinder 18 in the construction machine 100 achieved in the third embodiment. As explained earlier, the work load follow-up device 200 is installed in the hydraulic circuit that drives the work tool cylinder 18 alone. The work load follow-up device 200 in the embodiment includes an electromagnetic switching valve 35, a control valve 38, an accumulator 39, a relief valve 40 and an electromagnetic switching valve 301. The work load follow-up device 200 further includes a drive circuit 36 and ON/OFF switches 37 and 304 used to select the operating positions of the electromagnetic switching valves 35 and 301. It is to be noted that the work load follow-up device 200 in this embodiment differs from the work load follow-up device 200 in the second embodiment described earlier in that it does not include an accumulator 302 or a relief valve 303.

An oil passage 47 connects the oil passage 45 and the oil passage 46. The electromagnetic switching valve 301 is a switching valve that allows/disallows a flow of pressure oil from the oil passage 45 to the oil passage 46 through the oil passage 47. The operating position of the electromagnetic switching valve 301 is switched by the drive circuit 36 in correspondence to the ON/OFF state of the ON/OFF switch 304 installed in the operator's cab 11*a*.

When the ON/OFF switch 37 is in the ON state and the ON/OFF switch 304 is in the OFF state in the work load follow-up device 200 in the embodiment structured as described above, the oil passages 41*a* and 42*a* are set in communication with the oil passages 41*b* and 42*b* via the electromagnetic switching valve 35, but the oil passage 45 is disconnected from the part of the oil passage 47 located further on the downstream side relative to the electromagnetic switching valve 301. Under these circumstances, the work load follow-up device 200 in the embodiment engages in an operation identical to that executed by the work load follow-up device 200 in the first embodiment.

When both ON/OFF switches 37 and 304 are in the ON state, the oil passages 41*a* and 42*a* are set in communication with the oil passages 41*b* and 42*b* via the electromagnetic switching valve 35 and also, the oil passage 45 is set in the communication with the oil passage 46, thereby allowing the pressure oil in the oil passage 45 to flow into the oil passage 46.

When a pressure difference occurs between the pressure in the bottom-side oil chamber 18*a* and the pressure in the rod-side oil chamber 18*b* at the work tool cylinder 18, the control valve 38 sets the oil passage 41 in communication with either the oil passage 45 or the oil passage 46 and sets the oil passage 42 in communication with the other oil passage 45 or 46 that is not in communication with the oil passage 41. Since the oil passage 41 is in communication with the bottom-side oil chamber 18*a* and the oil passage 42 is in communication with the rod-side oil chamber 18*b*, the bottom-side oil chamber 18*a* comes into communication with either the oil passage 45 or the oil passage 46 and the rod-side oil chamber 18*b* comes into communication with the other oil passage 45 or 46 that is not in communication with the oil passage 41 if there is a pressure difference between the bottom-side oil chamber 18*a* and the rod-side oil chamber 18*b*. In this situation, the bottom-side oil chamber 18*a* and the rod-side oil chamber 18*b* at the work tool cylinder 18 are made to communicate with each other through the oil passage 47.

Thus, if the gravitational center of the gripping device 101 is set at a position other than that directly under the rotational center of the gripping device 101 at the front end of the arm 15, a difference occurs between the pressure in the bottom-side oil chamber 18*a* and the rod-side oil chamber 18*b* due to the weight of the gripping device 101. Under these circumstances, the pressure oil in the oil chamber with the higher pressure is allowed to travel through the electromagnetic valve 35 and the control valve 38 and then be released into the oil passage 46 from the oil passage 45 via the oil passage 47 and the electromagnetic switching valve 301. Since the weight of the gripping device 101 causes the work tool cylinder 18 to extend/contract, the gripping device 101 becomes suspended directly under the front end of the arm 15 due to its own weight. Namely, the gripping device 101 is invariably positioned to face downward along the vertical direction regardless of the attitudes of the boom 13 and the arm 15.

Accordingly, when the ON/OFF switches 37 and 304 are both in the ON state, the construction machine 100 is in the optimal condition to perform a lowering operation to lower the gripping target object by the gripping device 101. When the ON/OFF switch 37 is in the ON state and the ON/OFF switch 304 is in the OFF state, the gripping device 101 can be operated in conformance to the displacement of the work target object which constitutes the work load, as in the first embodiment. When neither the ON/OFF switch 37 nor the ON/OFF switch 304 is in the ON state, the gripping device 101 does not follow the displacement of the work target device which constitutes the work load, just as in construction machines in the related art.

In addition to the advantages of the first and second embodiment, the following operational advantage can be further achieved in the construction machine 100 in the third embodiment described above.

(1) The construction machine includes the oil passage 47 connecting the oil passages 45 and 46 with each other and the electromagnetic switching valve 301 by which a pressure oil flow through the oil passage 47 is allowed or disallowed. The electromagnetic switching valve 301 is opened/closed via the ON/OFF switch 304. Thus, regardless of the attitudes assumed by the broom 13 and the arm 15, the gripping device 101 can always be positioned to face downward along the vertical direction under its own weight, to engage in a lowering operation to lower the gripping target object with improved operability and work efficiency.

Figure 6:
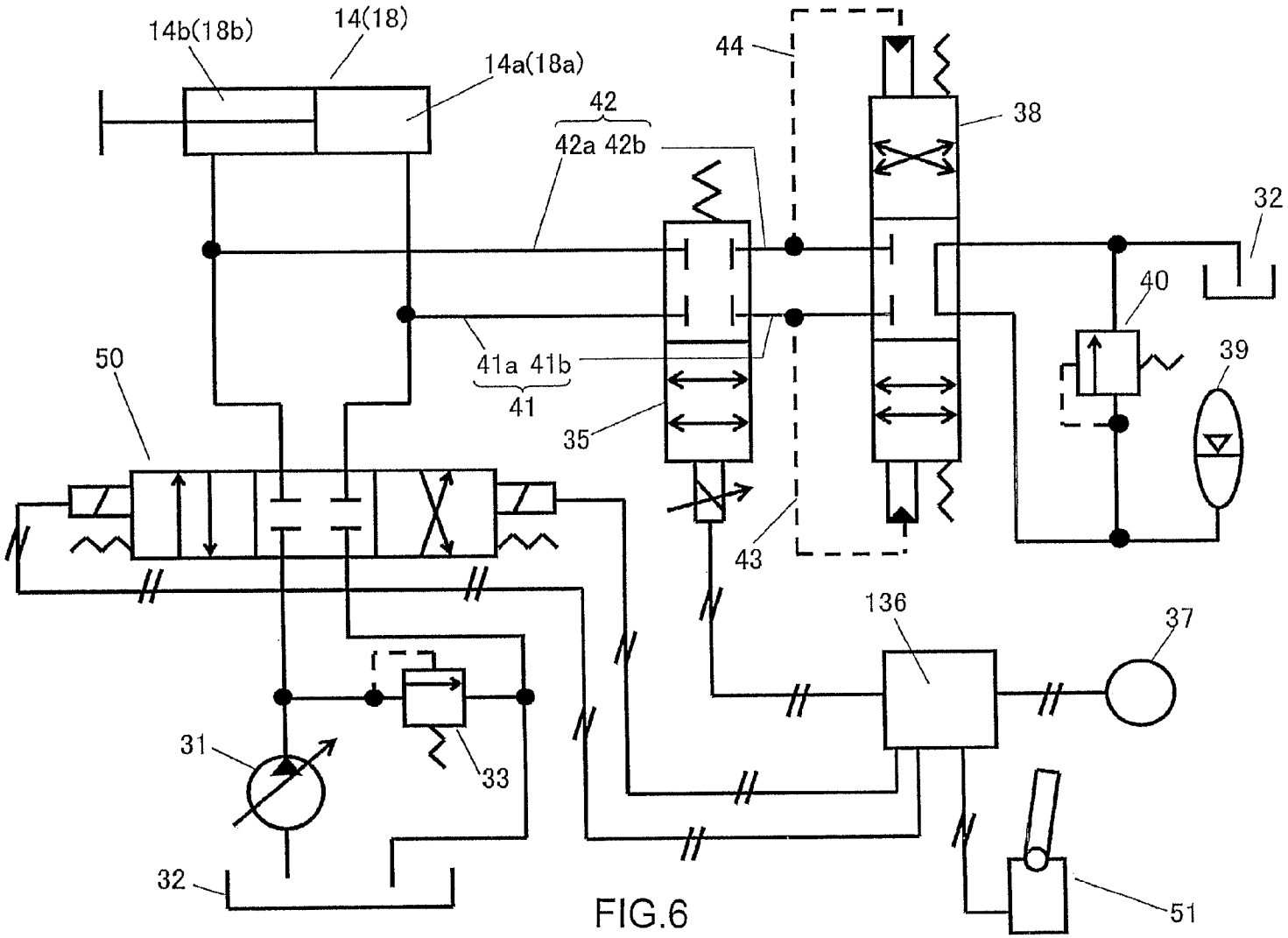
FIG. 6 shows an example of a variation that may be adopted in the hydraulic circuits.
Figure 7:
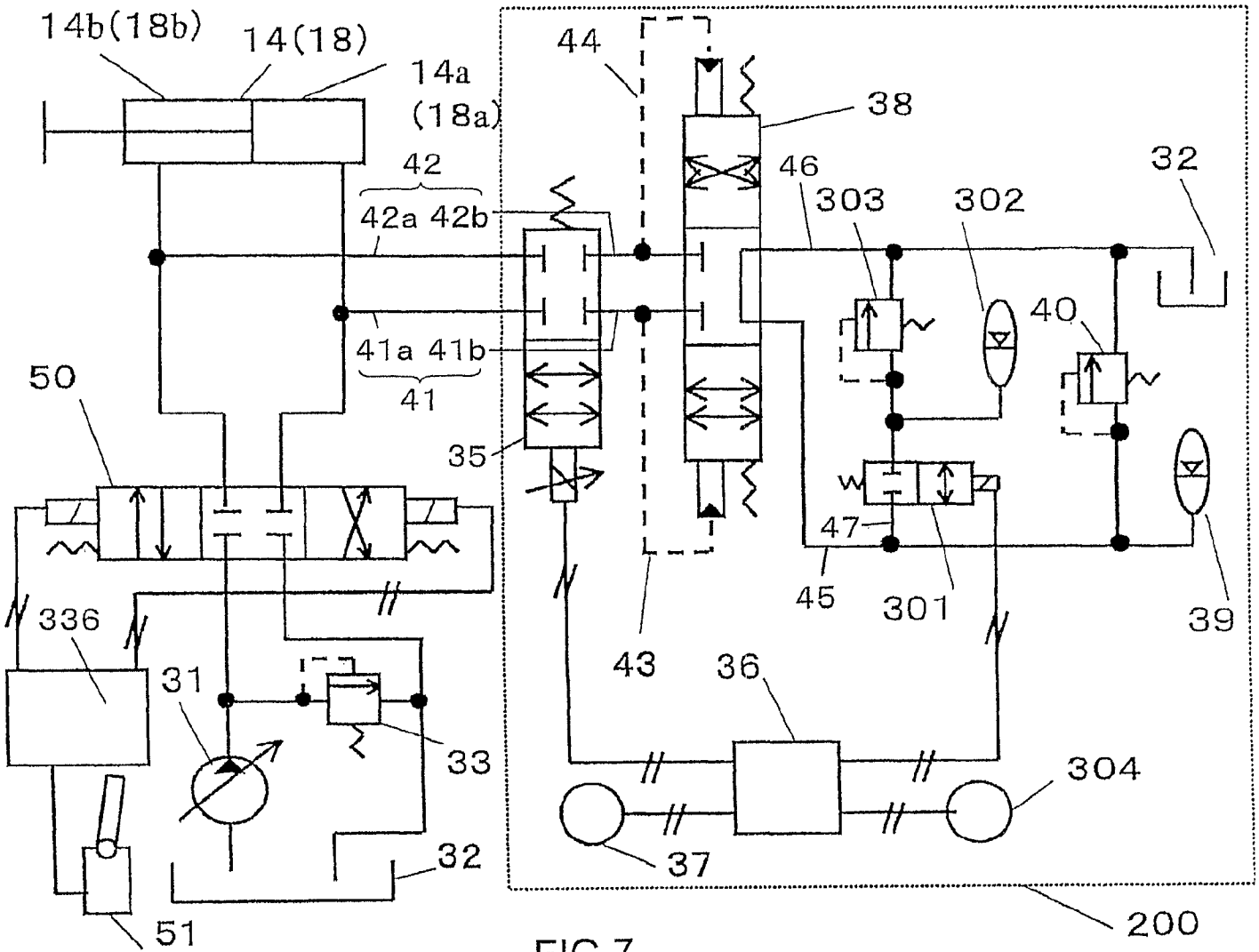
FIG. 7 shows an example of a variation that may be adopted in the hydraulic circuits.

Examples of Variations (1) While the explanation is given above on an assumption that the spool at the control valve 30 is driven as the pilot pressure oil is controlled with the operation lever 34, the present invention is not limited to this example. For instance, a control valve 50 may be controlled via an electric lever as shown in FIGS. 6 and 7. Reference numeral 51 indicates an electric operation lever and reference numeral 136 indicates a control circuit in the example presented in FIG. 6. The control circuit 136 outputs a command value corresponding to the extent to which the electric operation lever 51 is operated to the solenoid at the control valve 50 and selects the operating position of the electromagnetic switching valve 35 in correspondence to the ON/OFF state of the ON/OFF switch 37. Reference numeral 51 indicates an electric operation lever and reference numeral 336 indicates a control circuit in the example presented in FIG. 7. The control circuits 336 outputs a command value corresponding to the extent to which the electric operation lever 51 is operated to the solenoid at the control valve 50. It is to be noted that while the work load follow-up device 200 in FIG. 6 represents an example of a variation of the work load follow-up device 200 in the first embodiment and the work load follow-up device 200 in FIG. 7 represents an example of a variation of the work load follow-up device 200 in the second embodiment, the present invention is not limited to these examples.

Figure 8:
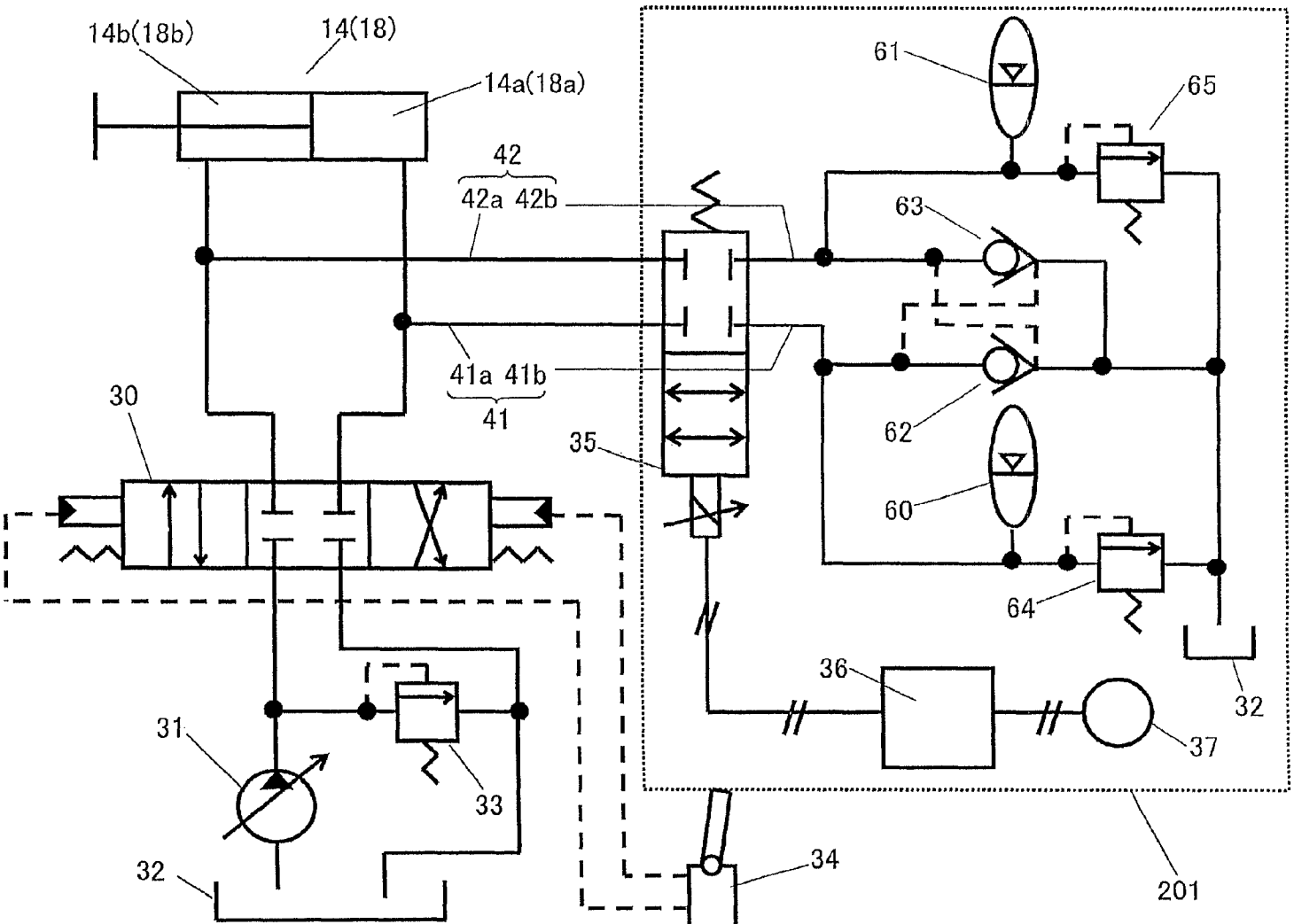
FIG. 8 shows an example of a variation that may be adopted in the hydraulic circuits.

(2) While the pressure oil in the high-pressure side oil chamber is absorbed and collected at a single accumulator 39 in the explanation provided above, the present invention is not limited to this example. For instance, the present invention may be adopted in a structure such as that shown in FIG. 8 with accumulators 60 and 61 disposed respectively in parallel to pilot check valves 62 and 63 at the oil passages 41*b* and 42*b* on the downstream side of the electromagnetic switching valve 35 and relief valves 64 and 65 disposed in series at the accumulators 60 and 61 respectively on the downstream side of the accumulators 60 and 61. In this case, as the oil passages 41*a* and 42*a* come into communication with the oil passages 41*b* and 42*b*, the oil chambers 14*a* and 14*b* at the boom cylinder 14 become connected to the accumulators 60 and 61 respectively. When the pressure in either oil chamber increases, the pressure oil in the high-pressure side oil chamber is absorbed and collected at the corresponding accumulator 60 or 61. Namely, the accumulators 60 and 61 functioning as spring elements in the work load follow-up device 201 allow the movement of the boom 13 to follow the displacement of the work target object which constitutes the work load. As a result, advantages similar to those explained earlier are achieved. It is to be noted that the work load follow-up device 201 assuming the structure shown in FIG. 8 does not require a control valve 38.

(3) While no special mention is included in the explanation above with regard to the type of accumulator that should constitute the accumulator 39, the accumulator 39 may be, for instance, a bladder-type hydro-pneumatic accumulator, a spring-loaded accumulator or a piston-type accumulator.

Figure 9:
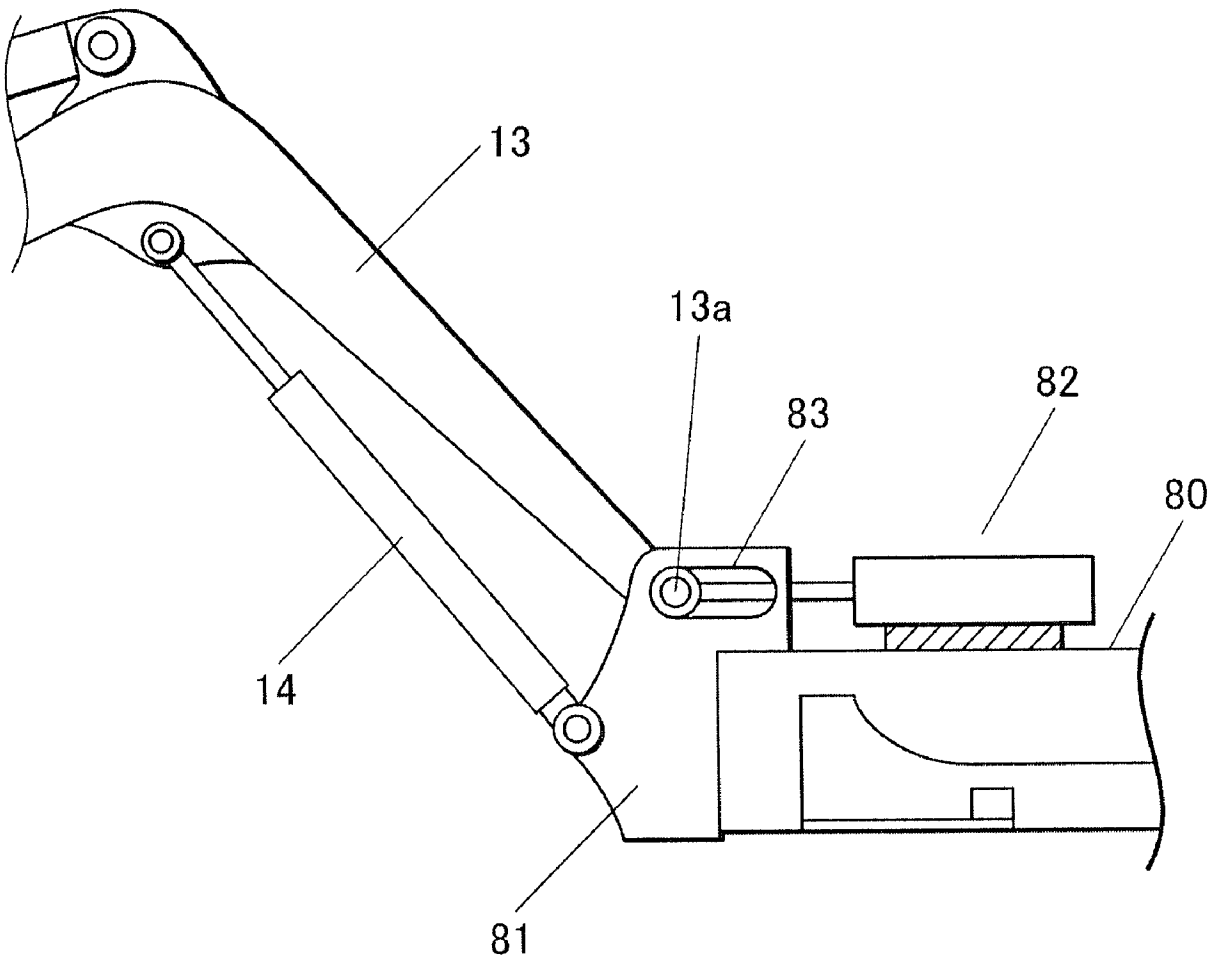
FIG. 9 presents an example of a variation.

(4) While the work load follow-up devices 200 are each connected to one of the hydraulic circuits through which the pressure oil is supplied to the boom cylinder 14 and the work tool cylinder 18 in the explanation above, the present invention is not limited to this example. For instance, the present invention may be adopted in a structure such as that shown in FIG. 9 with a special follow-up cylinder 82 fixed to a frame 80 of the revolving superstructure 11. The structure further includes a bracket 81 that allows a base end portion 13*a* of the boom 13 to slide toward the front and the rear (along the left/right direction in the figure) of the construction machine 100 through a slide groove 83. The cylinder rod front end of the follow-up cylinder 82 is connected to the base end portion 13*a* of the boom 13 with a pin and a work load follow-up device 200 is connected to a hydraulic circuit through which pressure oil is supplied to the follow-up cylinder 82.

The structure described above allows the base end portion 13*a* of the boom 13 to move along the slide groove 83 so as to adjust the attitude of the boom 13 in correspondence to the displacement of the work target object which constitutes the work load. As a result, advantages similar to those described earlier are achieved.

Figure 10:
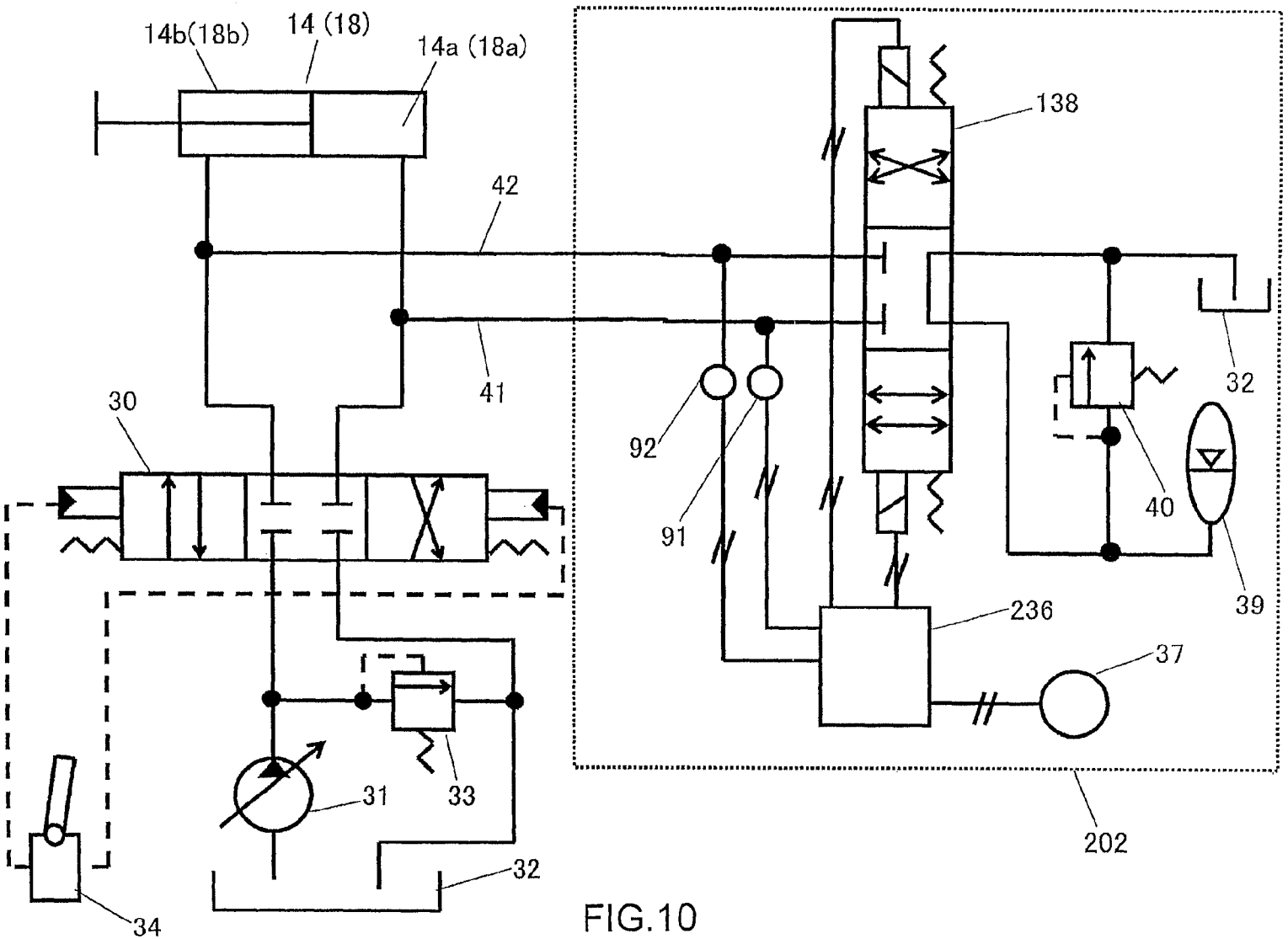
FIG. 10 shows an example of a variation that may be adopted in the hydraulic circuits.
Figure 11:
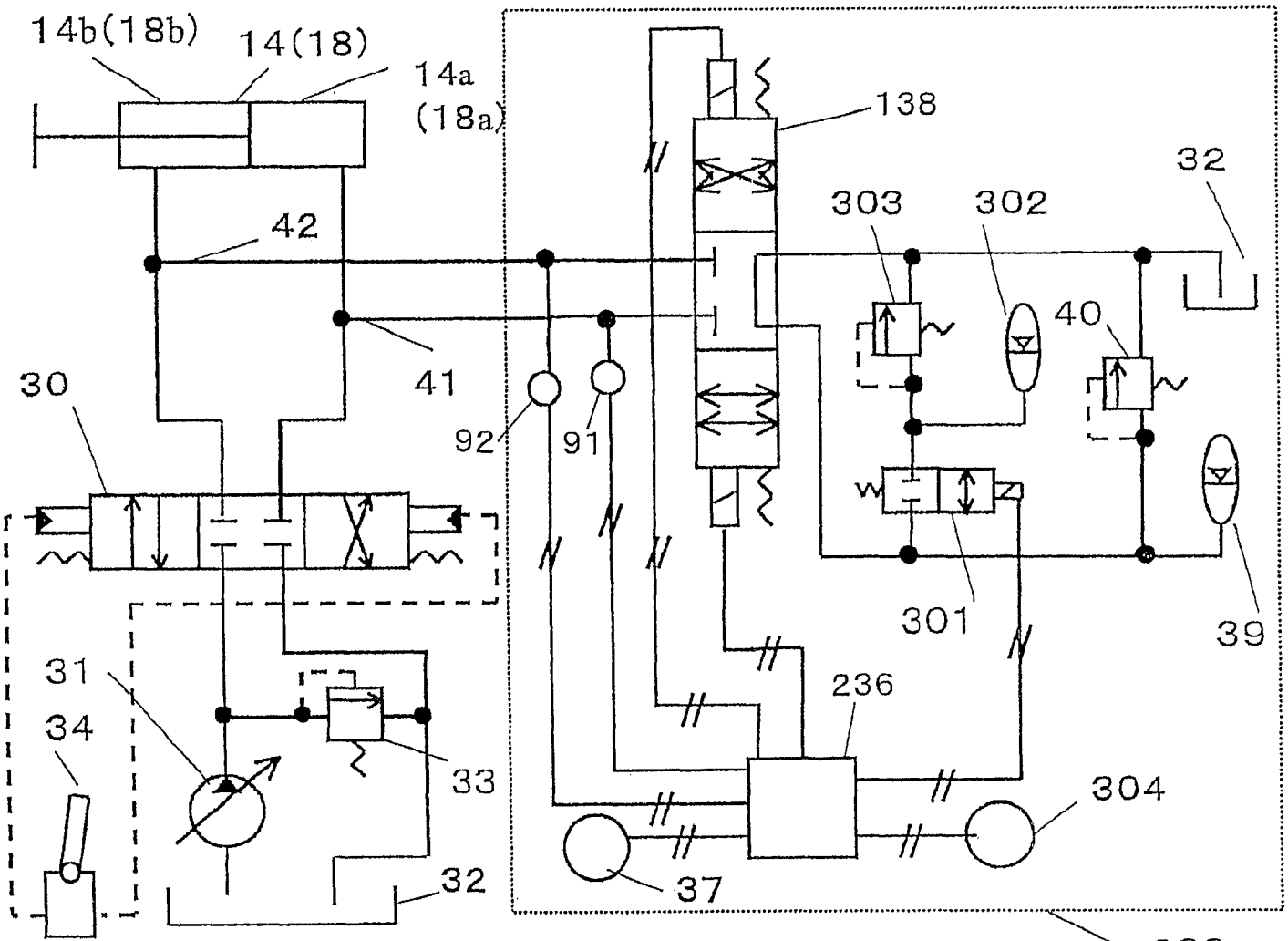
FIG. 11 shows an example of a variation that may be adopted in the hydraulic circuits.

(5) While the spool at the control valve 38 is driven by using the pressure oil from the oil passage 43 connected to the oil passage 41*b* and the pressure oil from the oil passage 44 connected to the oil passage 42*b* as the pilot pressure oil in the explanation provided above, the present invention is not limited to this example. The present invention may instead be adopted in structures such as those shown in FIGS. 10 and 11, with an electromagnetic control valve 138 disposed in place of the control valve 38 and pressure sensors 91 and 92 installed respectively at the oil passages 41 and 42. In the examples shown in FIGS. 10 and 11, a control circuit 236 excites/demagnetizes the solenoid at the control valve 138 in correspondence to the pressures detected via the pressure sensors 91 and 92 and the ON/OFF state of the ON/OFF switch 37 to select the optimal spool position at the control valve 138. In these examples too, advantages similar to those described earlier are achieved. A work load follow-up device 202 assuming the structure shown in either FIG. 10 or FIG. 11 does not require the electromagnetic switching valve 35. It is to be noted that while the work load follow-up device 202 in FIG. 10 represents an example of a variation of the work load follow-up devices 200 in the first embodiment and the work load follow-up device 202 in FIG. 11 represents an example of a variation of the work load follow-up devices 200 in the second embodiment, the present invention is not limited to these examples.

(6) While the pressure oil in the high-pressure side oil chamber is absorbed and collected and the pressure oil having been collected is then released in the hydraulic circuit which supplies the pressure oil to the hydraulic cylinder in order to operate the front work arm 10 in conformance to the displacement of the work target object which constitutes the work load in the explanation provided above, the present invention is not limited to this example. For instance, the present invention may be adopted in a structure with a mechanical spring disposed between the cylinder and the front work arm 10 so as to operate the front work arm 10 in conformance to the displacement of the work target object which constitutes the work load as the spring extends/contracts.

(7) While the pressure oil in the high-pressure side oil chamber is absorbed and collected and the pressure oil having been collected is then released via the work load follow-up devices 200 engaged in operation in conjunction with the boom cylinder 14 and the work tool cylinder 18 in the explanation provided above, the present invention is not limited to this example. The work load follow-up devices 200 may instead be engaged in operation to absorb and collect the pressure oil in the high-pressure side oil chambers and then release the pressure oil having been collected in conjunction with the boom cylinder 14 and the arm cylinder 16, or the work load follow-up devices 200 may be engaged in operation to absorb and collect the pressure oil in the high-pressure side oil chambers and then to release the pressure oil having been collected in conjunction with the arm cylinder 16 and the work tool cylinder 18.

(8) While the electromagnetic switching valve 35 is electrically operated in response to an on/off operation of the ON/OFF switch 37 in the explanation provided above, the present invention is not limited to this example. For instance, a manual switching valve instead of the electromagnetic switching valve 35, may be utilized to allow the operator to directly operate the switching valve manually. In addition, the structure shown in FIG. 3 may be modified to include pressure sensors each installed at either the oil passage 41*a* or the oil passage 42*a* so as to enable the drive circuit 36 to switch the electromagnetic switching valve 35 based upon the pressure values detected via the pressure sensors. In this case, the pressure sensors, the drive circuit 36 and the electromagnetic switching valve 35 together function as a switching means for selecting either to follow or not follow the work load.

(9) While the pressure oil in the oil passage 45 is released into the oil passage 46 via the relief valve 40 in the explanation provided above, the present invention is not limited to this example and a proportional electromagnetic pressure control valve may be installed in place of the relief valve 40. The use of the proportional electromagnetic pressure control valve allows any value to be set as the maximum value for the pressure of the pressure oil applied to the accumulator 39 and thus, a high level of versatility is assured for the construction machine 100 with regard to the type of work it performs.

(10) It is to be noted that a work load follow-up device 200 structured as described earlier may be connected to the hydraulic circuit through which pressure oil is supplied to the cylinder 20. In this case, when the ON/OFF switch 37 is in the ON state and the pressure in the bottom-side oil chamber (not shown) at the cylinder 20 increases as the work target object (gripping target object) becomes gripped, the bottom chamber comes into communication with the accumulator 39 via the electromagnetic switching valve 35 and the control valve 38. Since this prevents a sudden increase in the gripping force after the gripping claws 19 grip the work target object, damage to the gripping target object due to an excessive gripping force is prevented. In other words, the gripping target object can be gripped gently. In addition, even if the work target object comes into contact with a gripping claw 19 inadvertently, damage to the work target object or the gripping claw 19 can be prevented since the gripping claw 19 will move along the closing direction or the opening direction in correspondence to the contact force.

(11) While the work load follow-up device 200 is installed only in the hydraulic circuit for driving the work tool cylinder 18 in the third embodiment described above, the present invention is not limited to this example and the work load follow-up device 200 may instead be installed in the hydraulic circuit for another hydraulic cylinder, such as the arm cylinder 16, which drives the work arm 10. In addition, a plurality of hydraulic circuits that drive hydraulic cylinders may each include a work load follow-up device 200.

(12) The embodiment and variations described above may be adopted in various combinations.

The present invention is not limited to the embodiments described above in any way whatsoever and may be adopted in construction machines assuming various structures, as long as they include a structural element that absorbs and collects the pressure oil in an oil chamber where the pressure has risen in response to a work load and releases the pressure oil having been absorbed and collected once the work load is eliminated (or reduced) to allow the pressure oil to flow back into the initial oil chamber and a structural element that allows/disallows absorption and collection of the pressure oil.

By adopting any of the first through third embodiment of the present invention and the variations thereof described above, damage to the work arm or the work tool due to an overload can be prevented and a delay in the operating force response can be avoided to assure good operability and sustain the desired level of work efficiency.

Fourth Embodiment

Figure 12:
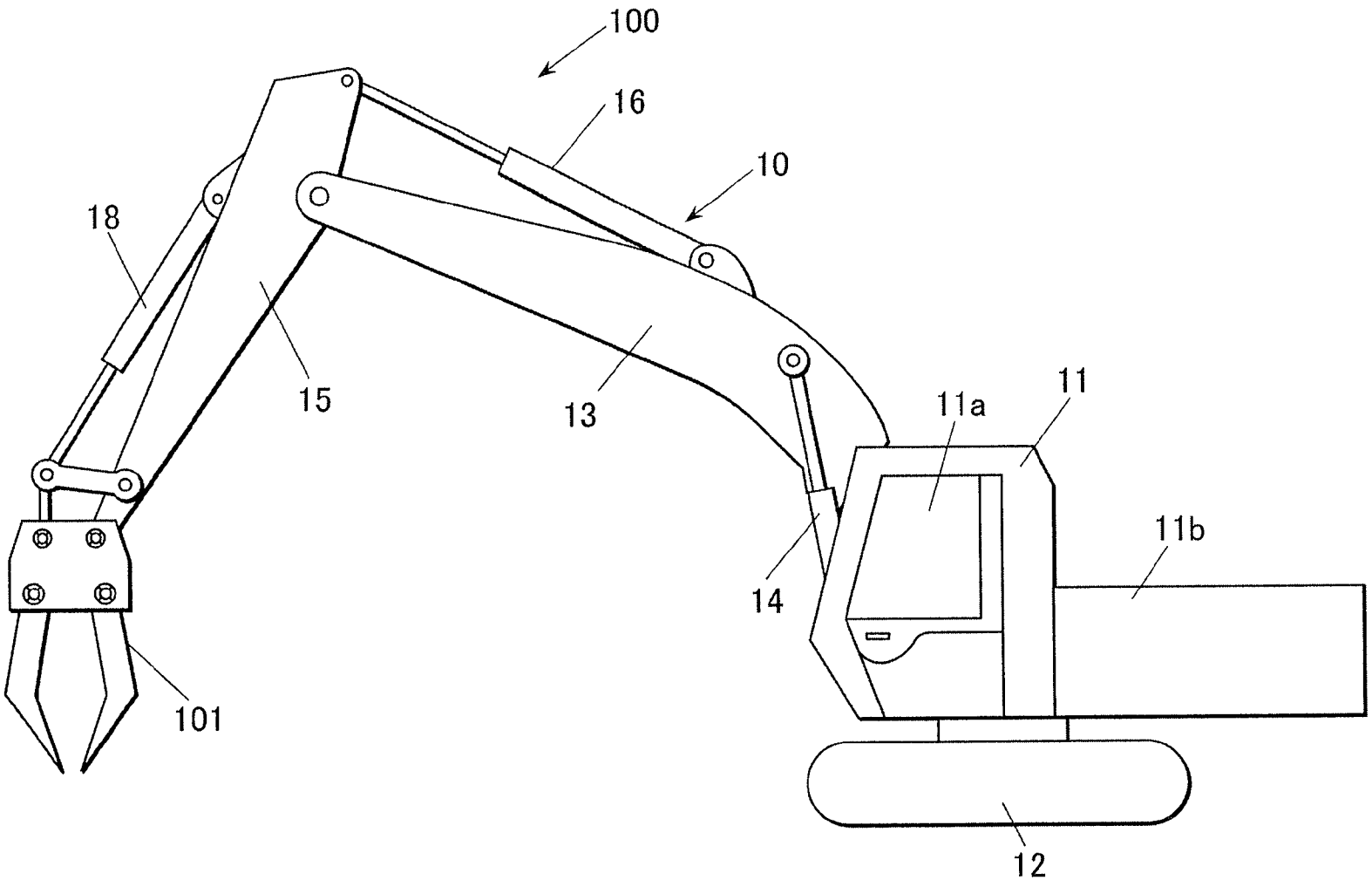
FIG. 12 is an external view of the construction machine achieved in a fourth embodiment.

In reference to FIGS. 12 through 16, the fourth embodiment of the construction machine according to the present invention is explained. As shown in FIG. 12, a revolving superstructure 11 is rotatably mounted at a traveling carriage 12 in a construction machine 100 that includes as its base unit a hydraulic excavator. An operator's cab 11*a* is disposed at the front of the revolving superstructure 11. Behind the operator's cab 11*a*, a main drive device 11*b*, which includes an engine and a hydraulic pump, is disposed.

A front work arm 10 constituted with an articulated arm is mounted at the revolving superstructure 11. The front work arm 10 includes a boom 13 attached to the revolving superstructure 11 so as to swing up/down freely via a boom cylinder 14, an arm 15 connected to the boom 13 and mounted so as to swing up/down freely via an arm cylinder 16 and a gripping device 101, which is a work tool connected to the front end of the arm 15 so as to rotate freely along the up/down direction via a work tool cylinder 18.

Figure 13:
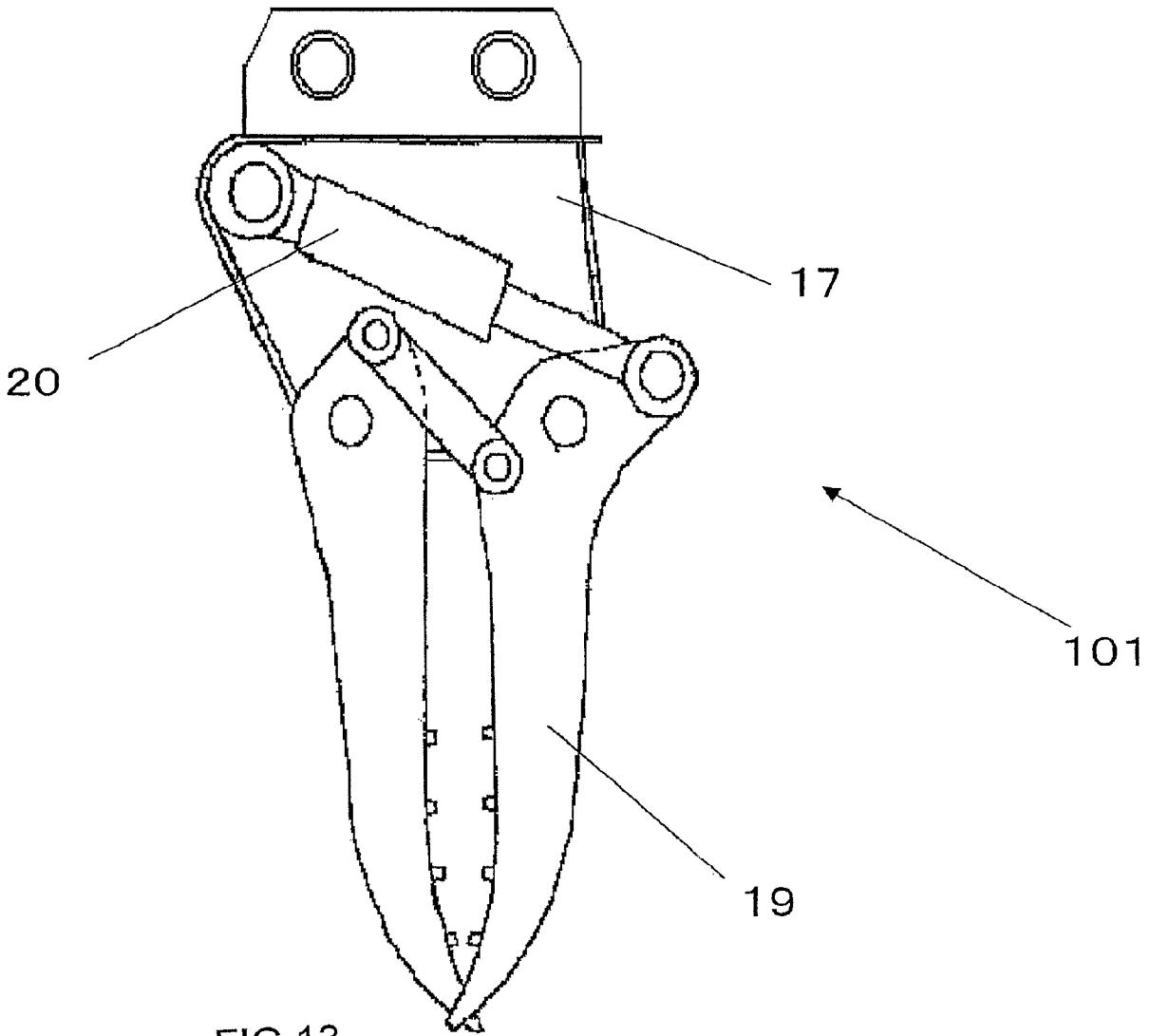
FIG. 13 shows the structure of the gripping device.

FIG. 13 shows the structure of the gripping device 101. The gripping device 101 includes a gripping device body 17 attached to the front end of the arm 15, a pair of gripping claws 19 disposed facing opposite each other so as to be able to grasp and hold a target object between their front ends and a cylinder 20 that drives the gripping claws 19 to engage them in opening/closing operation.

Figure 14:
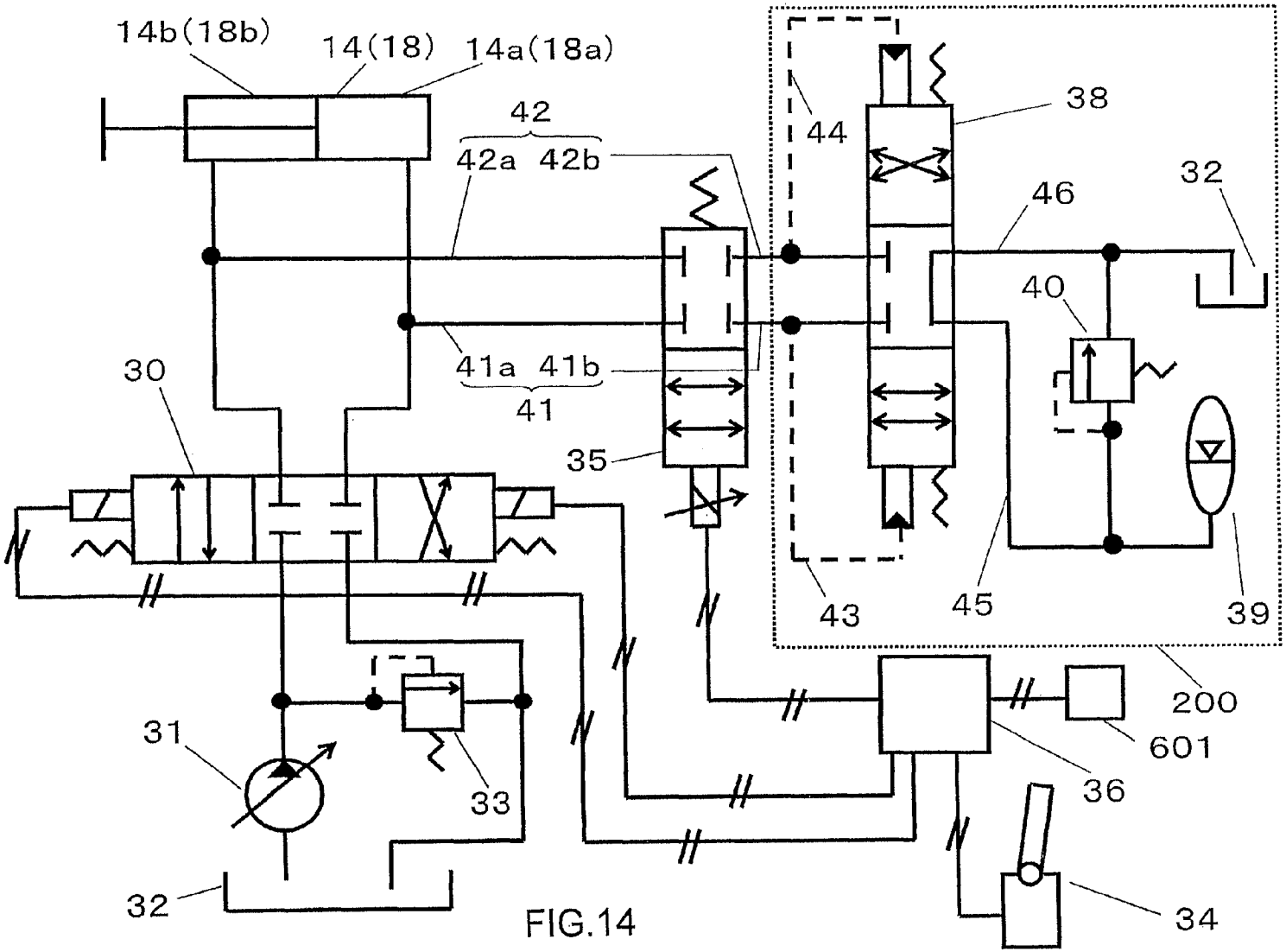
FIG. 14 is a circuit diagram pertaining to the hydraulic circuits that drive the boom cylinder and the work tool cylinder of the construction machine.

FIG. 14 is a circuit diagram pertaining to the hydraulic circuits that drive the boom cylinder 14 and the work tool cylinder 18 in the construction machine 100. While an explanation is given below on the hydraulic circuit that drives the boom cylinder 14, the hydraulic circuit that drives the work tool cylinder 18 assumes an identical structure. In addition, while an electromagnetic switching valve 35 and a work load follow-up device 200 to be detailed later in the description of the hydraulic circuits for driving the boom cylinder 14 and the work tool cylinder 18 are not included in the hydraulic circuit that drives the cylinder 20, the hydraulic circuit adopts a structure which is otherwise similar to that of the hydraulic circuits for driving the cylinders 14 and 18.

A main pump 31, a control valve 30, a main relief valve 33, a hydraulic operating fluid reservoir 32, an electromagnetic switching valve 35 and a workload follow-up device 200 are installed to form the hydraulic circuit. In addition, the hydraulic circuit includes an operation lever 34 and a control circuit 36 for controlling the control valve 30. The operation lever 34 is an electrically operated lever normally referred to as an electric lever. An ON/OFF switch 601 installed in the operator's cab 11*a* is connected to the control circuit 36.

As the main pump 31, by which pressure oil is supplied to the various actuators of the construction machine 100, is driven by an engine (not shown), the hydraulic operating fluid in the hydraulic operating fluid reservoir 32 is delivered to the boom cylinder 14 via the control valve 30. The pressure oil from the main pump 31 is also delivered to the arm cylinder 16, the work tool cylinder 18 and the cylinder 20 via corresponding control valves (not shown). The maximum pressure in this hydraulic circuit is defined via the main relief valve 33.

The work load follow-up device 200 includes a control valve 38, an accumulator 39 and a relief valve 40. Via the electromagnetic valve 35, installed in the oil passages 41 and 42 connecting the boom cylinder 14 and the control valve 38, the upstream side (oil passages 41*a* and 42*a*) of the oil passages 41 and 42 are allowed to communicate with the downstream side (oil passages 41*b* and 42*b*) of the oil passages 41 and 42 or the upstream side of the oil passages 41 and 42 is disconnected from the downstream side of the oil passages 41 and 42. The electromagnetic switching valve 35 is connected with the control circuit 36, which selects the operating position of the electromagnetic switching valve 35. The oil passage 41*a* is connected to a bottom-side oil chamber 14*a* at the boom cylinder 14, whereas the oil passage 42*a* is connected to a rod-side oil chamber 14*b* at the boom cylinder 14.

The control valve 38 switches the state of connection of the oil passages 41*b* and 42*b* to the oil passages 45 and 46 by selecting a spool position in correspondence to the pressures in the oil passages 41*b* and 42*b*. Namely, the pressure oil from an oil passage 43 connected to the oil passage 41*b* and from an oil passage 44 connected to the oil passage 42*b* as pilot pressure oil at the control valve 38 to drive the spool. When the pressures in the oil passages 41*b* and 42*b* are both low or when the pressures in the oil passages 41*b* and 42*b* are substantially equal to each other, the spool at the control valve 38 assumes the neutral position, disconnecting the oil passages 41*b* and 42*b* from the oil passages 45 and 46.

As the pressure in the oil passage 41*b* increases and the pressure in the oil passage 42*b* decreases, the spool at the control valve 38 shifts from the neutral position and, as a result, the oil passage 41*b* becomes connected to the oil passage 45 and the oil passage 42*b* becomes connected to the oil passage 46. If, on the other hand, the pressure in the oil passage 41*b* becomes lower and the pressure in the oil passage 42*b* becomes higher, the spool at the control valve 38 shifts from the neutral position to connect the oil passage 41*b* to the oil passage 46 and the oil passage 42*b* to the oil passage 45. In other words, when the pressure in either the oil passage 41*b* or the oil passage 42*b* becomes high and the pressure in the other oil passage becomes low, the oil passage where the pressure is high is connected to the oil passage 45 and the oil passage where the pressure is low is connected to the oil passage 46 via the control valve 38.

The accumulator 39 is connected to the oil passage 45 to absorb the pressure oil in the oil passage 45 or release pressure oil it has accumulated into the oil passage 45. Once the pressure in the oil passage 45 exceeds a preset pressure level, the pressure oil in the oil passage 45 is released into the oil passage 46 via the relief valve 40. The relief valve 40, the pressure level setting for which is lower than the pressure level setting selected for the main relief valve 33, is installed mainly for purposes of protecting the accumulator 39. It is to be noted that the oil passage 46 is connected to the hydraulic operating fluid reservoir 32.

The control circuit 36 outputs a command value corresponding to the extent to which the operation lever 34 is operated to the solenoid at the control valve 30 and selects the operating position of the electromagnetic switching valve 35 based upon the ON/OFF state of the ON/OFF switch 601 and the operating state of the operation lever 34. Conditions set with regard to the selection of the operating position of the electromagnetic switching valve 35 by the control circuit 36 are to be described in detail later. As the solenoid at the electromagnetic switching valve 35 becomes excited by the control circuit 36, the spool is driven so as to set the oil passages 41*a* and 42*a* in communication with the oil passages 41*b* and 42*b*. As the solenoid at the electromagnetic switching valve 35 becomes demagnetized by the control circuit 36, the spool is driven with the force of the spring at the electromagnetic switching valve 35, thereby disconnecting the oil passages 41*a* and 42*a* from the oil passages 41*b* and 42*b*.

As a specific operation lever is operated in the construction machine 100 structured as described above, the spool of the control valve corresponding to the relevant hydraulic cylinder is driven and the hydraulic cylinder is driven at a speed reflecting the extent to which the operation lever is operated. For instance, in response to an operation of the operation lever 34 installed in conjunction with the boom cylinder 14, the control circuit 36 outputs a control signal so as to drive the spool at the control valve 30 in correspondence to the extent to which the operation lever 34 is operated. As a result, the boom cylinder 14 is driven at a speed reflecting the extent to which the operation lever 34 is operated.

As pressure oil is delivered into the bottom-side oil chamber 14*a* at the boom cylinder 14, the boom 13 is driven to swing upward relative to the revolving superstructure 11, whereas if pressure oil is delivered into the rod-side oil chamber 14*b* at the boom cylinder 14, the boom 13 is driven to swing downward relative to the revolving superstructure 11. As pressure oil is delivered into a bottom-side oil chamber (not shown) at the arm cylinder 16, the arm 15 is driven to swing downward relative to the boom 13, whereas if pressure oil is delivered into a rod-side oil chamber (not shown) at the arm cylinder 16, the arm 15 is driven to swing upward relative to the boom 13.

As pressure oil is delivered into a bottom-side oil chamber 18*a* at the work tool cylinder 18, the gripping device 101 is driven to swing downward relative to the arm 15, whereas if pressure oil is delivered into a rod-side oil chamber 18*b*, the gripping device 101 is driven to swing upward relative to the arm 15. As pressure oil is delivered to a bottom-side oil chamber (not shown) at the cylinder 20, the pair of gripping claws 19 are driven along the gripping direction, whereas if pressure oil is delivered into a rod-side oil chamber (not shown) at the cylinder 20, the pair of gripping claws 19 are driven along the releasing direction.

Flowchart

Figure 15:
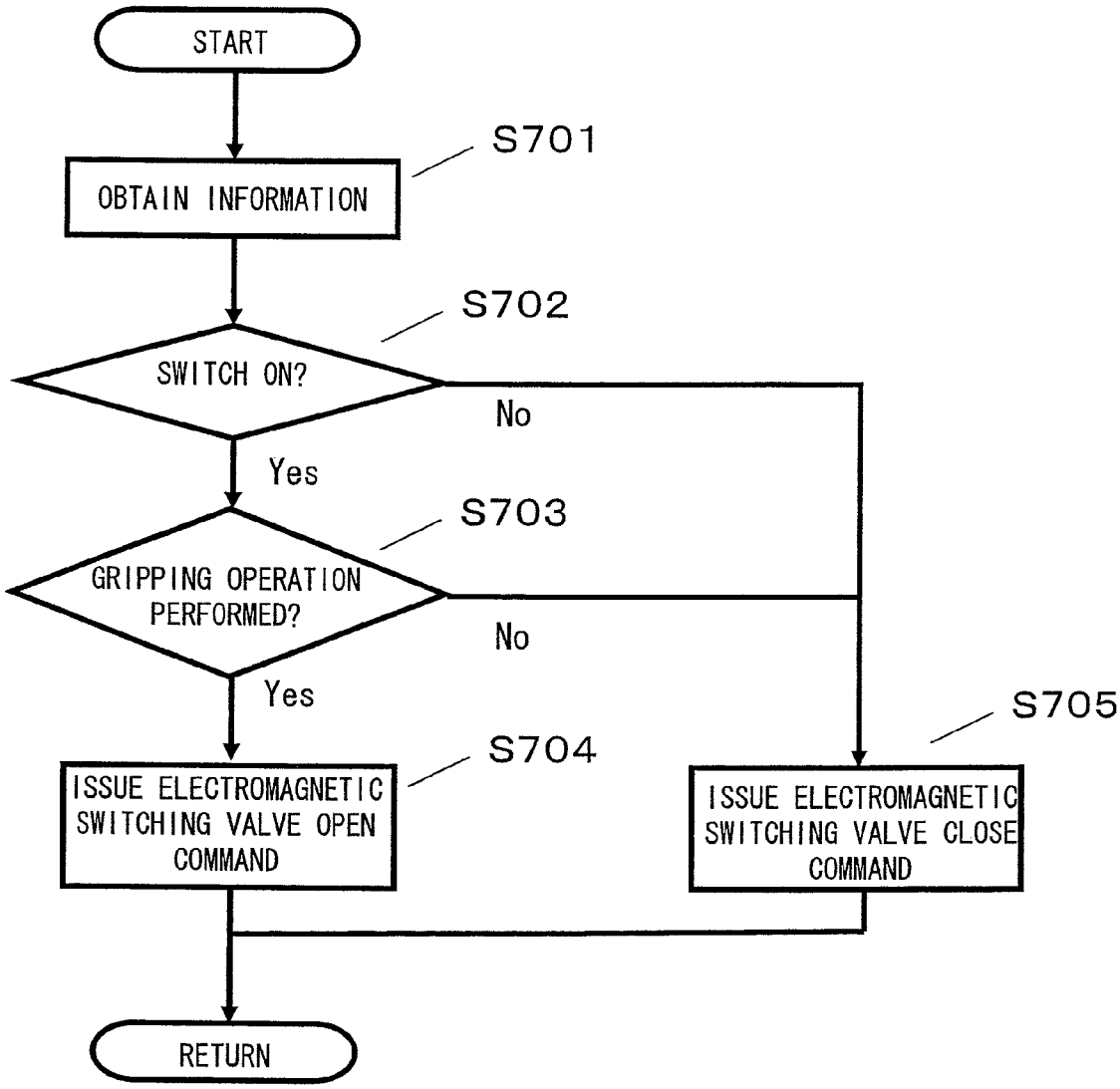
FIG. 15 presents a flowchart of the control processing operation executed to control the electromagnetic switching valve.

FIG. 15 presents a flowchart of the control processing operation executed to control the individual electromagnetic switching valves 35. As an ignition switch (not shown) is turned on at the construction machine 100, the program in conformance to which the processing shown in FIG. 15 is executed is started up and is executed in the control circuit 36. In step S701, information indicating the states assumed at various components of the construction machine 100 is obtained. More specifically, information indicating the extent to which the operation lever 34 has been operated to drive the cylinder 20 for the gripping device 101 and information indicating the state of the ON/OFF switch 601 are obtained. Once step S701 is executed, the operation proceeds to step S702 to make a decision based upon the information having been obtained in step S701 as to whether or not the ON/OFF switch 601 is currently in the ON state.

If an affirmative decision is made in step S702, the operation proceeds to step S703 to determine the operating state of the construction machine 100. More specifically, a decision is made as to whether or not the operation lever 34, which is operated to drive the cylinder 20, has been operated beyond the dead zone so as to grip the target object with the gripping device 101. If an affirmative decision is made in step S703, the operation proceeds to step S704 to output an open command for the electromagnetic switching valve 35, i.e., to excite the solenoid at the electromagnetic switching valve 35, before the operation makes a return. If a negative decision is made in step S702 or in step S703, the operation proceeds to step S705 to output a close command for the electromagnetic switching valve 35, i.e., to demagnetize the solenoid at the electromagnetic switching valve 35, before the operation makes a return.

Operations of the Work Load Follow-Up Device 200 and the Boom Cylinder 14

As the electromagnetic switching valve 35 is controlled as described above, the work load follow-up device 200 and the boom cylinder 14 are engaged in operation as follows. If the ON/OFF switch 601 is in the ON state (an affirmative decision is made in step S702) and the operation lever 34 by which the cylinder 20 is driven has been operated beyond the dead zone so as to grip the target object with the gripping device 101 (an affirmative decision is made in step S703), the solenoid at the electromagnetic switching valve 35 is excited (step S704).

As a result, the oil passages 41*a* and 42*a* are set in communication with the oil passages 41*b* and 42*b* via the electromagnetic switching valve 35, allowing the pressure oil in the bottom-side oil chamber 14*a* and the rod-side oil chamber 14*b* at the boom cylinder 14 to flow into the downstream side of the electromagnetic switching valve 35. In other words, when the ON/OFF switch 601 is in the ON state and the operation lever 34 by which the cylinder 20 is driven has been operated beyond the dead zone along the gripping direction, the behavior of the boom cylinder 14 is affected by the control valve 38 and the accumulator 39. As explained earlier, when pressure oil is delivered into the bottom-side oil chamber 14*a*, the boom 13 is driven to swing upward relative to the revolving superstructure 11 in response to an operation of the operation lever 34 by which the boom 13 is operated, whereas when pressure oil is delivered into the rod-side oil chamber 14*b*, the boom 13 is driven to swing downward relative to the revolving superstructure 11 in response to an operation of the operation lever 34.

With the operation lever 34, by which the boom 13 is operated, remaining in the operating state, the pressure in either the oil chamber 14*a* or the oil chamber 14*b*, to which the pressure oil is supplied via the control valve 30, rises as the gripping claws 19 come into contact with the work target object, in correspondence to the force (work load) with which the gripping claws 19 contact the work target object. Then, as the pressure in either of the oil passages 41*b* and 42*b* in communication with the oil chambers 14*a* and 14*b* becomes high and the pressure in the other oil passage becomes low, the oil passage where the pressure has risen to a high level is connected with the oil passage 45 and the oil passage where the pressure has decreased is connected to the oil passage 46 via the control valve 38. As a result, the pressure oil in either the oil chamber 14*a* or the oil chamber 14*b* (hereafter referred to as the "high-pressure side oil chamber") communicating with the oil passage where the pressure has risen is absorbed by the accumulator 39. Since this allows the accumulator 39 to function as a spring element against the work load, a sudden increase in the work load is prevented.

If the operation lever 34, by which the boom 13 is operated, remains in the operating state after the gripping claws 19 contact the work target object, the pressure oil in the high-pressure side oil chamber (or the pressure oil flowing from the control valve 30 toward the high-pressure side oil chamber) is absorbed and collected at the accumulator 39 until the pressure rises to the pressure level setting selected for the relief valve 40. The pressure oil in the high-pressure side oil chamber (or the pressure oil flowing from the control valve 30 toward the high-pressure side oil chamber) is released from the relief valve 40 into the hydraulic operating fluid reservoir 32 once the pressure rises to the pressure level set for the relief valve 40. Namely, the accumulator 39 is protected via the relief valve 40 which regulates the pressure of the pressure oil applied to the accumulator 39. In addition, the relief valve 40 allows the gripping claws 19 to contact the work target object with a work load or contact force corresponding to the pressure setting selected for the relief valve 40.

If a swinging motion of the arm 15, for instance, causes the gripping claws 19 to contact the work target object while the operation lever 34, by which the boom 13 is operated, is in a non-operating state, the pressure in either the oil chamber 14*a* or the oil chamber 14*b* at the boom cylinder 14 rises to a level corresponding to the work load. When the operation lever 34, by which the boom 13 is operated, is in the non-operating state, the pressure oil in the high-pressure side oil chamber does not flow to the outside via the control valve 30. However, since the oil passages 41*a* and 42*a* are in communication with the oil passages 41*b* and 42*b* via the electromagnetic switching valve 35, the pressure oil in the high-pressure side oil chamber flows into the accumulator 39 via the control valve 38 as explained earlier.

As a result, the pressure oil in the high-pressure side oil chamber is absorbed and collected at the accumulator 39 in correspondence to the work load, and the boom cylinder 14 extends/contracts in correspondence to the quantity of pressure oil accumulated at the accumulator 39 to cause a swinging motion of the boom 13. As the work load is lessened, the pressure oil having been collected at the accumulator 39 flows back into the high-pressure side oil chamber and thus, the boom cylinder 14 extends/contracts. In other words, a swinging motion of the boom 13 corresponding to the level of the work load is induced. Namely, the swinging motion of the boom 13 occurring as the pressure oil in the high-pressure side oil chamber is absorbed and collected at the accumulator 39 and then released from the accumulator 39 in correspondence to the work load, allows the attitude of the front work arm 10 to be adjusted so as to follow the displacement of the work target object coming into contact with the gripping claws 19 to apply an external force to the gripping claws 19. Thus, the attitude of the gripping device 101 is adjusted in correspondence to the external force applied to the gripping claws 19.

If the pressure in the oil passage 45 is equal to or less than the pressure level setting selected for the relief valve 40 at the time of the work load application, the pressure oil in the high-pressure side oil chamber will not have flowed back into the hydraulic operating fluid reservoir 32 via the relief valve 40. Under these circumstances, as the work load application stops and the pressure oil having been collected at the accumulator 39 flows back to the high-pressure side oil chamber, the cylinder rod at the boom cylinder 14 resumes the pre-work load application extension position.

If the pressure in the oil passage 45 exceeds the pressure level setting selected for the relief valve 40 at the time of the work load application, the pressure oil in the high-pressure side oil chamber flows back into the hydraulic operating fluid reservoir 32 via the relief valve 40. Under these circumstances, as the work load application stops and the pressure oil having been collected at the accumulator 39 flows back into the high-pressure side oil chamber, the cylinder rod at the boom cylinder 14 moves back closer to the pre-work load application extension position but stops at a position short of the full pre-work load application extension position by an extent matching the quantity of pressure oil having flowed back into the hydraulic operating fluid reservoir 32.

As described above, when the oil passages 41*a* and 42*a* are set in communication with the oil passages 41*b* and 42*b* via the electromagnetic switching valve 35, the work load follow-up device 200 is able to affect the operation of the boom cylinder 14. In other words, the ON/OFF switch 601 simply needs to be turned on to adjust the attitude of the boom 13 in conformance to the external force applied to the gripping claws 19 when gripping the target object with the gripping device 101.

Figure 16A:
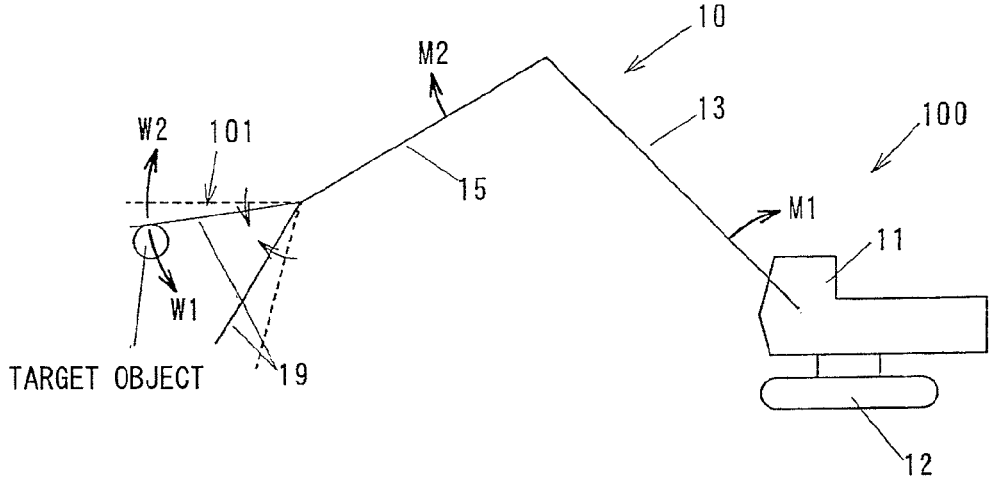
FIGS. 16A and 16B provide conceptual illustrations showing how the attitude of the front work arm changes when gripping a target object, with FIG. 16A showing a state after only one of the gripping claws comes into contact with the target object and 16B showing how the attitude of the front work arm changes as the gripping claws close with one of them remaining in contact with the target object.

For instance, if the gripping target object assumes a position offset from the midpoint between the two gripping claws 19 facing opposite each other, the gripping target object first contacts one of the gripping claws 19 as shown in FIG. 16A. In other words, only one of the gripping claws 19 comes into contact with the target object. As the gripping claws 19 are driven along the closing directions in this state, a force W1 is applied to the gripping target object from the gripping claw 19 having come into contact with the target object and, at the same time, a force W2 is applied to the gripping claw 19 having come into contact with the target object as a reaction to the force W1. Bending moments M1 and M2 are applied to the boom 13 and the arm 15 respectively due to the force W2 applied to the gripping claw 19.

If the force W1 is excessive, the target object may be damaged, whereas when the force W2 is excessive, the front work arm 10 may be damaged due to an overload. However, as long as the ON/OFF switch 601 is in the ON state when gripping the target object with the gripping device 101, the oil passages 41*a* and 42*a* are in communication with the oil passages 41*b* and 42*b* via the electromagnetic switching valve 35, as explained earlier, and thus, the pressure oil in the high-pressure side oil chamber at the boom cylinder 14, where the pressure has risen due to the bending moment M1, is absorbed into the accumulator 39. In other words, the accumulator 39 functions as a spring element that works against the bending moment M1 resulting from the force W2.

Figure 16B:
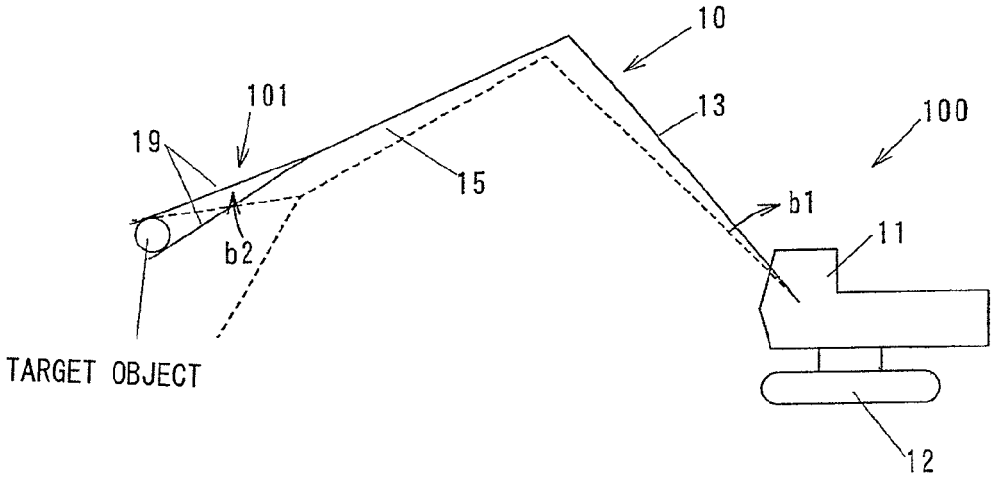

Consequently, the boom 13 rotates as indicated by the arrow b1 in FIG. 16B so as to lessen the bending moment M1. As a result, the gripping device 101 moves as indicated by the arrow b2 and the target object is gripped at the midpoint between the two gripping claws 19 facing opposite each other. Since the structure described above prevents a sudden increase in any of the force W2 applied to the gripping claw 19, the force W1 applied to the target object and the bending moments M1 and M2, damage to the gripping target object and the front work arm 10 is effectively prevented. The structure described above is ideal in applications in which a light load must be handled delicately.

The oil passages 41*a* and 42*a* are disconnected from the oil passages 41*b* and 42*b* by the electromagnetic switching valve 35 when the ON/OFF switch 601 is in the OFF state, and thus, the pressure oil in the bottom-side oil chamber 14*a* and the rod-side oil chamber 14*b* at the boom cylinder 14 does not flow into the downstream side of the electromagnetic switching valve 35. In this situation, the behavior of the boom cylinder 14 is not affected by the operations of the control valve 38 and the accumulator 39. Thus, if pressure oil is delivered into the bottom-side oil chamber 14*a*, the boom 13 is driven to swing upward relative to the revolving superstructure 11 in response to an operation of the operation lever 34 by which the boom 13 is operated, whereas if pressure oil is delivered into the rod-side oil chamber 14*b*, the boom 13 is driven to swing downward relative to the revolving superstructure 11.

As the gripping claws 19 come into contact with the work target object and the swinging motion of the boom 13 stops with the operation lever 34, by which the boom 13 is operated, remaining in the operating state, the pressure of the pressure oil supplied to the boom cylinder 14 rises to the level defined by the main relief valve 33. If a swinging motion of the arm 15, for instance, causes the gripping claws 19 to contact the work target object while the operation lever 34, by which the boom 13 is operated, is in a non-operating state, the pressure in either the oil chamber 14*a* or the oil chamber 14*b* at the boom cylinder 14 rises to a level corresponding to the work load. When the operation lever 34, by which the boom 13 is operated, is in the non-operating state, the flow of pressure oil in the oil chambers 14*a* and 14*b* at the boom cylinder 14 to the outside is blocked at the control valve 30 and the electromagnetic switching valve 35 and thus, the boom 13 does not swing.

As described above, when the oil passages 41*a* and 42*a* are cut off from the oil passages 41*b* and 42*b* by the electromagnetic switching valve 35, the work load follow-up device 200 is not able to affect the operation of the boom cylinder 14. In other words, the ON/OFF switch 601 should be turned off when the attitude of the boom 13 is not to be adjusted in conformance to the external force applied to the gripping claws 19 when gripping the target object with the gripping device 101.

The hydraulic circuit that drives the work tool cylinder 18 also includes a work load follow-up device 200 in the construction machine 100 achieved in the embodiment. Since the operation of the work tool cylinder 18 is similar to the operation of the boom cylinder 14 described above, its explanation is omitted. A setting for allowing/not allowing the boom cylinder 14 to operate in conformance to the external force applied to the gripping claws 19 and a setting for allowing/not allowing the work tool cylinder 18 to operate in conformance to the external force applied to the gripping claws 19 can be selected individually as desired. For instance, when both the boom cylinder 14 and the work tool cylinder 18 are set to operate in conformance to the external force applied to the gripping claws 19, two articulating joints are allowed to rotate in conformance to the external force applied to the gripping claws 19, doubling the level of freedom of movement. In this case, the front work arm 10 is able to follow a wider range of directions along which the external force may be applied.

By selecting the settings allowing neither the boom cylinder 14 nor the work tool cylinder 18 to operate in conformance with the external force applied to the gripping claws 19, the construction machine can be engaged in work operation in much the same way as work machines in the related art that do not include work load follow-up devices 200. In addition, either the boom cylinder 14 or the work tool cylinder 18 alone may be allowed to operate in conformance to the external force applied to the gripping claws 19. In short, optimal settings should be selected by operating the respective ON/OFF switches 601 in correspondence to the specific details of the work to be performed.

The following operational advantages can be achieved with the construction machine 100 achieved in the fourth embodiment of the present invention described above.

(1) The construction machine includes the work load follow-up devices 200, which allow the front work arm 10 to move in conformance to the external force applied to the gripping claws 19 and the setting for allowing/not allowing the front work arm 10 to move in conformance to the external force applied to the gripping claws 19 can be selected by turning on/off the ON/OFF switch 601. As a result, damage to the front work arm 10 due to an overload is prevented and, at the same time, a delay in the operating force response is prevented, which, in turn, assures the desired level of operability. Thus the work efficiency is not compromised. In addition, since the front work arm 10 can move in conformance to the external force applied to the gripping claws 19, the gripping device 101 can be engaged in a force following operation over the contour of a wall surface, a base surface or the like to assure a higher level of convenience. For instance, a force following operation such as ground leveling can be executed with ease by mounting a bucket instead of the gripping device 101 as the work tool. Furthermore, the front work arm 10 is made to operate in conformance to the external force applied to the gripping claws 19 by judging the work condition, i.e., by making a decision as to whether or not the construction machine is engaged in a gripping operation via the gripping device 101. Since this reduces the number of times the operator needs to perform a selecting operation (switching operation) to indicate whether or not to operate the front work arm 10 in conformance to the external force, the operability and the work efficiency are both improved.

(2) The movement of the front work arm 10 is made to conform to the external force applied to the gripping claws 19 by judging the operating state of the construction machine 100 based upon the operating condition of the gripping device 101. The gripping device 101, which is engaged in primary work operation of the construction machine 100, may be regarded as a device that most accurately reflects the operating state of the construction machine 100. In other words, the operating state of the construction machine 100 can be judged accurately based upon the operating condition of the gripping device and, as a result, optimal control can be executed with regard to whether or not to operate the front work arm 10 in conformance to the external force applied to the gripping claws 19 to improve both the operability and the work efficiency.

The operating state of the construction machine 100 is judged based upon the extent to which the operation lever 34, by which the cylinder 20 is driven, is operated. Since the extent to which the operation lever 34 is operated is detected in the control circuit 36 in the related art for purposes of executing control on the control valve 30, there is no need to add a new device or the like to enable the decision-making with regard to the operating state. Thus, the cost can be minimized. In addition, since the extent to which the operation lever 34 is operated can be detected with ease, the operating state of the construction machine 100 can be judged with ease and, as a result, the design cost related to the operating state decision-making operation can be reduced.

(4) A structure that allows the attitude of the boom 13 to conform to the external force applied to the gripping claws 19 is achieved by connecting an electromagnetic switching valve 35 and a work load follow-up device 200 to the hydraulic circuit that drives the boom cylinder 14. In addition, a structure that allows the attitude of the gripping device 101 to conform to the external force applied to the gripping claws 19 is achieved by connecting an electromagnetic switching valve 35 and the work load follow-up device 200 to the hydraulic circuit that drives the work tool cylinder 18. When a work tool includes a spring device attached thereto as in the related art, greater load capacity must be assured and the operability of such a work tool is bound to be poorer due to the presence of the spring device. As a result, work efficiency cannot be achieved. The operation of the construction machine according to the present invention, however, is not affected by such negative factors. In addition, since damage to the front work arm 10 attributable to the work load applied to the gripping claws 19 is prevented through a simple structure, an increase in the cost can be minimized. It is to be noted that since the present invention may be adopted in an existing construction machine simply by connecting the electromagnetic switching valve 35 and the work load follow-up device 200 in the oil passage to a hydraulic cylinder, the follow-up function of executing operation in conformance to the external force applied to the gripping claws 19 can be added in the existing construction machine at low cost.

(5) The setting for allowing/not allowing the boom cylinder 14 to operate in conformance to the external force applied to the gripping claws 19 and the setting for allowing/not allowing the work tool cylinder 18 to operate in conformance to the external force applied to the gripping claws 19 can be individually selected as desired. By allowing both the boom cylinder 14 and the work tool cylinder 18 to operate in conformance to the external force applied to the gripping claws 19, two articulating joints are allowed to rotate in conformance to the external force, doubling the level of freedom in movement of the front work arm. As a result, the front work arm 10 is able to follow a wider range of work target object displacement and the risk of damage to the front work arm 10 can be greatly reduced. In addition, depending upon the specific details of the work to be performed, either the boom cylinder 14 or the work tool cylinder 18 alone is set to operate in conformance to the external force applied to the gripping claws 19 or the settings allowing neither the boom cylinder 14 nor the work tool cylinder 18 to operate in conformance to the external force applied to the gripping claws 19 may be selected. In short, optimal settings can be selected with a high level of flexibility to best suit the specific details of the work to be performed.

(6) As the pressure oil in the high-pressure side oil chambers at the boom cylinder 14 and the work tool cylinder 18 is absorbed and collected in the accumulators 39 and then released from the accumulators 39, the front work arm 10 is allowed to move in conformance to the external force applied to the gripping claws 19. In addition, the setting for allowing or not allowing the pressure oil in a high-pressure side oil chamber to be absorbed at the corresponding accumulator 39 is selected via the electromagnetic switching valve 39. Thus, the cylinder rods of the boom cylinder 14 and the work tool cylinder 18 are allowed to extend/contract in conformance to the external force applied to the gripping claws 19 and also the extend/contract allow/disallow settings for the cylinder rods of the boom cylinder 14 and the work tool cylinder 18 can be selected through hydraulic circuits adopting a simple circuit structure. This means that stable and reliable operation is assured at low cost.

(7) Since the pressure oil in a high-pressure side oil chamber is guided to the corresponding accumulator 39 via the control valve 38, only a single accumulator 39 is required, which contributes to cost reduction. Furthermore, since the spool at the control valve 38 is driven with the pressure oil from the high-pressure side oil chamber used as the pilot pressure oil, a high level of operational reliability is assured through a simple structure.

Fifth Embodiment

Figure 17:
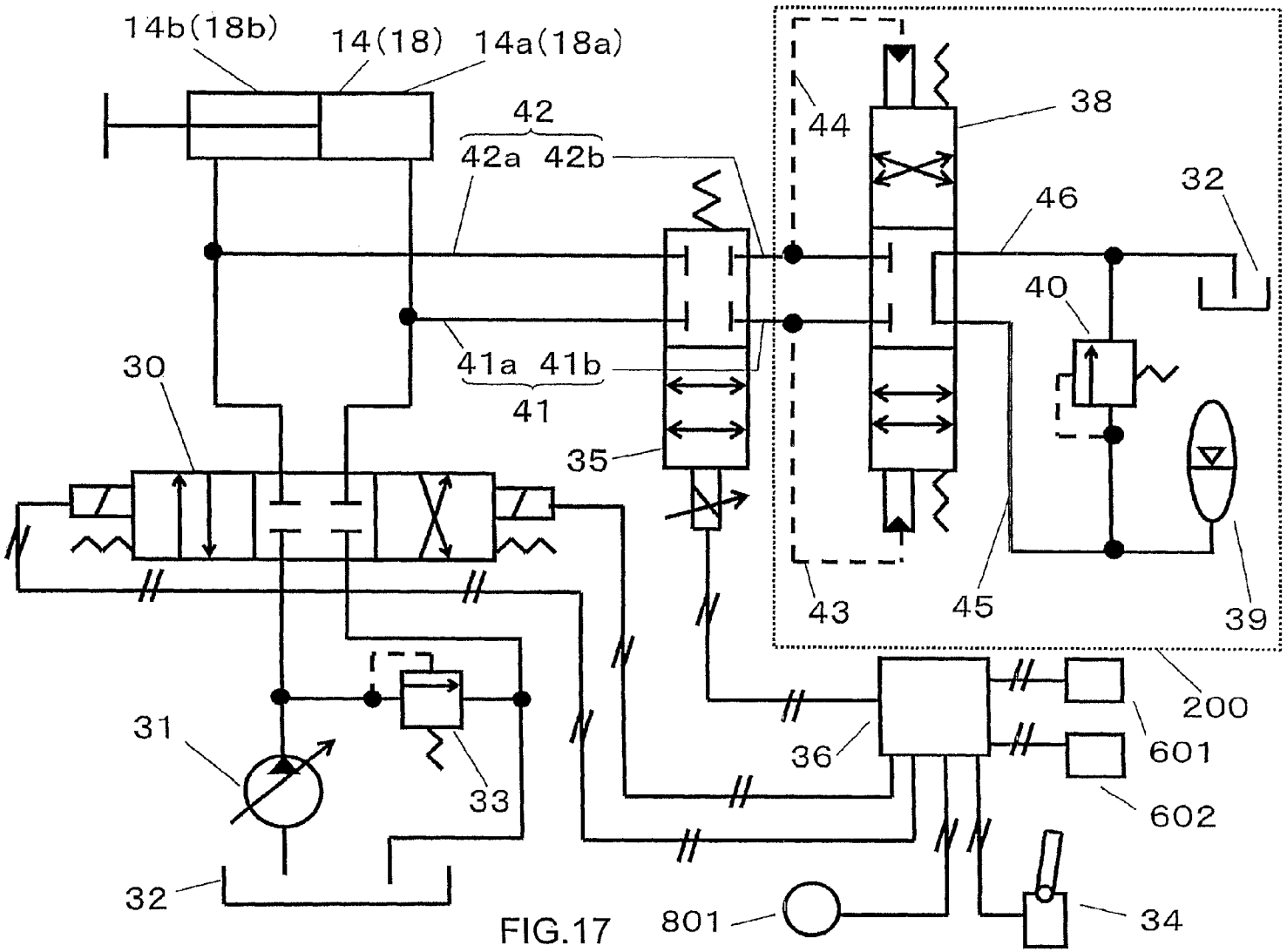
FIG. 17 is a circuit diagram pertaining to the hydraulic circuits that drive the boom cylinder and the work tool cylinder of the construction machine achieved in a fifth embodiment.
Figure 18:
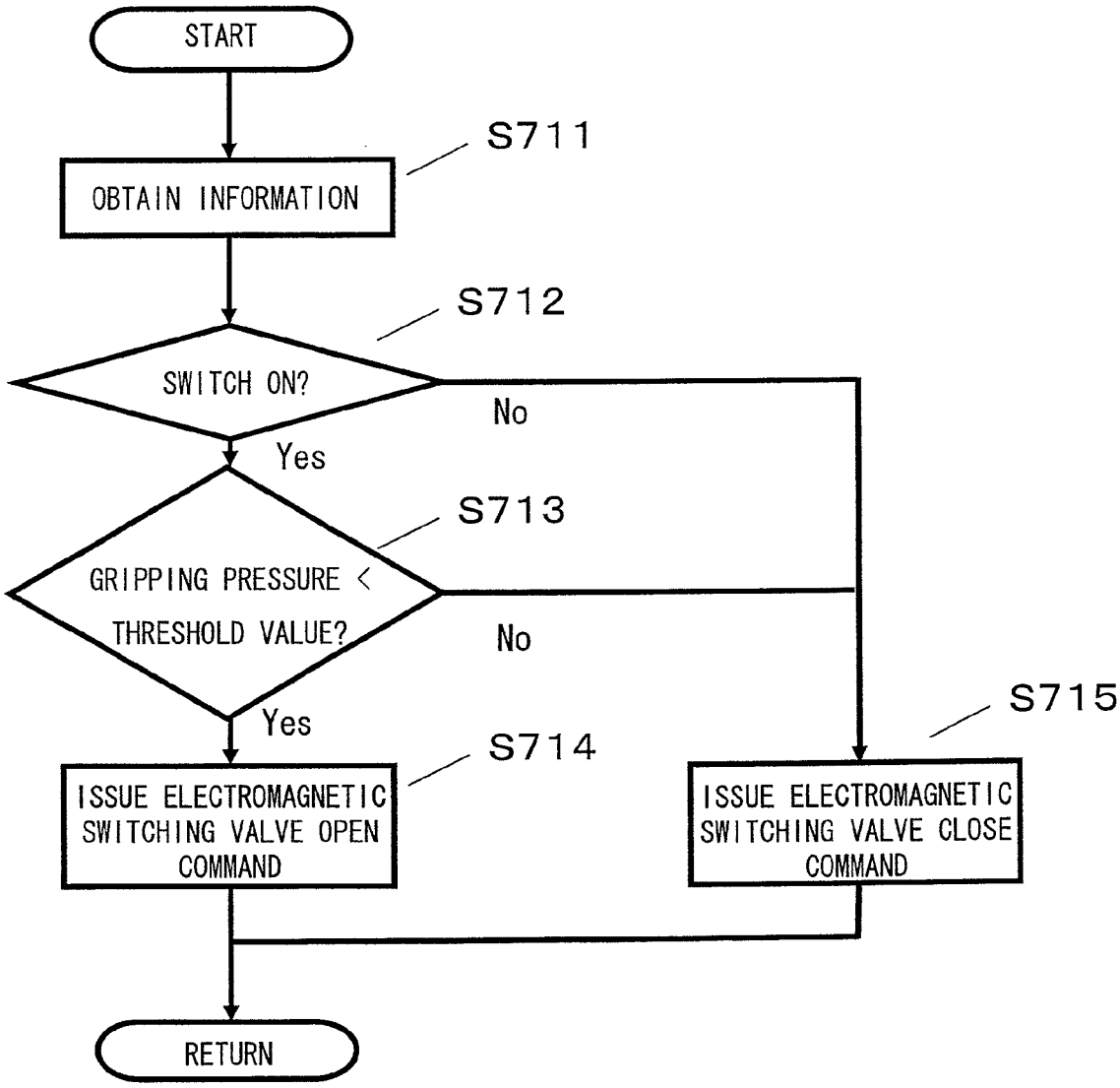
FIG. 18 presents a flowchart of the control processing operation executed to control the electromagnetic switching valve in the fifth embodiment.

In reference to FIGS. 17 and 18, the fifth embodiment of the construction machine according to the present invention is explained. The same reference numerals are assigned to structural elements identical to those in the fourth embodiment and the following explanation focuses on the differences from the fourth embodiment. Structural elements that are not specially noted in the following explanation are identical to those in the fourth embodiment. The fifth embodiment differs from the fourth embodiment in that the operating state of the construction machine 100 is judged based upon the level of the work load.

FIG. 17 is a circuit diagram pertaining to the hydraulic circuits that drive the boom cylinder 14 and the work tool cylinder 18 in the construction machine 100. While an explanation is given below on the hydraulic circuit that drives the boom cylinder 14, the hydraulic circuit that drives the work tool cylinder 18 assumes an identical structure. In addition, while the hydraulic circuit that drives the cylinder 20 does not include an electromagnetic switching valve 35 or a work load follow-up device 200, its structure is otherwise similar to that of the hydraulic circuits for driving the boom cylinder 14 and the work tool cylinder 18.

A main pump 31, a control valve 30, a main relief valve 33, a hydraulic operating fluid reservoir 32, an electromagnetic switching valve 35 and a work load follow-up device 200 are installed to form the hydraulic circuit. In addition, the hydraulic circuit includes an operation lever 34 and a control circuit 36 for controlling the control valve 30. An ON/OFF switch 601, a pressure sensor 801 and a work load setting device 602 are connected to the control circuit 36.

The pressure sensor 801 detects the pressure of pressure oil supplied to the cylinder 20, which drives the gripping claws 19 along the opening/closing direction. Namely, the pressure sensor 801 detects the pressure P of the pressure oil supplied to the bottom-side oil chamber (not shown) at the cylinder 20. The work load setting device 601 sets a threshold value P1. It is to be noted that the threshold value P1 is set for the pressure P in the bottom-side oil chamber at the cylinder 20, which is used when judging the operating state of the construction machine 100 as detailed later.

Flowchart

FIG. 18 presents a flowchart of the control processing operation executed to control the electromagnetic switching valve 35. As an ignition switch (not shown) is turned on at the construction machine 100, the program in conformance to which the processing shown in FIG. 18 is executed is started up and is executed in the control circuit 36. In step S711, information indicating the states assumed at various components of the construction machine 100 is obtained. Namely, information indicating the pressure P in the bottom-side oil chamber at the cylinder 20 detected via the pressure sensor 801, the state of the ON/OFF switch 601 and the threshold value P1 set by the work load setting device 602 is obtained. Once step S711 is executed, the operation proceeds to step S712 to make a decision based upon the information having been obtained in step S711 as to whether or not the ON/OFF switch 601 is currently in the ON state.

If an affirmative decision is made in step S712, the operation proceeds to step S713 to determine the operating state of the construction machine 100. In more specific terms, a decision is made as to whether or not the pressure P in the bottom-side oil chamber at the cylinder 20 detected via the pressure sensor 801 is less than the threshold value P1 set by the work load setting device 602. If an affirmative decision is made in step S713, the operation proceeds to step S714 to output an open command for the electromagnetic switching valve 35, i.e., to excite the solenoid at the electromagnetic switching valve 35, before the operation makes a return. If a negative decision is made in step S712 or in step S713, the operation proceeds to step S715 to output a close command for the electromagnetic switching valve 35, i.e., to demagnetize the solenoid at the electromagnetic switching valve 35, before the operation makes a return.

Operations of the Work Load Follow-Up Device 200 and the Boom Cylinder 14

As the electromagnetic switching valve 35 is controlled as described above, the work load follow-up device 200 and the boom cylinder 14 are engaged in operation as follows. If the ON/OFF switch 601 is in the ON state (an affirmative decision is made in step S712) and the pressure P in the bottom-side oil chamber at the cylinder 20 detected by the pressure sensor 801 is less than the threshold value P1 having been set by the work load setting device 601 (an affirmative decision is made in step S713), the solenoid at the electromagnetic switching valve 35 is excited (step S714).

Namely, when the ON/OFF switch 601 is in the ON state and the pressure Pin the bottom-side oil chamber at the cylinder 20 detected via the pressure sensor 801 is less than the threshold value P1 having been set by the work load setting device 602, the boom 13 or the gripping device 101 is operated in conformance to the external force applied to the gripping claws 19.

For instance, if the gripping target object assumes a position offset from the midpoint between the two gripping claws 19 facing opposite each other, the gripping target object first contacts one of the gripping claws 19 as shown in FIG. 16A. In other words, only one of the gripping claws 19 comes into contact with the target object. While the pressure P in the bottom-side oil chamber at the cylinder 20 rises as one of the gripping claws 19 contacts the target object, the oil passages 41*a* and 42*a* are allowed to communicate with the oil passages 41*b* and 42*b* via the electromagnetic switching valve 35 as long as the ON/OFF switch 601 is in the ON state and the pressure P is less than the threshold value P1. Thus, the boom 13 rotates as indicated by the arrow b1 in FIG. 16B so as to lessen the bending moment M1, causing the gripping device 101 to move as indicated by the arrow b2 and ultimately allowing the target object to be gripped at the midpoint between the two gripping claws 19 facing opposite each other.

As the operation lever 34 by which the cylinder 20 is driven is operated, the gripping force imparted by the gripping claws 19 increases and the pressure P becomes equal to or greater than the threshold value P1, the oil passages 41*a* and 42*a* become disconnected from the oil passages 41*b* and 42*b* by the electromagnetic switching valve 35. As a result, the work load follow-up device 200 stops affecting the operation of the boom cylinder 14 and the boom 13 is driven to swing in response to an operation of the operation lever 34 by which the boom 13 is operated, as explained earlier.

Since the structure described above prevents a sudden increase in any of the force W2 applied to the gripping claw 19, the force W1 applied to the target object and the bending moments M1 and M2, damage to the gripping target object and the front work arm 10 is effectively prevented. Thus, the structure is ideal in applications in which a light load must be handled delicately, as is the fourth embodiment described earlier. In addition, the embodiment in which the work load follow-up device 200 does not affect the operation of the boom cylinder 14 as long as the target object is gripped with a force equal to or greater than a predetermined gripping force level is ideal in applications that require the target object gripped by the gripping device 101 to be disposed at a specific position.

Sixth Embodiment

Figure 19:
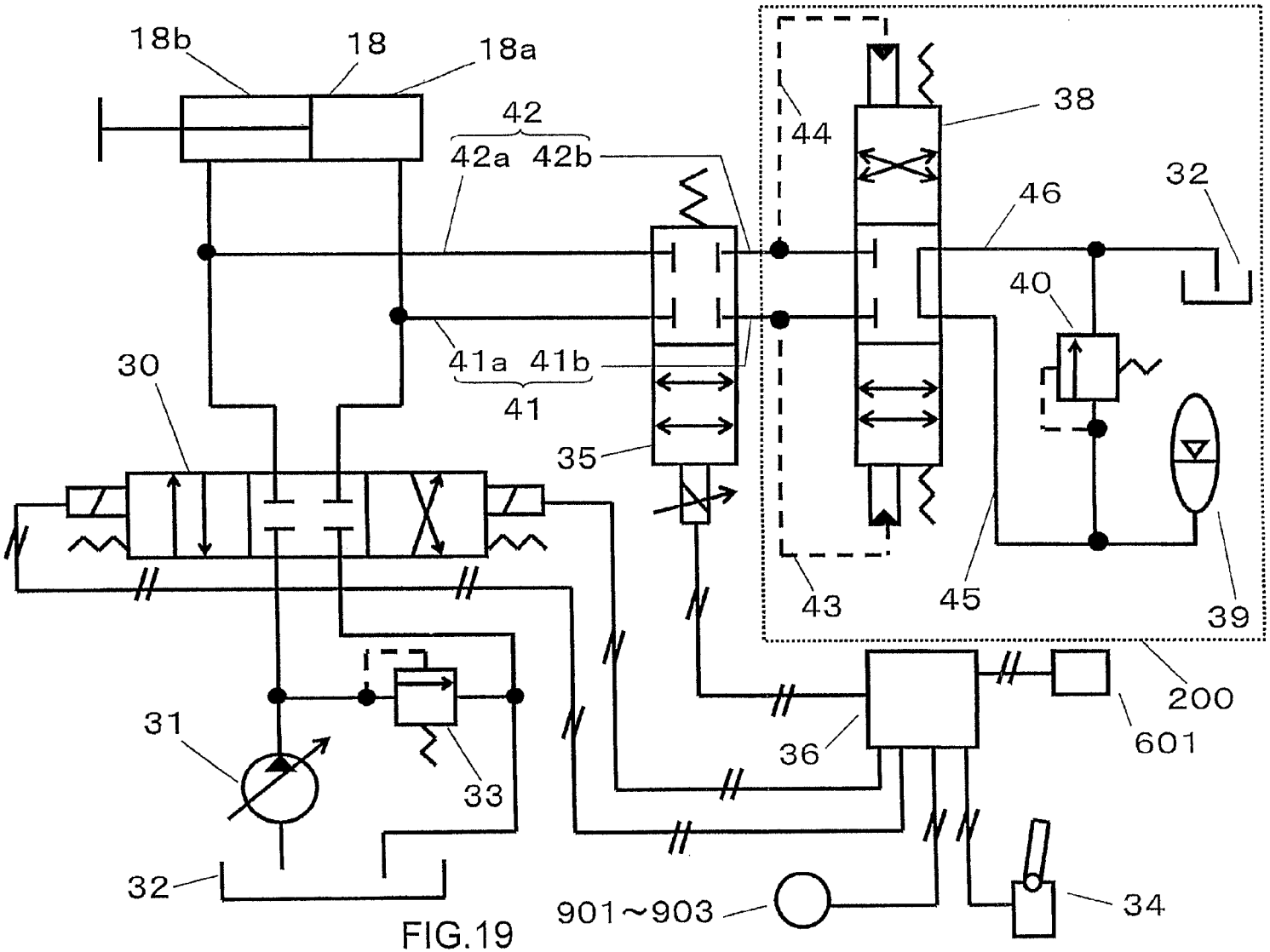
FIG. 19 is a circuit diagram of the hydraulic circuit that drives the work tool cylinder of the construction machine achieved in a sixth embodiment.
Figure 20:
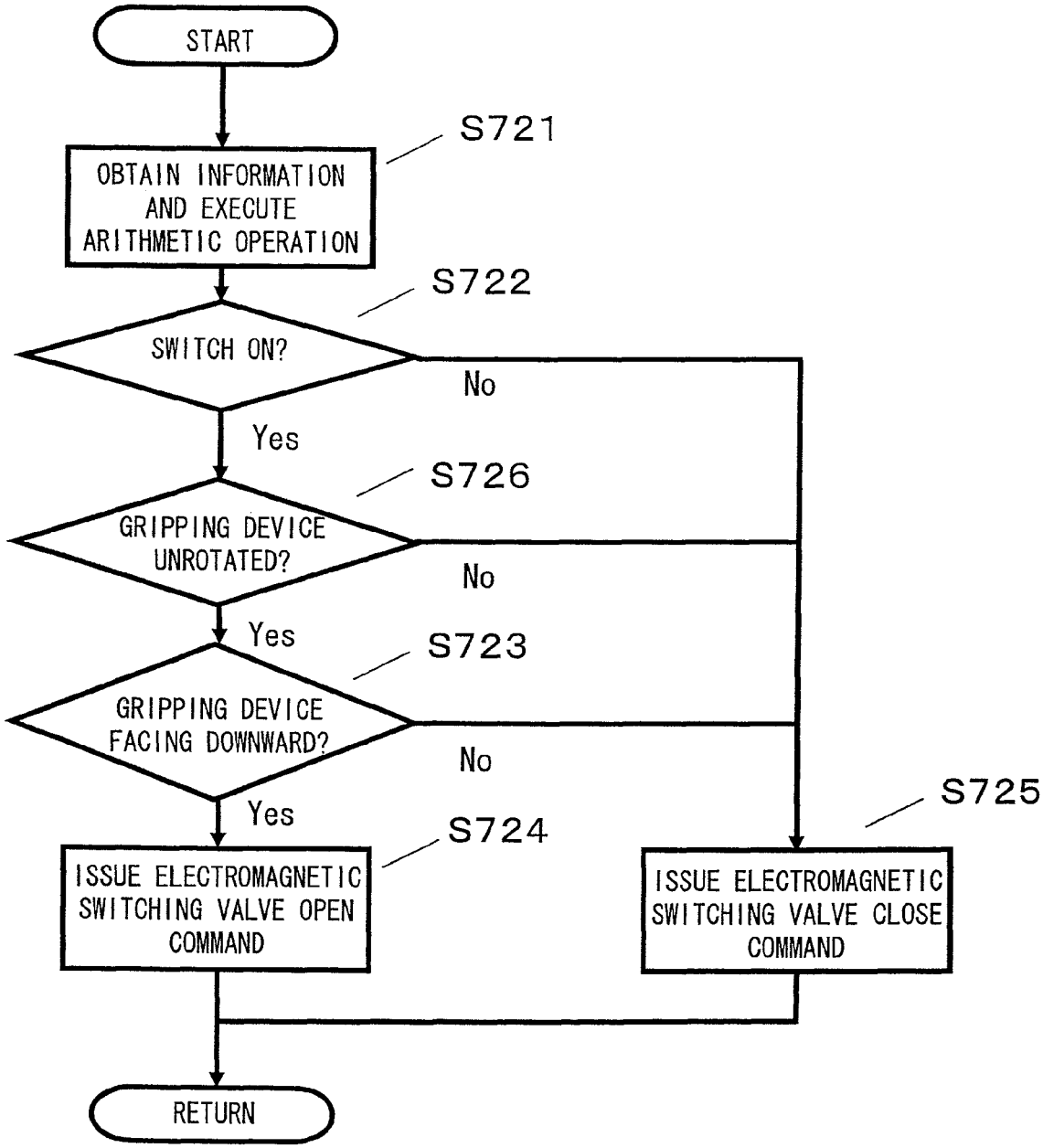
FIG. 20 presents a flowchart of the control processing operation executed to control the electromagnetic switching valve in the sixth embodiment.

In reference to FIGS. 19 and 20, the sixth embodiment of the construction machine according to the present invention is explained. The same reference numerals are assigned to structural elements identical to those in the fourth embodiment and the following explanation focuses on the differences from the fourth embodiment. Structural elements that are not specially noted in the following explanation are identical to those in the fourth embodiment. The sixth embodiment differs from the fourth embodiment in that the operating state of the construction machine 100 is judged based upon the attitude assumed by the gripping device 101.

FIG. in 19 is a circuit diagram of the hydraulic circuit that drives the work tool cylinder 18. It is to be noted that an electromagnetic switching valve 35 and a work load follow-up device 200 are installed in conjunction with the work tool cylinder 18 alone in the embodiment. A main pump 31, a control valve 30, a main relief valve 33, a hydraulic operating fluid reservoir 32, an electromagnetic switching valve 35 and a work load follow-up device 200 are installed to form this hydraulic circuit. In addition, the hydraulic circuit includes an operation lever 34 and a control circuit 36 for controlling the control valve 30. An ON/OFF switch 601 and potentiometers 901~903 are connected to the control circuit 36. The pressure level setting is selected for the relief valve 40 at the work load follow-up device 200 in the embodiment so as to ensure that the gripping device 101 is allowed to face downward substantially along the vertical direction due to its own weight.

The potentiometer 901 detects the angular position of the boom 13 relative to the revolving superstructure 11 and outputs the detected angle as angle information. The potentiometer 902 detects the angular position of the arm 15 relative to the boom 13 and outputs the detected angle as angle information. The potentiometer 903 detects the angular position of the gripping device 101 relative to the arm 15 and outputs the detected angle as angle information.

Flowchart

FIG. 20 presents a flowchart of the control processing operation executed to control the electromagnetic switching valve 35. As an ignition switch (not shown) is turned on at the construction machine 100, the program in conformance to which the processing shown in FIG. 20 is executed is started up and is executed in the control circuit 36. In step S721, information indicating the states assumed at various components of the construction machine 100 is obtained and the attitude assumed by the gripping device 101 is calculated. More specifically, information indicating the extent to which the operation lever 34 by which the work tool cylinder 18 is driven is operated and the state of the ON/OFF switch 601 as well as the angle information output from the potentiometers 901~903 is obtained and, based upon the angle information, the angle assumed by the gripping device 101 relative to the ground is determined through arithmetic operation. Once step S721 is executed, the operation proceeds to step S722 to make a decision based upon the information having been obtained in step S721 as to whether or not the ON/OFF switch 601 is currently in the ON state.

If an affirmative decision is made in step S722, the operation proceeds to step S726 to make a decision as to whether or not the gripping device 101 has remained unrotated based upon the information having been obtained in step S721 indicating the extent to which the operation lever 34, by which the work tool cylinder 18 is driven, has been operated. If an affirmative decision is made in step S726 the operation proceeds to step S723 to judge the operating state of the construction machine 100. In more specific terms, a decision is made based upon the angle of the gripping device 101 relative to the ground surface having been calculated in step S21 as to whether or not the gripping device 101 faces downward substantially along the vertical direction.

If an affirmative decision is made in step S723, the operation proceeds to step S724 to output an open command for the electromagnetic switching valve 35, i.e., to excite the solenoid at the electromagnetic switching valve 35, before the operation makes a return. If a negative decision is made in step S722, in step S726 or in step S723, the operation proceeds to step S725 to output a close command for the electromagnetic switching valve 35, i.e., to demagnetizes the solenoid at the electromagnetic switching valve 35, before the operation makes a return.

Operations of the Work Load Follow-Up Device 200 and the Work Tool Cylinder 18

As the electromagnetic switching valve 35 is controlled as described above, the work load follow-up device 200 and the work tool cylinder 18 are engaged in operation as follows. If the ON/OFF switch 601 is in the ON state (an affirmative decision is made in step S722), the gripping device 101 has remained unrotated (an affirmative decision is made in step S726) and the gripping device 101 is facing downward substantially along the vertical direction (an affirmative decision is made in step S723), the solenoid at the electromagnetic switching valve 35 is excited (step S724).

Namely, the oil passages 41*a* and 42*a* are allowed to communicate with the oil passages 41*b* and 42*b* via the electromagnetic switching valve 35 if the ON/OFF switch 601 is in the ON state, the gripping device 101 remains unrotated and the gripping device 101 faces downward substantially along the vertical direction in the embodiment. With the pressure level setting for the relief valve 40 selected as described earlier, the gripping device 101 is allowed to remain facing downward substantially along the vertical direction due to its own weight even if the attitude of the front work arm 10 shifts due to the rotating motion of the boom 13 or the arm 15 until the ON/OFF switch 601 is turned off or the gripping device 101 is rotated.

As explained, the weight of the gripping device 101 sets the gripping device 101 in a rotatably suspended state relative to the arm 15 when the ON/OFF switch 601 is in the ON state, the gripping device 101 remains unrotated and the gripping device 101 faces downward substantially along the vertical direction in the embodiment. This means that the embodiment is ideal in applications such as cargo loading/unloading and carrying operations during which the target object gripped by the gripping device 101 must be placed at a specific position while maintaining a stable attitude.

Figure 21:
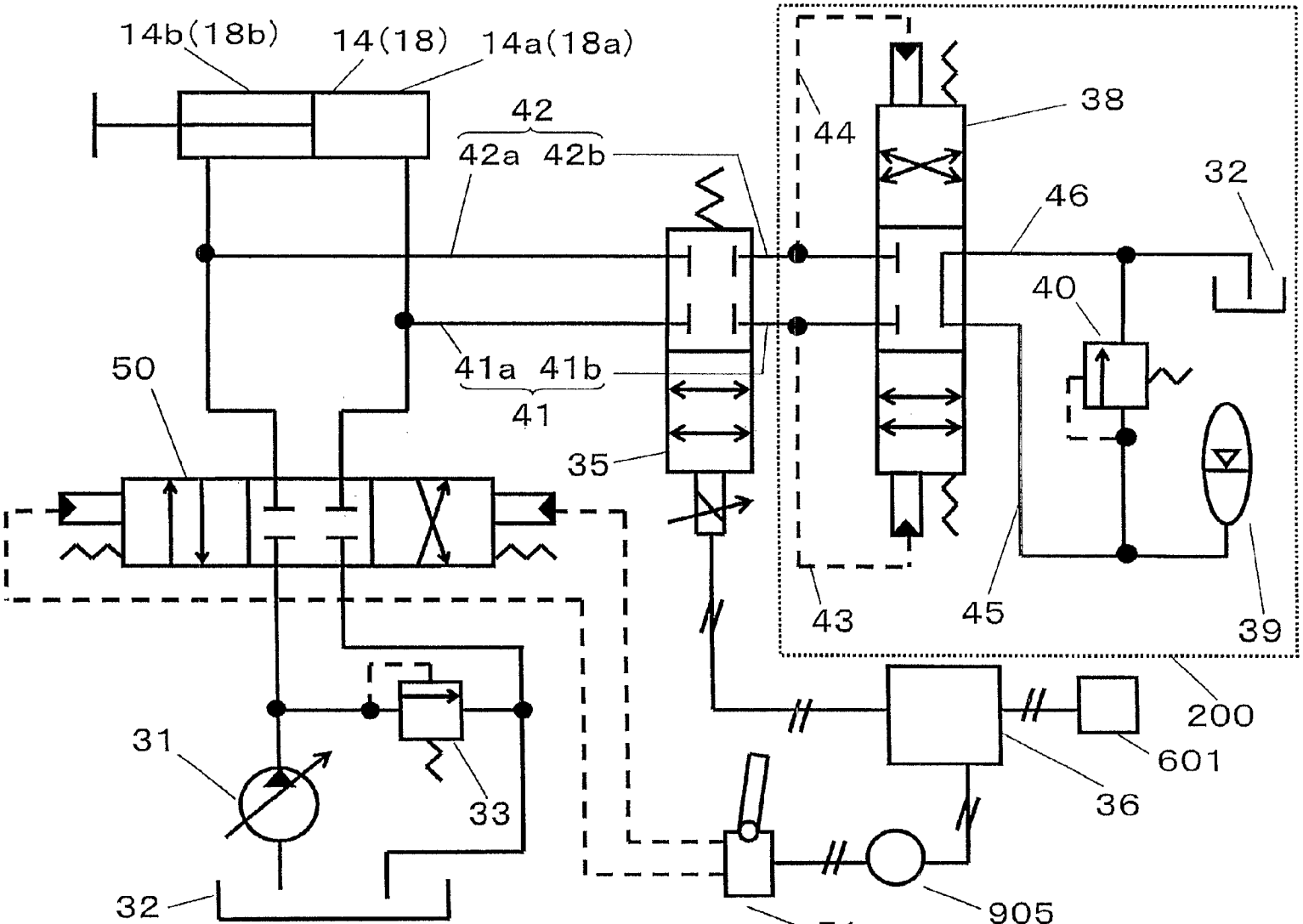
FIG. 21 shows an example of a variation that may be adopted in the hydraulic circuits.

Examples of Variations (1) While the operation lever 34 described above is an electrically operated lever widely referred to as an electric lever, the present invention is not limited to this example. A control valve 50 may instead be controlled with an operation lever 51, by which the pilot pressure oil is controlled, as shown in FIG. 21. As the operation lever 51 is operated, pilot pressure oil originating from a pilot pump (not shown) drives the spool at the control valve 50 with the pressure corresponding to the extent to which the operation lever 51 is operated. Thus, the boom cylinder 14 is driven at a speed corresponding to the extent to which the operation lever 51 is operated.

It is to be noted that reference numeral 905 in FIG. 21 indicates a potentiometer that detects the extent to which the operation lever 51 is operated. By detecting the extent to which the operation lever 51 has been operated based upon the output signal provided by the potentiometer 905, the operating state of the construction machine 100 can be judged as in the fourth embodiment, and thus, advantages and effects similar to those of the fourth embodiment explained earlier can be achieved.

(2) The operating state of the construction machine 100 is judged based upon the extent to which the operation lever 34 by which the cylinder 20 of the gripping device 101 is driven is operated in the fourth embodiment explained earlier. However, the present invention is not limited to this example and the operating state of the construction machine 100 may instead be judged based upon the extent to which an operation lever 34 for driving another cylinder has been operated.

(3) While the operating state of the construction machine 100 is judged based upon the pressure P in the bottom-side oil chamber at the cylinder 20, detected via the pressure sensor 801, in the fifth embodiment explained earlier, the present invention is not limited to this example and the operating state of the construction machine 100 may be judged based upon the pressure of the pressure oil delivered to another cylinder instead. In addition, instead of measuring the pressure P in the bottom-side oil chamber at the cylinder 20, the gripping force imparted by the gripping claws 19 may be directly measured by using a force sensor and the operating state of the construction machine 100 may be judged based upon the gripping force thus measured.

(4) While the attitude of the gripping device 101 is determined through arithmetic operation executed based upon the angular positions detected via the potentiometers 901~903 in the explanation provided above, the attitude of the gripping device 101 may instead be calculated based upon the cylinder strokes detected at the hydraulic cylinders 14, 16 and 18.

(5) While two articulating joints are rotated by the work load follow-up devices 200 in the explanation provided above, a single articulating joint or three or more articulating joints may be rotated to provide varying levels of freedom of movement.

(6) While the operating state of the construction machine 100 is judged by checking whether or not the gripping device 101 is facing downward substantially along the vertical direction in the sixth embodiment described above, an angle other than the vertical may be selected for the decision-making criterion. In addition, while the operating state of the construction machine 100 is judged based upon the attitude assumed by the gripping device 101 in the sixth embodiment described above, the operating state of the construction machine 100 may instead be judged based upon the attitude of the boom 13 or the attitude of the arm 15.

(7) While the operating state of the construction machine 100 is judged based upon the extent to which the operation lever 34 by which the cylinder 20 is driven is operated, the pressure P in the bottom-side oil chamber at the cylinder 20 or the attitude assumed by the gripping device 101 in the explanation provided earlier, the present invention is not limited to these examples. For instance, the operating state of the construction machine 100 may be judged based upon a plurality of decision-making criteria, e.g., a combination of the extent to which the operation lever 34 for driving the cylinder 20 is operated and the pressure Pin the bottom-side oil chamber at the cylinder 20.

(8) While no special mention is included in the explanation above with regard to the type of accumulator that should constitute the accumulator 39, the accumulator 39 may be, for instance, a bladder-type hydro-pneumatic accumulator, a spring-loaded accumulator or a piston-type accumulator.

Figure 22:
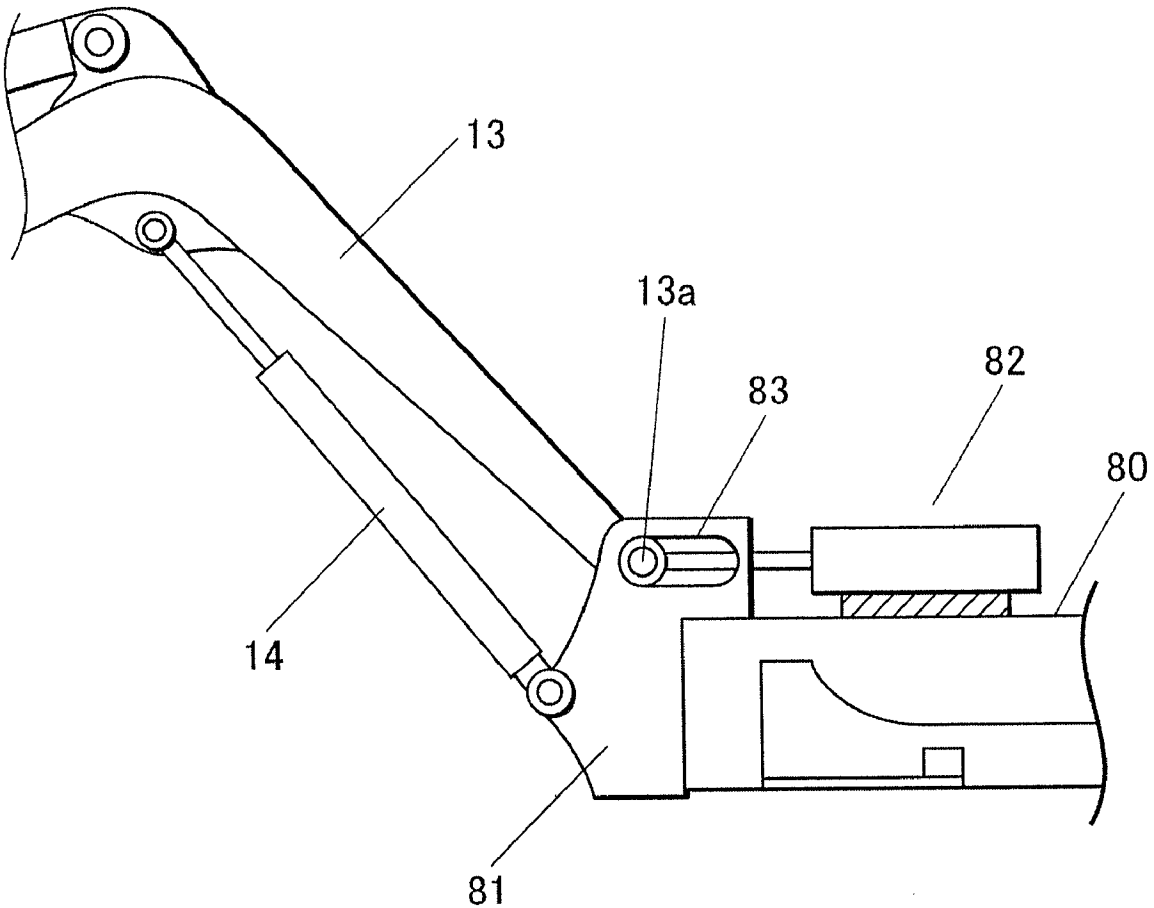
FIG. 22 presents an example of a variation.

(9) While the work load follow-up devices 200 are each connected to one of the hydraulic circuits through which the pressure oil is supplied to the boom cylinder 14 and the work tool cylinder 18 in the explanation above, the present invention is not limited to this example. For instance, the present invention may be adopted in a structure such as that shown in FIG. 22 with a special follow-up cylinder 82 fixed to a frame 80 of the revolving superstructure 11. The structure further includes a bracket 81 that allows a base end portion 13*a* of the boom 13 to slide toward the front and toward the rear (along the left/right direction in the figure) of the construction machine 100 through a slide groove 83. The cylinder rod front end of the follow-up cylinder 82 is connected to the base end portion 13*a* of the boom 13 with a pin and an electromagnetic switching valve 35 and a work load follow-up device 200 are connected to the hydraulic circuit through which pressure oil is supplied to the follow-up cylinder 82.

The structure described above allows the base end portion 13*a* of the boom 13 to move along the slide groove 83 so as to adjust the attitude of the boom 13 in conformance to the external force applied to the gripping claws 19. As a result, advantages similar to those described earlier can be achieved.

Figure 23:
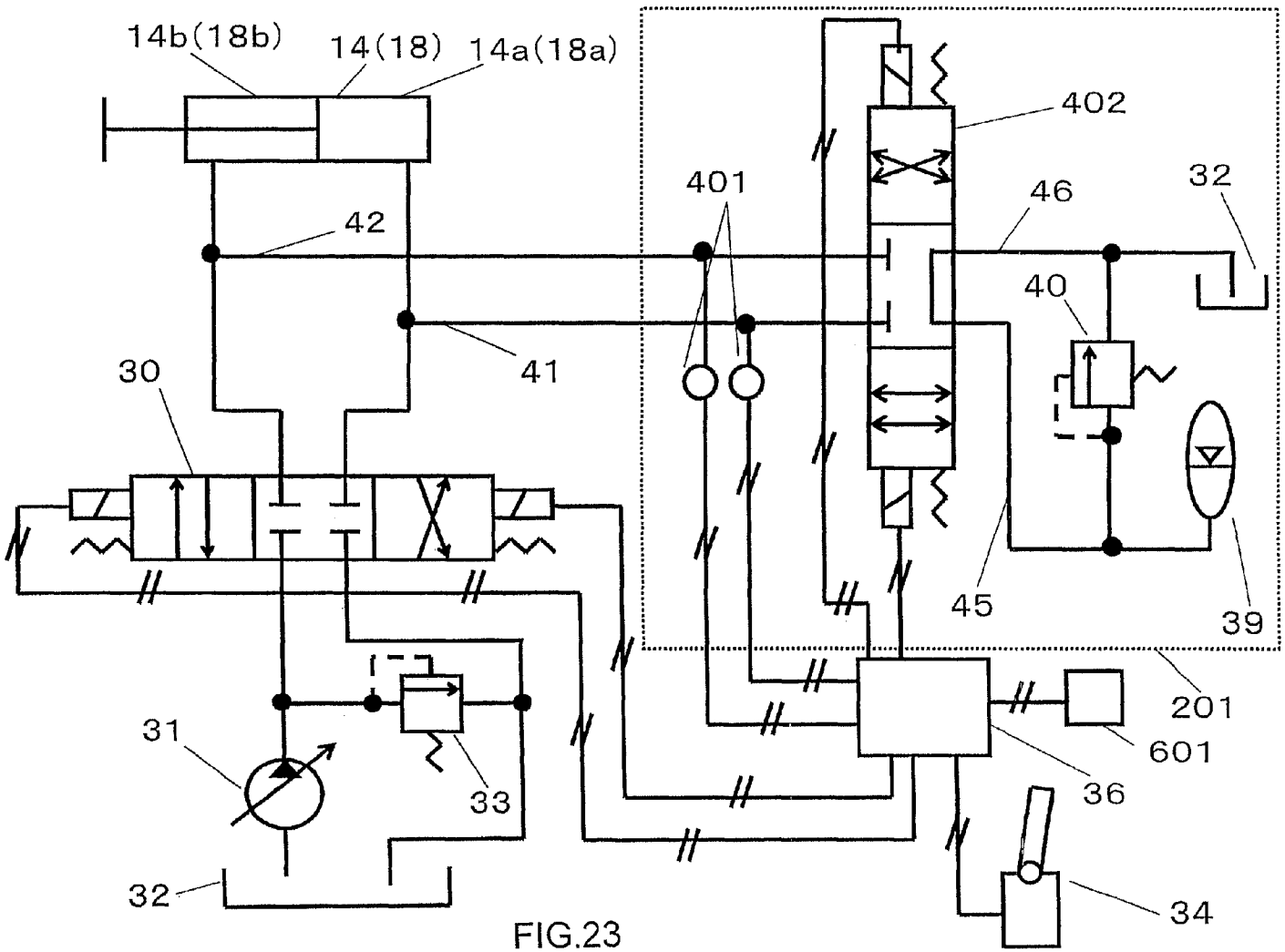
FIG. 23 shows an example of a variation that may be adopted in the hydraulic circuits.

(10) While the spool at the control valve 38 is driven by using the pressure oil from the oil passage 43 connected to the oil passage 41*b* and the pressure oil from the oil passage 44 connected to the oil passage 42*b* as the pilot pressure oil in the fourth embodiment described above, the present invention is not limited to this example. The present invention may instead be adopted in a structure such as that shown in FIG. 23, with an electromagnetic control valve 402 disposed in place of the control valve 38 and pressure sensors 401 installed at the oil passages 41 and 42. In the example shown in FIG. 23, the control circuit 36 excites/demagnetizes the solenoid at the control valve 402 in correspondence to the pressures detected via the pressure sensors 401, the ON/OFF state of the ON/OFF switch 601 and the extent to which the operation lever 34 by which the cylinder 20 is driven is operated to select the optimal spool position at the control valve 402. In this example too, advantages similar to those of the fourth embodiment are achieved. A work load follow-up device 201 assuming the structure shown in FIG. 23 does not require the electromagnetic switching valve 35.

(11) While the work load follow-up devices 200 connected to the hydraulic circuit that drives the boom cylinder 14 and the hydraulic circuit that drives the work tool cylinder 18 assume identical structures in the explanation provided above, the present invention is not limited to this example. For instance, it may be adopted in a configuration that includes work load follow-up devices with different structures, e.g., an electromagnetic switching valve 35 and a work load follow-up device 200 connected to the hydraulic circuit that drives either the boom cylinder 14 or the work tool cylinder 18 and the work load follow-up device 201 shown in FIG. 23 connected to the other hydraulic circuit.

(12) While the pressure oil in the high-pressure side oil chamber is absorbed and collected and the pressure oil having been collected is then released in the hydraulic circuit through which pressure oil is supplied to a hydraulic cylinder in the explanation provided above, the present invention is not limited to this example. For instance, it may be adopted in a structure with a mechanical spring disposed between the cylinder and the front work arm 10, to cause displacement of the front work arm 10 in correspondence to the external force applied to the gripping claws 19 as the spring extends/contracts.

(13) While the pressure oil in the high-pressure side oil chambers is absorbed and collected and the pressure oil having been collected is then released via the work load follow-up devices 200 engaged in operation in conjunction with the boom cylinder 14 and the work tool cylinder 18 in the explanation provided above, the present invention is not limited to this example. The work load follow-up device 200 may instead be engaged in operation to absorb and collect the pressure oil in the high-pressure side oil chambers and then release the pressure oil having been collected in conjunction with the boom cylinder 14 and the arm cylinder 16, or the work load follow-up devices 200 may be engaged in operation to absorb and collect the pressure oil in the high-pressure side oil chambers and then to release the pressure oil having been collected in conjunction with the arm cylinder 16 and the work tool cylinder 18.

(14) While the pressure oil in the oil passage 45 is released into the oil passage 46 via the relief valve 40 in the explanation provided above, the present invention is not limited to this example and a proportional electromagnetic pressure control valve may be installed in place of the relief valve 40. The use of the proportional electromagnetic pressure control valve allows any value to be set as the maximum value for the pressure of the pressure oil applied to the accumulator 39 and thus, a high level of versatility is assured for the construction machine 100 with regard to the work it performs.

(15) While the front work arm 10 is allowed to rotate relative to the revolving superstructure 11 along the up/down direction only in the explanation provided above, the present invention is not limited to this example and the front work arm 10 may be allowed to rotate relative to the revolving superstructure along the left/right direction as well. In such a case, a work load follow-up device 200 may be connected to the hydraulic circuit by which the hydraulic cylinder (oscillating cylinder), installed to allow the front work arm 10 to swing to the left and the right, is driven. Since the front work arm 10 is allowed to swing to the left and to the right in correspondence to the external force applied to the gripping claws 19, the front work arm 10 can be operated in conformance to external forces input from a wider range of directions.

(16) The fourth through sixth embodiments and variations thereof described above may be adopted in various combinations.

By adopting any of the fourth through sixth embodiments of the present invention and the variations thereof described above, damage to the work arm or the work tool due to an overload can be prevented and a delay in the operating force response can be avoided to assure good operability and sustain the desired level of work efficiency.

Seventh Embodiment

Figure 24:
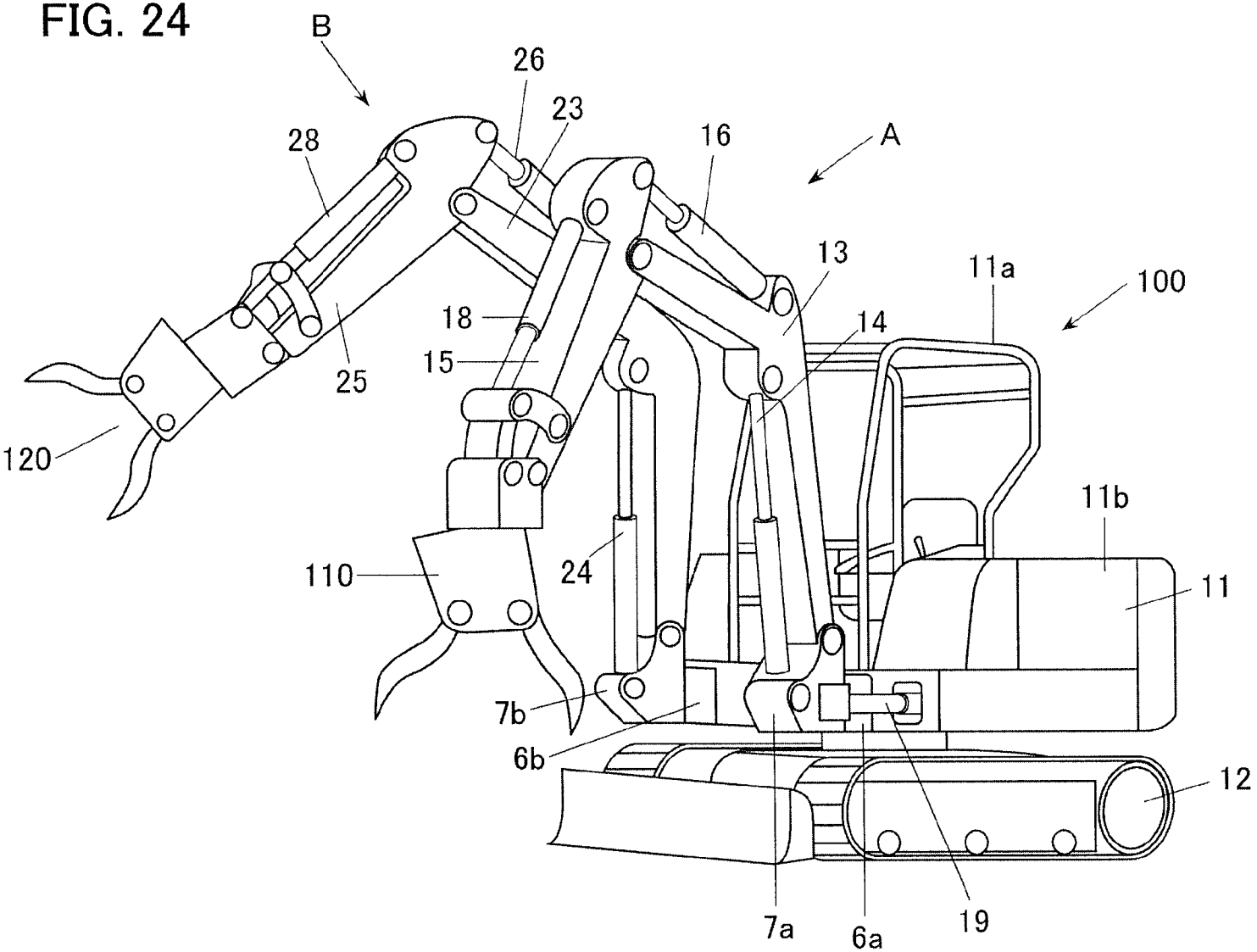
FIG. 24 is an external view of the construction machine achieved in a seventh embodiment.
Figure 25:
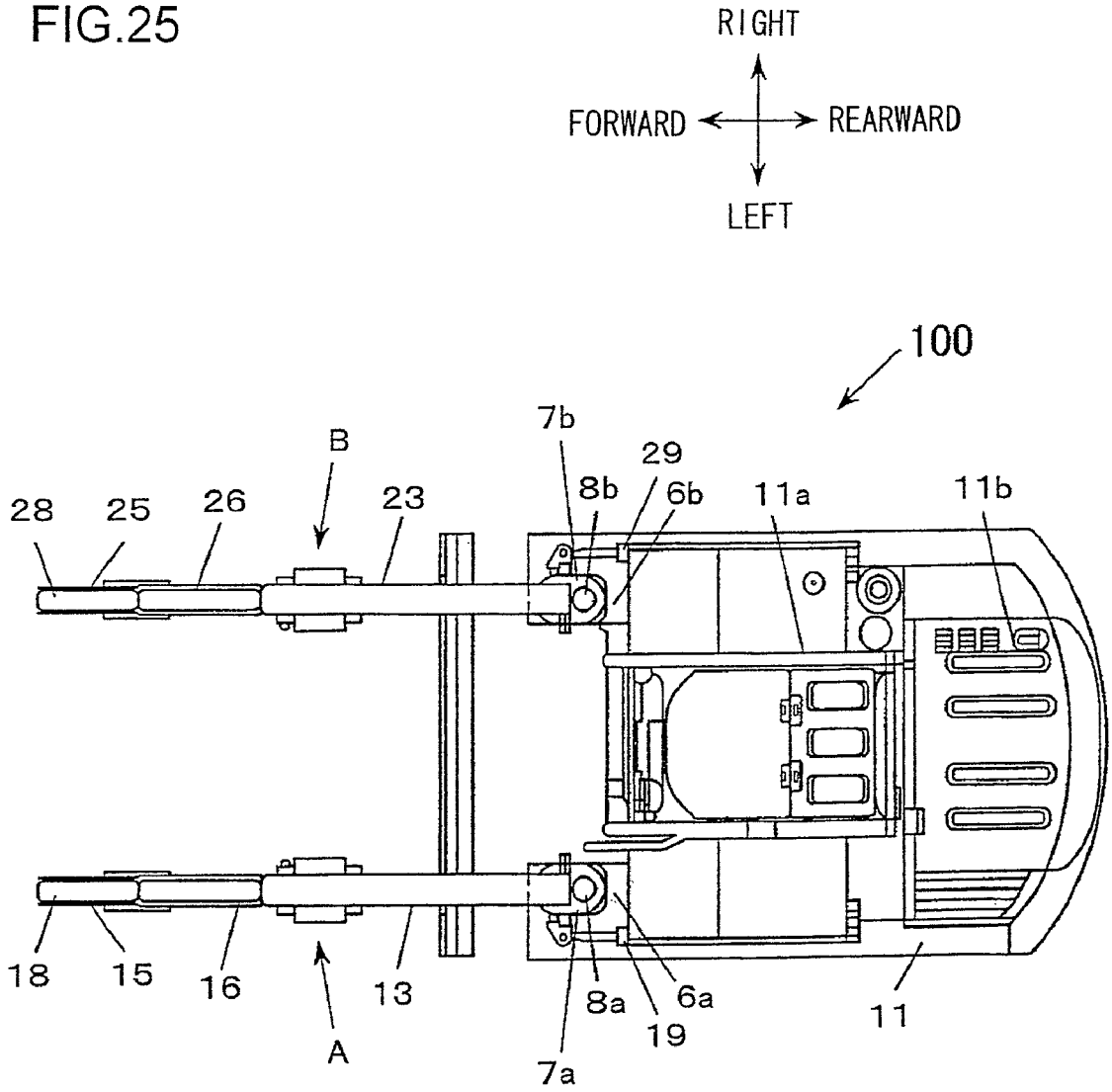
FIG. 25 is a plan view of the construction machine.

In reference to FIGS. 24 through 32, the seventh embodiment of the construction machine according to the present invention is explained. As shown in FIGS. 24 and 25, a revolving superstructure 11 is rotatably mounted at a traveling carriage 12 in a construction machine 100 that includes as its base unit a hydraulic excavator. An operator's cab 11*a* is disposed at the front of the revolving superstructure 11. Behind the operator's cab 11*a*, a main drive device 11*b*, which includes an engine and a hydraulic pump, is disposed.

A first bracket 6*a* is disposed to the front of the operator's cab 11*a* on the left side, with a swing-type first front work arm A mounted at the first bracket 6*a*. A second bracket 6*b* is disposed to the front of the operator's cab 11*a* on the right side, with a swing-type second front work arm B mounted at the second bracket 6*b*.

The first front work arm A is an articulated arm which includes a mount member 7*a* mounted so as to swing freely to the left and to the right around a hinge 8*a* (see FIG. 25) disposed at the first bracket 6*a*, a boom 13 mounted at the mount member 7*a* so as to swing up/down freely, an arm 15 mounted at the boom 13 so as to swing up/down freely and a gripping device 110 that is mounted at the front end of the arm 15 so as to rotate along the up/down direction freely and is used as a first work tool. The first front work arm A further includes an oscillating cylinder 19 (see FIG. 25), which causes the mount member 7*a* to swing to the left and to the right, a boom cylinder 14, which causes the boom 13 to swing up/down, an arm cylinder 16, which causes the arm 15 to swing up/down and a work tool cylinder 18, which causes the gripping device 110 to rotate along the up/down direction.

The second front work arm B is disposed symmetrically to the first front work arm A along the left/right direction on the opposite side of the operator's cab 11*a* from the first front work arm A. The second front work arm B adopts a structure similar to that of the first front work arm A. Namely, the second front work arm B is an articulated arm which includes a mount member 7*b* mounted so as to swing freely to the left and to the right around a hinge 8*b* (see FIG. 25) disposed at the second bracket 6*b*, a boom 23 mounted at the mount member 7*b* so as to swing up/down freely, an arm 25 mounted at the boom 23 so as to swing up/down freely and a gripping device 120 that is mounted at the front end of the arm 25 so as to rotate along the up/down direction freely and is used as a second work tool. The second front work arm B further includes an oscillating cylinder 29 (see FIG. 25) which causes the mount member 7*b* to swing to the left and to the right, a boom cylinder 24, which causes the boom 23 to swing up/down, an arm cylinder 26, which causes the arm 25 to swing up/down and a work tool cylinder 28, which causes the gripping device 120 to rotate along the up/down direction.

Figure 26:
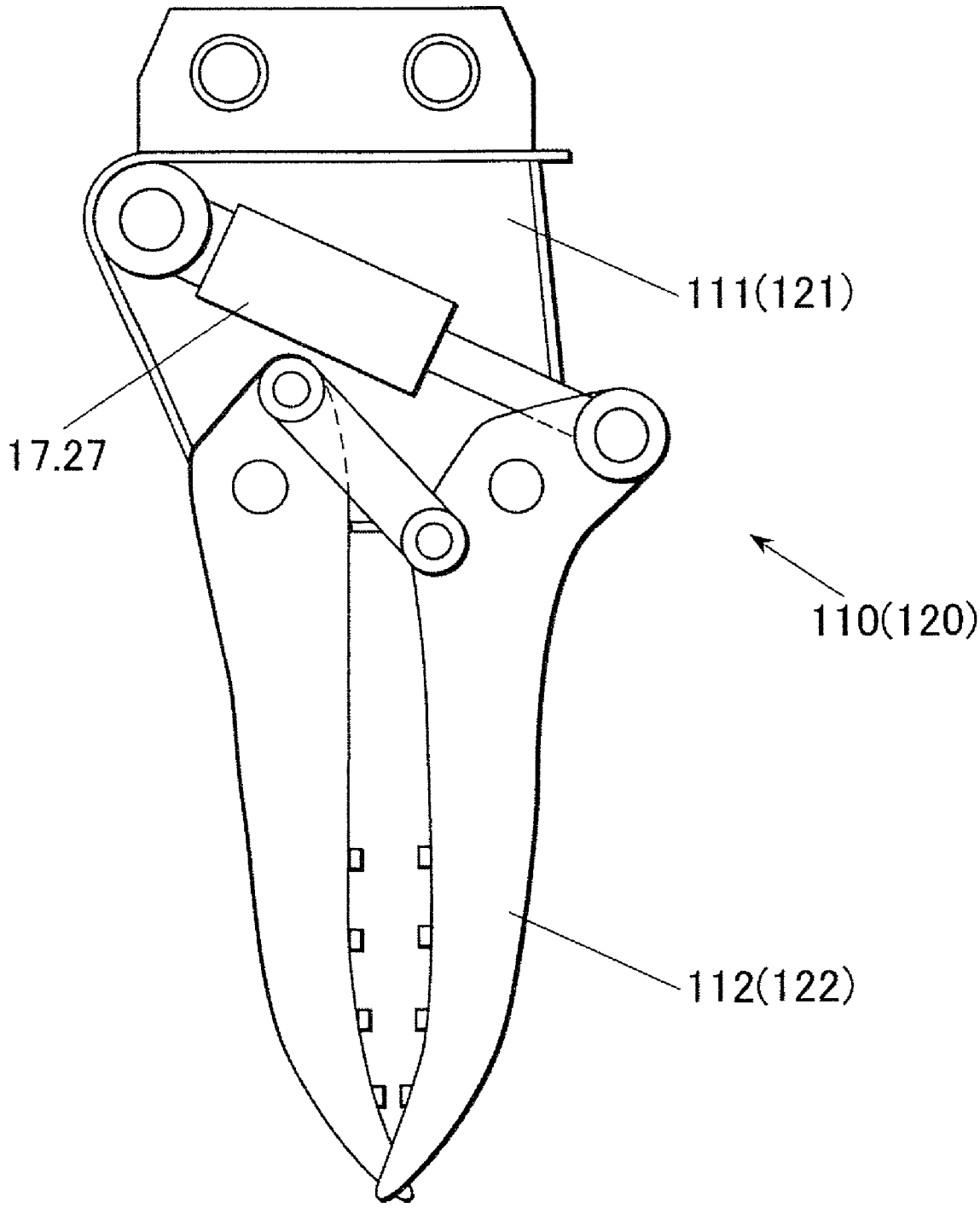
FIG. 26 shows the structure of the gripping devices.

FIG. 26 shows the structure adopted in the gripping devices 110 and 120. The gripping device 110 includes a gripping device body 111 disposed at the front end of the arm 15, a pair of gripping claws 112 disposed facing opposite each other so as to grip the target object between the front ends thereof and a cylinder 17 that drives the gripping claws 112 along the opening direction and the closing direction. Likewise, the gripping device 120 includes a gripping device body 121 disposed at the front end of the arm 25, a pair of gripping claws 122 disposed facing opposite each other so as to grip the target object between the front ends thereof and a cylinder 27 that drives the gripping claws 122 along the opening direction and the closing direction.

Figure 27:
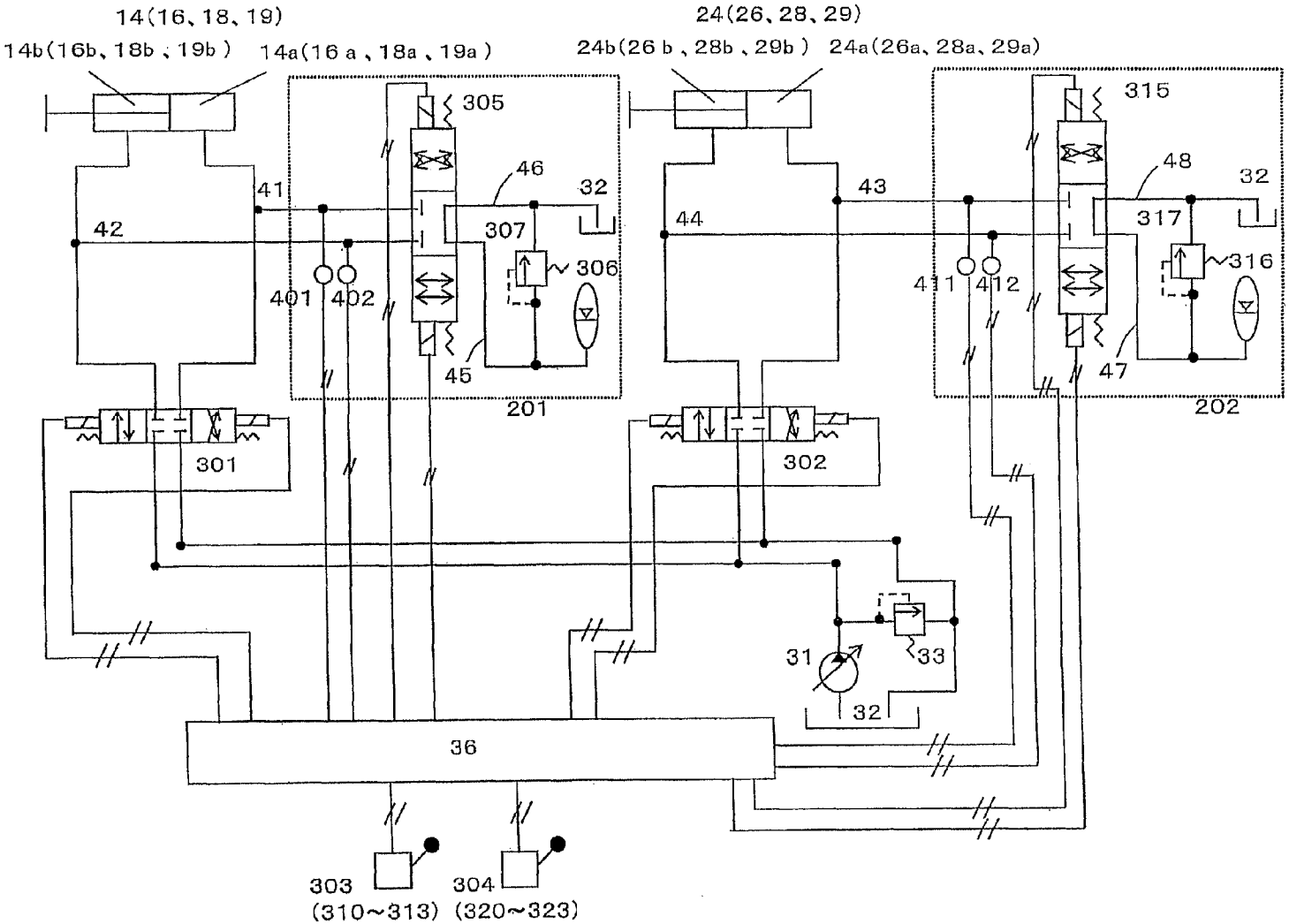
FIG. 27 shows the hydraulic circuit in the construction machine.

FIG. 27 is a circuit diagram pertaining to the hydraulic circuits that drive the boom cylinders 14 and 24, the arm cylinders 16 and 26, the work tool cylinders 18 and 28 and the oscillating cylinders 19 and 29 in the construction machine 100. While an explanation is given below on the hydraulic circuit that drives the boom cylinders 14 and 24, the hydraulic circuits that drive the arm cylinders 16 and 26, the work tool cylinders 18 and 28 and the oscillating cylinders 19 and 29 assume identical structures. A main pump 31, control valves 301 and 302, a main relief valve 33, a hydraulic operating fluid reservoir 32 and work load follow-up devices 201 and 202 are installed to form this hydraulic circuit. In addition, the hydraulic circuit includes a controller 36 and operation levers 303 and 304 used to control the control valves 301 and 302 and the work load follow-up devices 201 and 202.

As the main pump 31, by which pressure oil is supplied to the various actuators of the construction machine 100, is driven by an engine (not shown), the hydraulic operating fluid in the hydraulic operating fluid reservoir 32 is delivered to the boom cylinders 14 and 24 via the control valves 301 and 302. The pressure oil from the main pump 31 is also delivered to the arm cylinders 16 and 26, the work tool cylinders 18 and 28, the cylinders 17 and 27 and the oscillating cylinders 19 and 29 via corresponding control valves (not shown). The maximum pressure in the hydraulic circuit is defined via the main relief valve 33.

The hydraulic circuits that drive the hydraulic cylinders 14, 16, 18 and 19 are each connected with a work load follow-up device 201. While the following explanation focuses on the work load follow-up device 201 connected to the hydraulic circuit that drives the boom cylinder 14, the work load follow-up devices connected to the hydraulic circuits that drive the other hydraulic cylinders 16, 18 and 19 assume structures identical to that of the work load follow-up device 201 explained below. The work load follow-up device 201 includes a control valve 305, an accumulator 306 and a relief valve 307. The work load follow-up device 201 further includes pressure sensors 401 and 402. As the position of the spool at the control valve 305 is switched, the state of connection between oil passages 41 and 42 and oil passages 45 and 46 is switched. It is to be noted that the oil passage 41 is connected to a bottom-side oil chamber 14*a* at the boom cylinder 14, whereas the oil passage 42 is connected to a rod-side oil chamber 14*b* at the boom cylinder 14.

The accumulator 306 is connected to the oil passage 45 to absorb the pressure oil in the oil passage 45 or release pressure oil it has accumulated into the oil passage 45. Once the pressure in the oil passage 45 exceeds a preset pressure level, the pressure oil in the oil passage 45 is released into the oil passage 46 via the relief valve 307. The pressure level set for the relief valve 307 is lower than the pressure level setting selected for the main relief valve 33. It is to be noted that the oil passage 46 is connected to the hydraulic operating fluid reservoir 32.

The pressure sensor 401 detects the pressure of the pressure oil in the oil passage 41 (i.e., the pressure in the bottom-side oil chamber 14*a*) and outputs an electrical signal indicating the detected pressure value to the controller 36. Likewise, the pressure sensor 402 detects the pressure of the pressure oil in the oil passage 42 (i.e., the pressure in the rod-side oil chamber 14*b*) and outputs an electrical signal indicating the detected pressure value to the controller 36. The controller 36 switches the spool position at the control valve 305 in correspondence to the pressures in the oil passages 41 and 42 detected via the pressure sensors 401 and 402, the ON/OFF state of an ON/OFF switch 313, to be detailed later, installed at the operation lever 303 and the like.

The work load follow-up device 202 includes a control valve 315, an accumulator 316 and a relief valve 317. The work load follow-up device 202 further includes pressure sensors 411 and 412. As the position of the spool at the control valve 315 is switched, the state of connection between oil passages 43 and 44 and oil passages 47 and 48 is switched. It is to be noted that the oil passage 43 is connected to the bottom-side oil chamber 24*a* at the boom cylinder 24, whereas the oil passage 44 is connected to the rod-side oil chamber 24*b* at the boom cylinder 24.

The accumulator 316 is connected to the oil passage 47 to absorb the pressure oil in the oil passage 47 or release the pressure oil it has accumulated into the oil passage 47. Once the pressure in the oil passage 47 exceeds a preset pressure level, the pressure oil in the oil passage 47 is released into the oil passage 48 via the relief valve 317. The pressure level set for the relief valve 317 is lower than the pressure level setting selected for the main relief valve 33. It is to be noted that the oil passage 48 is connected to the hydraulic operating fluid reservoir 32.

The pressure sensor 411 detects the pressure of the pressure oil in the oil passage 43 and outputs an electrical signal indicating the detected pressure value to the controller 36. Likewise, the pressure sensor 412 detects the pressure of the pressure oil in the oil passage 44 and outputs an electrical signal indicating the detected pressure value to the controller 36. The controller 36 switches the spool position at the control valve 315 in correspondence to the pressures in the oil passages 43 and 44 detected via the pressure sensors 411 and 412, the ON/OFF state of an ON/OFF switch 323, to be detailed later, installed at the operation lever 304 and the like.

Figure 28:
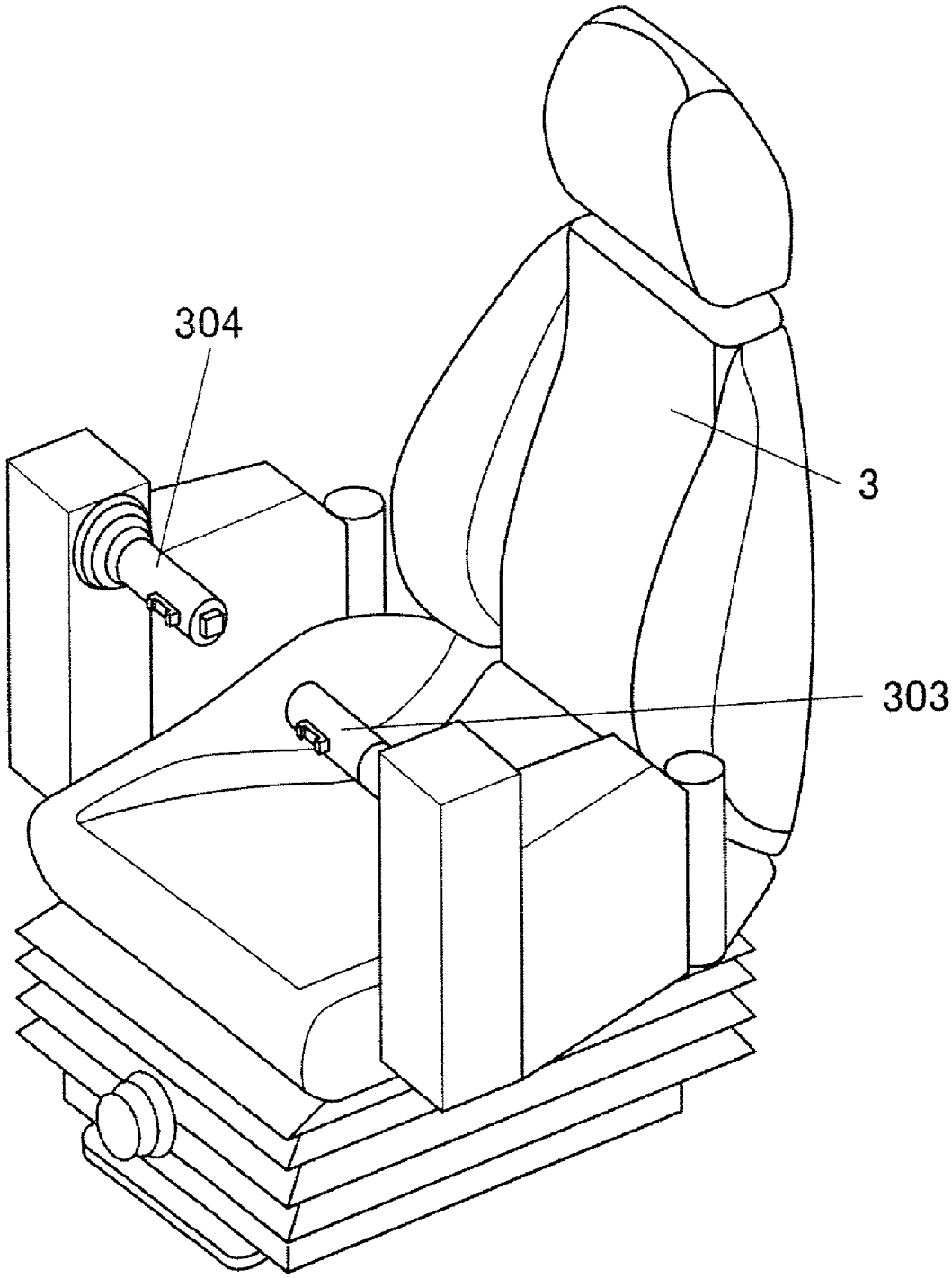
FIG. 28 is a perspective of an operator's seat.
Figure 29:
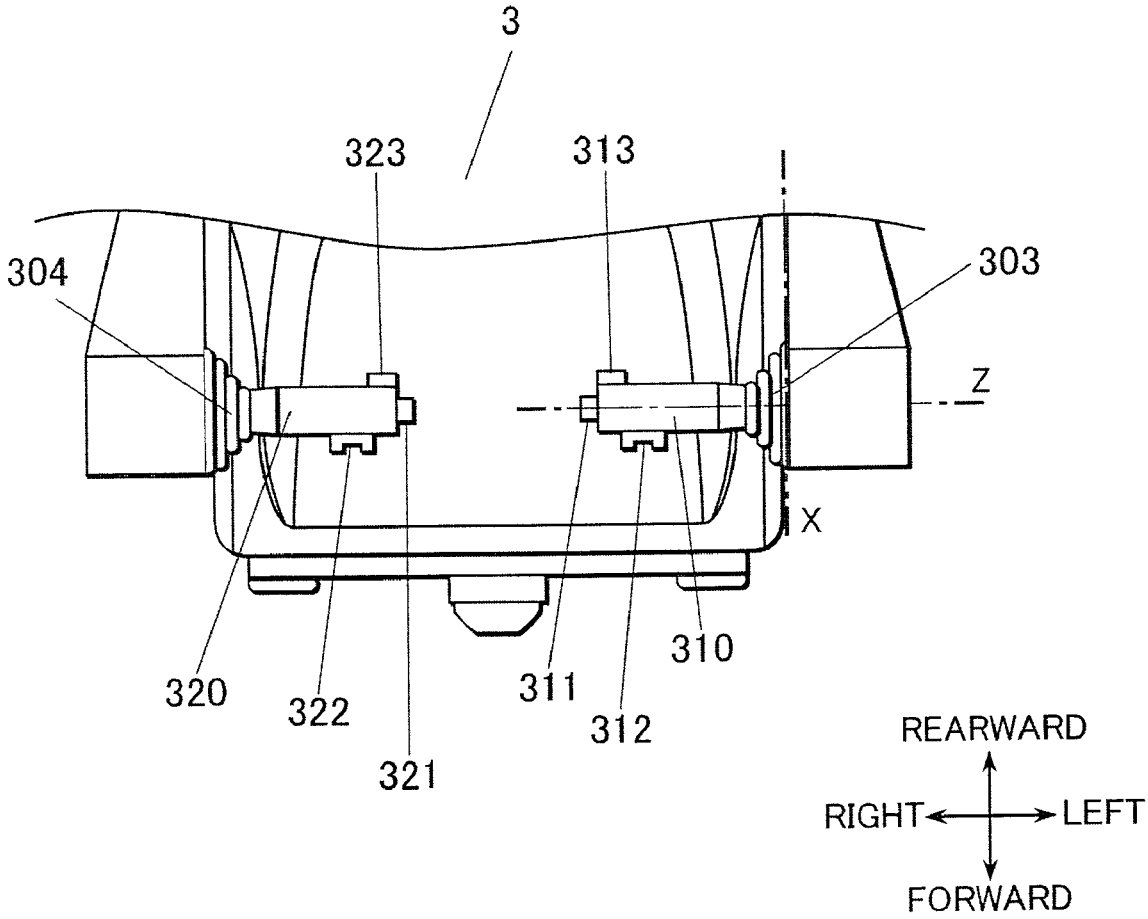
FIG. 29 is a top view of the area around operation levers.

The operation levers 303 and 304 are electric operation levers disposed on the two sides of an operator's seat 3 as shown in FIG. 28. It is to be noted that the operator's seat 3 is installed in the operator's cab 11*a*. FIG. 29 is a top view of the area around the operation levers 303 and 304. The operation lever 303 is constituted with a lever grip 310, a gripping operation lever 311, a swing operation lever 312 and the ON/OFF switch 313. The lever grip 310 can be operated up/down relative to the X axis in the figure and forward/rearward relative to the Y axis (not shown) which extends perpendicular to the drawing sheet on which FIG. 29 is drawn. The lever grip 310 can also be operated to turn around the Z axis in the figure.

As the lever grip 310 is operated along the up/down direction, the boom cylinder 14 extends/contracts to cause the boom 13 to swing along the up/down direction, as detailed later. As the lever grip 310 is operated along the forward/rearward direction, the arm cylinder 16 extends/contracts to cause the arm 15 to swing along the up/down direction as detailed later. As the lever grip 310 is rotated, the work tool cylinder 18 is caused to extend/contract to rotate the gripping device 110 along the up/down direction.

The gripping operation lever 311 is operated to open/close the gripping claws 112 at the gripping device 110, whereas the swing operation lever 312 is operated to swing the first front work arm A to the left/right. The ON/OFF switch 313 is an operation switch operated to allow/disallow operation of the work load follow-up device 201 and an operation signal originating from the ON/OFF switch is output to the controller 36.

The operation lever 304 is constituted with a lever grip 320, a gripping operation lever 321, a swing operation lever 322 and the ON/OFF switch 323. The lever grip 320, which is similar to the lever grip 310, can be operated along the up/down direction and the forward/rearward direction. In addition, the lever grip 320 can be rotated just as the lever grip 310 is rotated.

As the lever grip 320 is operated along the up/down direction, the boom cylinder 24 extends/contracts to cause the boom 23 to swing along the up/down direction. As the lever grip 320 is operated along the forward/rearward direction, the arm cylinder 26 extends/contracts to cause the arm 25 to swing along the up/down direction. As the lever grip 320 is rotated, the work tool cylinder 28 is caused to extend/contract to rotate the gripping device 120 along the up/down direction.

The gripping operation lever 321 is operated to open/close the gripping claws 122 at the gripping device 120, whereas the swing operation lever 322 is operated to swing the second front work arm B to the left/right. The ON/OFF switch 323 is an operation switch operated to allow/disallow operation of the work load follow-up device 202 and an operation signal originating from the ON/OFF switch is output to the controller 36.

As a specific operation lever is operated in the construction machine 100 structured as described above, the spool at the control valve corresponding to the relevant hydraulic cylinder is driven and thus, the hydraulic cylinder is driven at the speed corresponding to the extent to which the operation lever is operated. For instance, as the lever grip 310 corresponding to the boom cylinder 14 is operated along the up/down direction, the controller 36 drives the spool at the control valve 301 based upon the extent to which the lever grip 310 is operated along the up/down direction. The boom cylinder 14 is thus driven at a speed corresponding to the extent to which the lever grip 310 is operated along the up/down direction. The arm cylinder 16, the work tool cylinder 18, the cylinder 17 and the oscillating cylinder 19 are all driven in a similar manner.

As pressure oil is delivered into the bottom-side oil chamber 14*a* at the boom cylinder 14, the boom 13 is driven to swing upward relative to the revolving superstructure 11, whereas if pressure oil is delivered into the rod-side oil chamber 14*b* at the boom cylinder 14, the boom 13 is driven to swing downward relative to the revolving superstructure 11. As pressure oil is delivered into the bottom-side oil chamber 16*a* at the arm cylinder 16, the arm 15 is driven to swing downward relative to the boom 13, whereas if pressure oil is delivered into a rod-side oil chamber 16*b* at the arm cylinder 16, the arm 15 is driven to swing upward relative to the boom 13.

As pressure oil is delivered into the bottom-side oil chamber 18*a* at the work tool cylinder 18, the gripping device 110 is driven to swing downward relative to the arm 15, whereas if pressure oil is delivered into the rod-side oil chamber 18*b*, the gripping device 110 is driven to swing upward relative to the arm 15. As pressure oil is delivered to the bottom-side oil chamber (not shown) at the cylinder 17, the pair of gripping claws 112 is driven along the gripping direction, whereas if pressure oil is delivered into the rod-side oil chamber (not shown) at the cylinder 17, the pair of gripping claws 112 are driven along the releasing direction. As pressure oil is delivered into the bottom-side oil chamber 19*a* at the oscillating cylinder 19, the first front work arm A is driven to swing to the left relative to the hinge 8*a*, whereas as pressure oil is delivered into the rod-side oil chamber 19*b* at the oscillating cylinder 19, the first front work arm A is driven to swing to the right relative to the hinge 8*a*.

It is to be noted that since the various hydraulic cylinders at the second front work arm B operate in a manner similar to that with which the hydraulic cylinders at the first front work arm A operate, an explanation of their operation is omitted.

Operations of the Work Load Follow-Up Devices 201

When the ON/OFF switch 313 is in the OFF state, the operations of all the work load follow-up devices 201, each connected to the hydraulic circuit that drives one of; the hydraulic cylinders 14, 16, 18 and 19, are disallowed. Namely, when the ON/OFF switch 313 is in the OFF state, the controller 36 demagnetizes the solenoids at all the control valves 305. As a result, the spools at the control valves 305 each assume the neutral position, disconnecting the oil passages 41 and 42 from the oil passages 45 and 46 and thus, the pressure oil in the bottom-side oil chambers 14*a*, 16*a*, 18*a* and 19*a* and the pressure oil in the rod-side oil chambers 14*b*, 16*b*, 18*b* and 19*b* at the individual hydraulic cylinders 14, 16, 18 and 19 do not flow into the downstream side of the control valves 305. This means that the behaviors of the individual hydraulic cylinders 14, 16, 18 and 19 are not affected by the corresponding accumulators 306. For instance, as the operation lever 303 is operated, the boom 13 is driven to swing upward relative to the revolving superstructure 11 if the pressure oil is delivered into the bottom-side oil chamber 14*a* and is driven to swing downward relative to the revolving superstructure 11 if the pressure oil is delivered into the rod-side oil chamber 14*b*.

As the gripping claws 112 come into contact with the work target object and the swinging motion of the boom 13 stops while the lever grip 310 is still operated along the up/down direction, the pressure of the pressure oil supplied to the boom cylinder 14 rises to the level defined by the main relief valve 33. If, on the other hand, a swinging motion or the like of, for instance, the arm 15 causes the gripping claws 112 to contact the work target object while the lever grip 310 is not operated along the up/down direction, the pressure in either the oil chamber 14*a* or the oil chamber 14*b* at the boom cylinder 14 rises in correspondence to the contact force (work load) with which the gripping claws 112 and the work target object have come into contact with each other. Since the flow of the pressure oil in the oil chambers 14*a* and 14*b* at the boom cylinder 14 to the outside is blocked by the control valve 301 and the control valve 305, the boom 13 does not swing while the lever grip 310 is not operated along the up/down direction.

As described above, the operations of the hydraulic cylinders 14, 16, 18 and 19 are not affected by the work load follow-up devices 201 when the oil passages 41 and 42 are disconnected from the oil passages 45 and 46 via the control valves 305. In other words, if the movement of the front work arm A is not to follow the displacement of the work target object which applies the work load, the ON/OFF switch 313 should assume the OFF state.

When the ON/OFF switch 313 is in the ON state, the work load follow-up devices 201 are allowed to engage in operation. More specifically, the work load follow-up device 201 connected to the hydraulic circuit that drives the boom cylinder 14 is engaged in operation when the boom cylinder 14 is not extending/contracting and the absolute value of the difference between the pressure in the oil passage 41 and the pressure in the oil passage 42 detected via the pressure sensors 401 and 402 respectively (i.e., the difference between the pressure in the bottom-side oil chamber 14*a* and the pressure in the rod-side oil chamber 14*b*) is equal to or greater than a threshold value ΔP1. It is to be noted that the threshold value ΔP1 is a predetermined specific value. The work load follow-up device 201 connected to the hydraulic circuit that drives the arm cylinder 16 is engaged in operation when the arm cylinder 16 is not extending/contracting and the absolute value of the difference between the pressure in the oil passage 41 and the pressure in the oil passage 42 detected via the pressure sensors 401 and 402 respectively (i.e., the difference between the pressure in the bottom-side oil chamber 16*a* and the pressure in the rod-side oil chamber 16*b*) is equal to or greater than the threshold value ΔP1.

The work load follow-up device 201 connected to the hydraulic circuit that drives the work tool cylinder 18 is engaged in operation when the work tool cylinder 18 is not extending/contracting and the absolute value of the difference between the pressure in the oil passage 41 and the pressure in the oil passage 42 detected via the pressure sensors 401 and 402 respectively (i.e., the difference between the pressure in the bottom-side oil chamber 18*a* and the pressure in the rod-side oil chamber 18*b*) is equal to or greater than the threshold value ΔP1. The work load follow-up device 201 connected to the hydraulic circuit that drives the oscillating cylinder 19 is engaged in operation when the oscillating cylinder 19 is not extending/contracting and the absolute value of the difference between the pressure in the oil passage 41 and the pressure in the oil passage 42 detected via the pressure sensors 401 and 402 respectively (i.e., the difference between the pressure in the bottom-side oil chamber 19*a* and the pressure in the rod-side oil chamber 19*b*) is equal to or greater than the threshold value ΔP1.

Namely, the controller 36 makes a decision for the work load follow-up device 201 connected to the hydraulic circuit that drives the boom cylinder 14 as to whether or not the lever grip 310 remains unoperated along the up/down direction based upon the operation signal output from the operation lever 303 when the ON/OFF switch 313 is in the ON state. In addition, the controller 36 calculates the difference between the pressure in the oil passage 41 and the pressure in the oil passage 42 (i.e., the difference between the pressure in the bottom-side oil chamber 14*a* and the pressure in the rod-side oil chamber 14*b*) based upon the pressures in the oil passages 41 and 42 detected via the pressure sensors 401 and 402 and makes a decision as to whether or not the absolute value of the pressure difference thus calculated is equal to or greater than the threshold value ΔP1.

If affirmative decisions are made in both decision-making steps described above, the controller 36 switches the spool position by exciting the solenoid at the control valve 305 so as to connect either the oil passage 41 or the oil passage 42 with the higher pressure to the oil passage 45 and connect the oil passage with the lower pressure to the oil passage 46 based upon the pressures in the oil passages 41 and 42 detected via the pressure sensors 401 and 402 respectively. As a result, the pressure oil in either the oil chamber 14*a* or the oil chamber 14*b* (hereafter referred to as a high-pressure side oil chamber) that has come into communication with the oil passage with the higher pressure is absorbed at the accumulator 306. Since this allows the accumulator 306 to function as a spring element against the work load applied to the boom cylinder 14, a sudden increase in the work load applied to the boom cylinder 14 is prevented. In other words, the behavior of the boom cylinder 14 is affected by the accumulator 306.

Likewise, the controller 36 makes a decision for the work load follow-up device 201 connected to the hydraulic circuit that drives the arm cylinder 16 as to whether or not the lever grip 310 remains unoperated along the forward/rearward direction based upon the operation signal output from the operation lever 303 when the ON/OFF switch 313 is in the ON state. In addition, the controller 36 calculates the difference between the pressure in the oil passage 41 and the pressure in the oil passage 42 (i.e., the difference between the pressure in the bottom-side oil chamber 16*a* and the pressure in the rod-side oil chamber 16*b*) based upon the pressures in the oil passages 41 and 42 detected via the pressure sensors 401 and 402 and makes a decision as to whether or not the absolute value of the pressure difference thus calculated is equal to or greater than the threshold value ΔP1.

If affirmative decisions are made in both decision-making steps described above, the controller 36 switches the spool position by exciting the solenoid at the control valve 305 so as to connect either the oil passage 41 or the oil passage 42 with the higher pressure to the oil passage 45 and connect the oil passage with the lower pressure to the oil passage 46 based upon the pressures in the oil passages 41 and 42 detected via the pressure sensors 401 and 402 respectively. As a result, the pressure oil in the high-pressure side oil chamber, i.e., either the oil chamber 14*a* or the oil chamber 14*b*, is absorbed at the accumulator 306. Since this allows the accumulator 306 to function as a spring element against the work load applied to the arm cylinder 16, a sudden increase in the work load applied to the arm cylinder 16 is prevented. In other words, the behavior of the arm cylinder 16 is affected by the accumulator 306.

The operations of the work load follow-up device 201 connected to the hydraulic circuit that drives the work tool cylinder 18 and the work load follow-up device 201 connected to the hydraulic circuit that drives the oscillating cylinder 19 are both similar to those described above.

If, for instance, a swinging motion or the like of the arm 15 causes a gripping claw 19 to contact the work target object while the lever grip 310 is not operated along the up/down direction, the pressure in either the oil chamber 14*a* or the oil chamber 14*b* at the boom cylinder 14 rises in correspondence to the work load. When the lever grip 310 is not operated along the up/down direction, the pressure oil in the high-pressure side oil chamber does not flow out via the control valve 301. However, since the oil passages 41 and 42 and the oil passages 45 and 46 are in communication with each other via the control valve 305, the pressure oil in the high-pressure side oil chamber flows into the accumulator 306 via the control valve 305, as explained earlier.

As a result, the pressure oil in the high-pressure side oil chamber is absorbed and collected at the accumulator 306 in correspondence to the work load and ultimately, the boom 13 swings as the boom cylinder 14 extends/contracts in correspondence to the quantity of pressure oil collected at the accumulator 306. If the work load becomes reduced, the pressure oil having been collected at the accumulator 306 is allowed to flow back to the high-pressure side oil chamber, causing the boom cylinder 14 to extend/contract. Thus, the swinging motion of the boom 13 is affected by the level of the work load. Namely, since the boom 13 is caused to swing as the pressure oil in the high-pressure side oil chamber is absorbed and collected at the accumulator 306 and then the pressure oil having been collected at the accumulator 306 is released in correspondence to the work load, the operation of the gripping device 110 conforms to the displacement of the work target object, which applies an external force to the gripping claws 112 as it comes into contact with the gripping claws 112.

If the pressure in the oil passage 45 is equal to or less than the pressure level setting selected for the relief valve 307 at the time of the work load application, the pressure oil in the high-pressure side oil chamber will not have flowed back into the hydraulic operating fluid reservoir 32 via the relief valve 307. Under these circumstances, as the work load application stops and the pressure oil having been collected at the accumulator 306 flows back to the high-pressure side oil chamber, the cylinder rod at the boom cylinder 14 resumes the pre-work load application extension position.

If the pressure in the oil passage 45 exceeds the pressure level setting selected for the relief valve 307 at the time of the work load application, the pressure oil in the high-pressure side oil chamber flows back into the hydraulic operating fluid reservoir 32 via the relief valve 307. Under these circumstances, as the work load application stops and the pressure oil having been collected at the accumulator 306 flows back into the high-pressure side oil chamber, the cylinder rod at the boom cylinder 14 moves back closer to the pre-work load application extension position but stops at a position short of the full pre-work load application extension position by an extent matching the quantity of pressure oil having flowed back into the hydraulic operating fluid reservoir 32.

It is to be noted that settings for allowing/not allowing the operation of the boom cylinder 14, the arm cylinder 16, the work tool cylinder 18 and the oscillating cylinder 19 to conform to the displacement of the work target object that applies the work load are selected in a batch via the ON/OFF switch 313. Namely, the operations of the work load follow-up devices 201 connected to the hydraulic circuits that drive the individual hydraulic cylinders 14, 16, 18 and 19 are allowed or are disallowed in a batch via the ON/OFF switch 313.

Since the operations of the work load follow-up devices 202 provided in conjunction with the various hydraulic cylinders at the second front work arm B are similar to those at the first front work arm A described above, their explanation is omitted.

Figure 30:
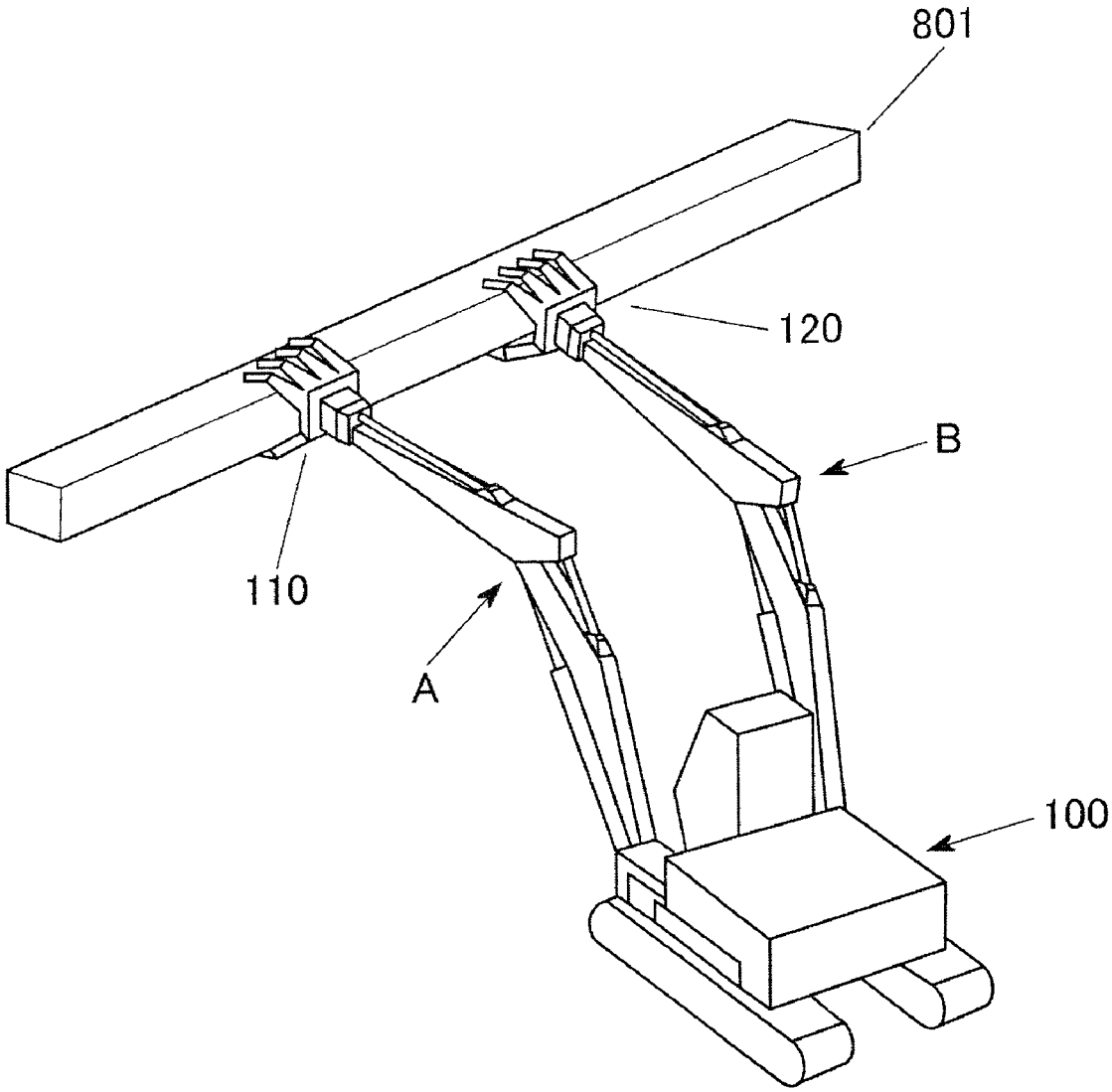
FIG. 30 illustrates the construction machine engaged in operation to grip a gripping target object.

FIG. 30 illustrates an operation of the construction machine 100 in the embodiment executed to grip a gripping target object 801. When the gripping target object is gripped at a gripping device mounted at one of the work arms at a construction machine equipped with two arms in the related art, which does not include the work load follow-up devices 201 and 202, the gripping device mounted at the other work arm is not able to grip the gripping target object readily due to the difficulty in aligning the gripping device mounted at the other work arm.

In contrast, the misalignment between the gripping devices 110 and 120 due to the difference between the attitude of the first front work arm A and the attitude of the second front work arm B can be absorbed via the work load follow-up devices 201 and 202 in the construction machine 100 achieved in the embodiment, and thus, the gripping target object 801 can be gripped by aligning the gripping devices 110 and 120 more easily. In addition, even if a difference occurs between the attitudes of the first front work arm A and the second front work arm B while transporting the gripping target object 801 gripped by the left-side gripping device 110 and the right-side gripping device 120, the misalignment between the gripping devices 110 and 120 is absorbed by the work load follow-up devices 201 and 202, which minimizes the risk of an excessive load being applied to the front work arms A and B and the gripping target object 801.

In addition, since the accumulators 306 and 316 can no longer affect the behaviors of the cylinders once the operations of the work load follow-up devices 201 and 202 are disallowed, a response delay in the operating force applied to the gripping target object is prevented to assure good operability and sustain the desired level of work efficiency.

Examples of Operations

When gripping the gripping target object 801 with the left-side gripping device 110 and the right-side gripping device 120 at the construction machine 100 in the embodiment, as shown in FIG. 30, any misalignment between the gripping device 110 and the gripping device 120 caused by the difference between the attitude of the first front work arm A and the attitude of the second front work arm B can be absorbed by engaging at least either the work load follow-up devices 201 or the work load follow-up devices 202.

For instance, the operations of the work load follow-up devices 201 may be disallowed by turning off the ON/OFF switch 313 and the operations of the work load follow-up devices 202 may be allowed by turning on the ON/OFF switch 323. In this state, the gripping target object 801 may first be gripped by the gripping device 110 at the first front work arm A and then the gripping target object 801 may be gripped by the gripping device 120 at the second front work arm B. Even if the position of the gripping device 120 about to grip the gripping target object 801 is somewhat offset relative to the gripping target object 801 already gripped by the gripping device 110, the attitude of the second front work arm B is adjusted as necessary as the work load follow-up devices 202 are engaged in operation.

Even if there is a difference between the attitude of the front work arm A and the attitude of the second front work arm B while the gripping target object 801 gripped by the left-side gripping device 110 and the right-side gripping device 120 is being moved, the misalignment between the gripping devices 110 and 120 is absorbed by the work load follow-up devices 202.

Both the work load follow-up devices 201 and 202 are allowed to engage in operation when the ON/OFF switches 313 and 323 are turned on. In this state, the gripping target object 801 is first gripped by the gripping device 110 at the first front work arm A and then the gripping target object 801 is gripped by the gripping device 120 at the second front work arm B. Even if the position of the gripping device 120 about to grip the gripping target object 801 is somewhat offset relative to the gripping target object 801 already gripped by the gripping device 110, the attitude of the first front work arm A and/or the attitude of the second front work arm Bare adjusted as necessary as the work load follow-up devices 201 and/or the work load follow-up devices 202 are engaged in operation.

Even if there is a difference between the attitude of the front work arm A and the attitude of the second front work arm B while the gripping target object 801 gripped by the left-side gripping device 110 and the right-side gripping device 120 is being moved, the misalignment between the gripping devices 110 and 120 is absorbed by the work load follow-up devices 201 and 202.

Figure 31:
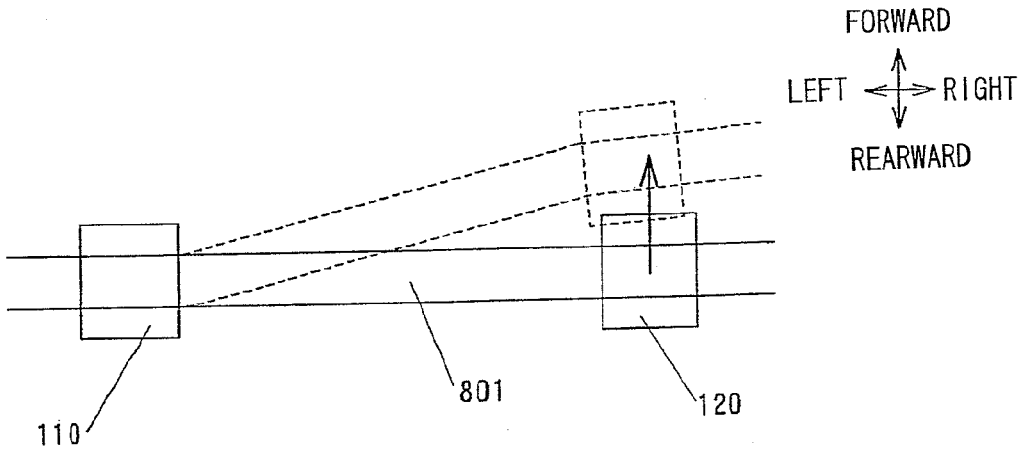
FIG. 31 schematically illustrates the state of the gripping devices and the gripping target object as the second front work arm B is rotated along the forward/rearward direction without moving the first front work arm A.

In addition, the gripping target object 801 gripped by both gripping devices 110 and 120 can be bent by rotating the second front work arm B along the forward/rearward direction without moving the front work arm A, as shown in FIG. 31. When the gripping target object is bent, the distance between the gripping devices 110 and 120 along the left/right direction becomes shorter. Namely, the distance between the gripping devices 110 and 120 along the left/right direction is altered as the gripping target object 801 becomes bent. Such a change in the distance between the gripping devices can be absorbed in the construction machine 100 achieved in the embodiment, since the work load follow-up devices 201 and 202 connected to the hydraulic circuits which drive the oscillating cylinders 19 and 29 allow the front work arms A and B to swing along the left/right direction.

Work tools other than the gripping devices 110 and 120 may be used. For instance, a force following operation can be performed over a wall surface, a base surface or the like with a bucket mounted as a work tool at the first front work arm A in place of the gripping device 110 and, in such a case, ground leveling and the like can be performed with ease with the bucket.

Figure 38:
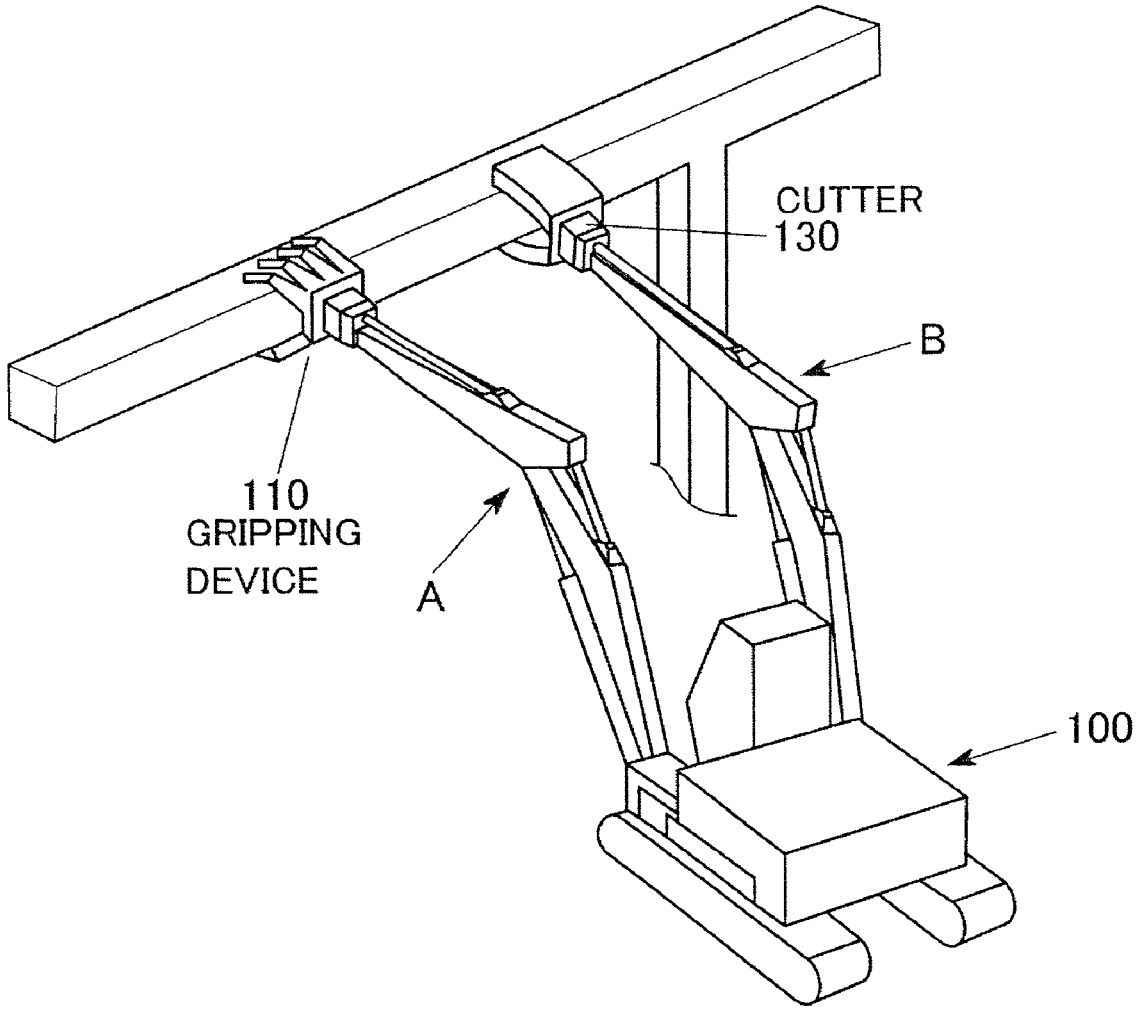
FIG. 38 shows an example of a work operation.

Also, the construction machine 100 with a cutter 130 mounted as a work tool at the second front work arm instead of the gripping device 120, as shown in FIG. 38, can be used in a cutting operation to cut steel reinforcing bars during demolition work. In this situation, the cutting target object gripped by the gripping device 110 at the first front work arm A may be cut with the cutter 130 mounted at the second front work arm B. If the cutting target object should stay still during the cutting operation, the operations of the work load follow-up devices 201 at the first front work arm A should be disallowed so as to hold the cutting target object still with the gripping device 110. In addition, the angle with which the blades of the cutter 130 contact the cutting target object can be corrected as necessary during the cutting operation by allowing the operations of the work load follow-up devices 202 at the second front work arm B. Namely, even if one of the two blades at the cutter first contacts the cutting target object, the cutting target object ultimately comes into contact with both blades as the attitude of the second front work arm B is adjusted. Thus, even during a cutting operation executed to cut a reinforcing steel bar or the like that cannot be visually checked by the user (operator) of the construction machine 100 with ease, the cutter blade contact is optimally corrected. As a result, application of an excessive load to the cutter or at the cutting target object is prevented and the application of an excessive load to the front work arms A and B, too, can be effectively prevented.

It is to be noted that under circumstances in which it is acceptable for the cutting target object to move during the cutting operation, the cutter blade contact angle can be corrected in an optimal manner during the cutting operation by allowing the operations of the work load follow-up devices 201 at the first front work arm A, regardless of whether or not the operations of the work load follow-up devices 202 at the second front work arm B are allowed.

Flowchart

Figure 32:
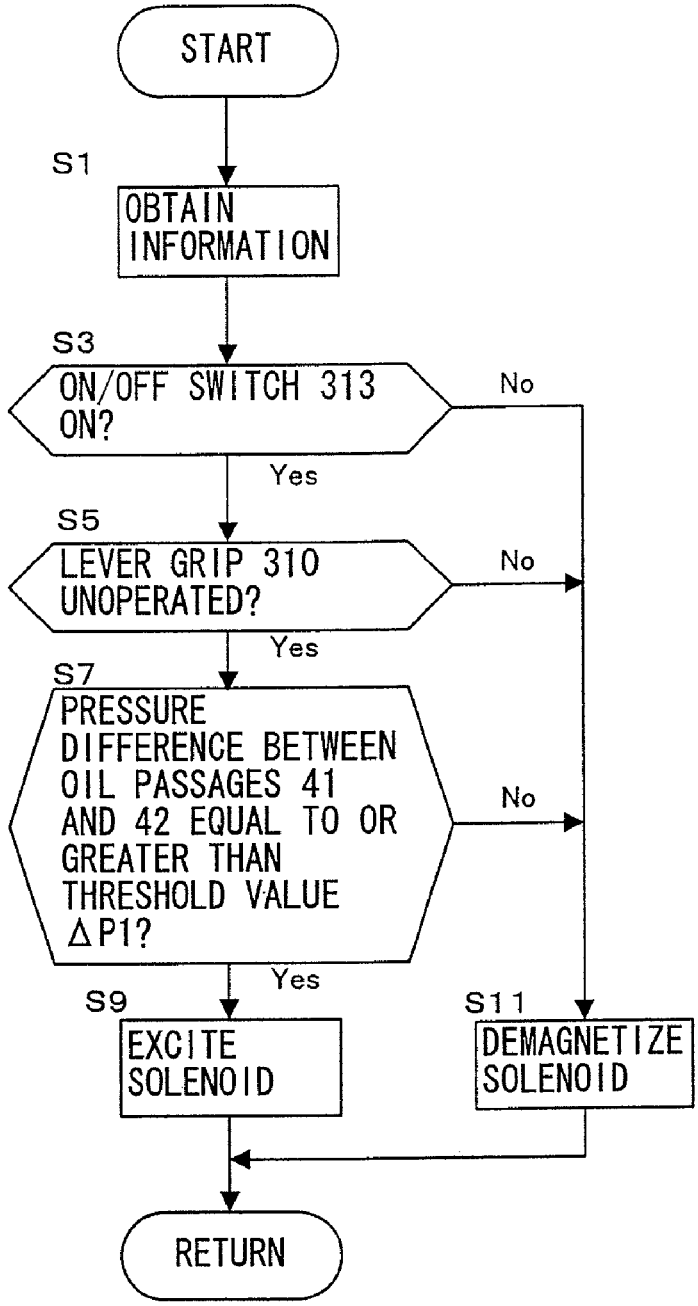
FIG. 32 presents a flowchart of the control processing operation executed to control the control valves in the work load follow-up devices.

FIG. 32 presents a flowchart of the control processing operation executed to control the control valves 305 at the work load follow-up devices 201 and 202. The program in conformance to which the processing shown in FIG. 32 is executed is started up as an ignition switch (not shown) is turned on at the construction machine 100 and the program thus started up is executed by the controllers 36. It is to be noted that while the control executed on the work load follow-up device 201 connected to the hydraulic circuit that drives the boom cylinder 14 is explained below, similar control is executed on the work load follow-up devices 201 connected to the hydraulic circuits that drive the other hydraulic cylinders 16, 18 and 19. In addition, the work load follow-up devices 202 at the second front work arm B are controlled in a similar manner.

In step S1, information indicating the states of the various units constituting the construction machine 100 is obtained. More specifically, information indicating, at least, the on/off state of the ON/OFF switch 313, the extent to which the lever grip 310 has been operated along the up/down direction and the pressures in the oil passages 41 and 42 detected via the pressure sensors 401 and 402 is obtained. Once step S1 is executed, the operation proceeds to step S3 to make a decision based upon the information having been obtained in step S1 as to whether or not the ON/OFF switch 313 is currently in the ON state.

If an affirmative decision is made in step S3, the operation proceeds to step S5 to make a decision based upon the information having been obtained in step S1 as to whether or not the lever grip 310 remains unoperated along the up/down direction. It is to be noted that the decision as to whether or not the lever grip 310 remains unoperated along the up/down direction is made in step S5 as part of the control of the work load follow-up device 201 connected to the hydraulic circuit that drives the boom cylinder 14. However, if the processing is executed to control the work load follow-up device 201 connected to the hydraulic circuit that drives the arm cylinder 16, a decision is made in step S5 by judging whether or not the lever grip 310 has been operated along the forward/rearward direction.

Likewise, if the processing is executed to control the work load follow-up device 201 connected to the hydraulic circuit that drives the work tool cylinder 18, a decision is made in step S5 by judging whether or not the lever grip 310 has been rotated. If the processing is executed to control the work load follow-up device 201 connected to the hydraulic circuit that drives the oscillating cylinder 19, a decision is made in step S5 by judging whether or not the swing operation lever 312 has been operated.

If an affirmative decision is made in step S5, the operation proceeds to step S7 to make a decision based upon the information having been obtained in step S1 as to whether or not the absolute value representing the difference between the pressure in the oil passage 41 and the pressure in the oil passage 42 is equal to or greater than the threshold value $\Delta P1$. If an affirmative decision is made in step S7, the operation proceeds to step S9 to excite the solenoid at the control valve 305 based upon the information having been obtained in step S1 so as to connect the oil passage with the higher pressure to the oil passage 45 and connect the oil passage with the lower pressure to the oil passage 46, and then the operation makes a return.

If a negative decision is made in step S3, a negative decision is made in step S5 or a negative decision is made in step S7, the operation proceeds to step S11 to demagnetize the solenoid at the control valve 305, and then the operation makes a return.

The following operational advantages can be achieved in the construction machine 100 in the seventh embodiment.

(1) The construction machine 100 includes the work load follow-up devices 201 and 202, each installed in the hydraulic circuit that drives one of the hydraulic cylinders at the first front work arm A and the second front work arm B. This structure allows any misalignment manifested by the gripping devices 110 and 120 due to the difference between the attitude of the first front work arm A and the attitude of the second front work arm B, to be absorbed by the work load follow-up devices 201 and 202 and thus, the gripping devices 110 and 120 engaged in operation to grip the gripping target object 801 can be aligned relative to each other with ease. In addition, even if a difference occurs between the attitude of the first front work arm A and the attitude of the second front work arm B when carrying the gripping target object 801 gripped by the left-side gripping device 110 and the right-side gripping device 120, the misalignment manifested by the gripping devices 110 and 120 can be absorbed by the work load follow-up devices 201 and 202 and thus, the application of an excessive load to the gripping target object 801 is prevented. In other words, since the need to align the gripping devices 110 and 120 with a high level of rigor is eliminated, the operation for causing the first front work arm A and the second front work arm B to swing in coordination with each other can be performed with better ease, which, in turn, improves the work efficiency and reduces operator fatigue.

(2) The operations of the work load follow-up devices 201 and 202 can be allowed or disallowed by turning on/off the ON/OFF switches 313 and 323. Since the operations of the accumulators 306 and 316 cannot affect the behaviors of the cylinders once the operations of the work load follow-up devices 201 and 202 are disallowed, a response delay in the operating force applied to the gripping target object is prevented to assure good operability and sustain the desired level of work efficiency.

(3) As the ON/OFF switches 313 and 323 are turned on and off in a specific combination, the operations of both the work load follow-up devices 201 and 202 are allowed. In addition, by turning the ON/OFF switches 313 and 323 on and off in a specific combination, the operations of either the work load follow-up devices 201 or 202 are allowed but the operations of the other work load follow-up devices are disallowed. By turning the ON/OFF switches 313 and 323 on and off in a specific combination, the operations of both the work load follow-up devices 201 and 202 are disallowed. Since the operations of the work load follow-up devices 201 and 202 can be allowed or disallowed as desired in correspondence to the nature of the work to be performed or the work environment, the work efficiency is bound to improve.

(4) The work load follow-up devices 201 and 202 are installed in the hydraulic circuits that drive the oscillating cylinders 19 and 29 respectively. Since any misalignment manifested by the gripping devices 110 and 120 due to the difference between the attitude of the first front work arm A and the attitude of the second front work arm B can be absorbed by the work load follow-up devices 201 and 202 when the first front work arm A and the second front work arm B swing along the left/right direction, the operability is improved.

(5) The work load follow-up devices 201 are each constituted with the control valve 305, the accumulator 306, the relief valve 307 and the pressure sensors 401 and 402, whereas the work load follow-up devices 202 are each constituted with the control valve 315, the accumulators 316, the relief valve 317 and the pressure sensors 411 and 412. The control valves 305 and 315 are each controlled by the controller 36. Since the work load follow-up devices 201 and 202 assume a simple hydraulic circuit structure, any increase in the cost of the work load follow-up devices 201 and 202 and the construction machine 100 can be minimized.

Eighth Embodiment

Figure 33:
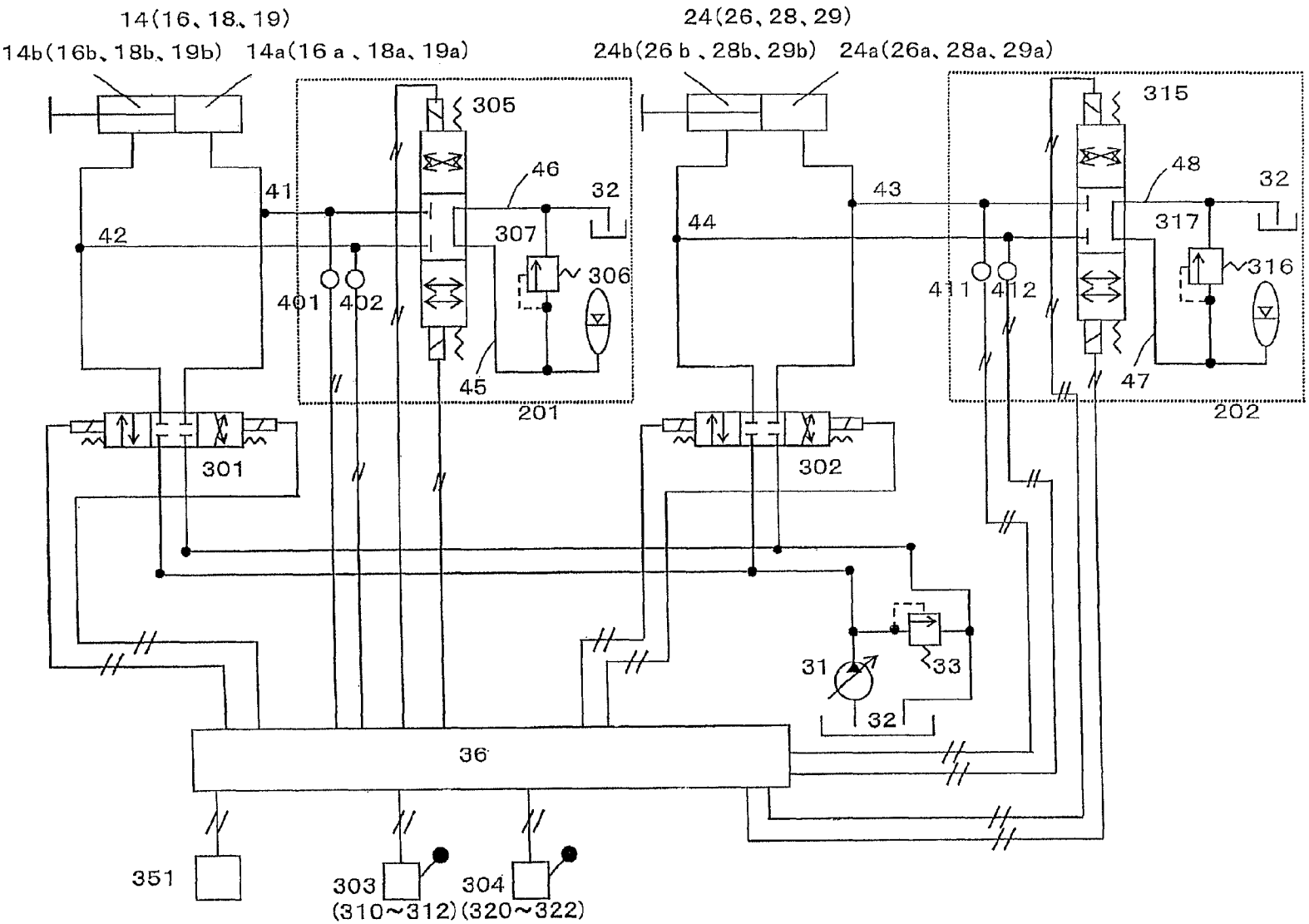
FIG. 33 is a circuit diagram of the hydraulic circuit in the construction machine achieved in an eighth embodiment.
Figure 34:
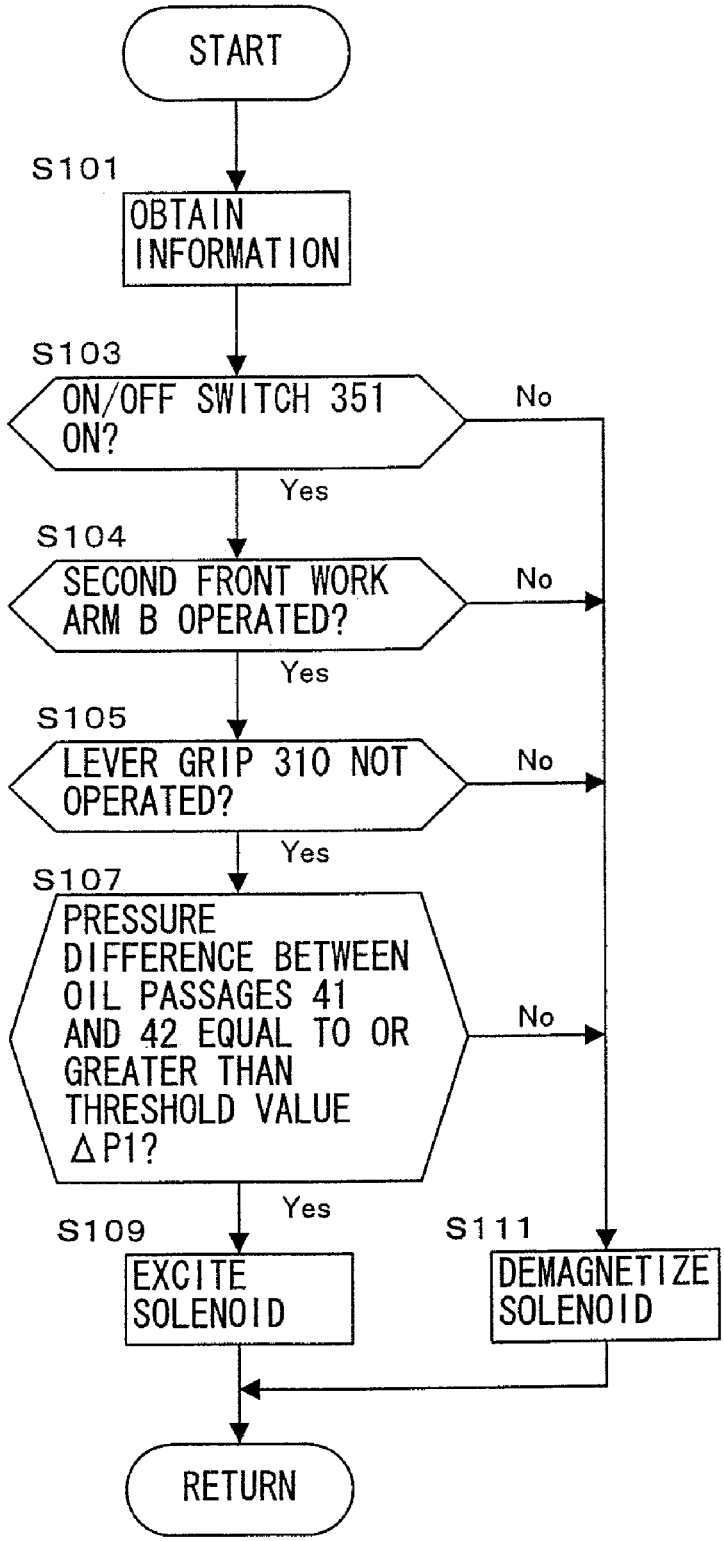
FIG. 34 presents a flowchart of the control processing operation executed to control the control valves in the work load follow-up devices in the eighth embodiment.

In reference to FIGS. 33 and 34, the eighth embodiment of the construction machine according to the present invention is explained. The same reference numerals are assigned to structural elements identical to those in the seventh embodiment and the following explanation focuses on the differences from the seventh embodiment. Structural elements that are not specially noted in the following explanation are identical to those in the seventh embodiment. The eighth embodiment differs from the seventh embodiment mainly in that the work load follow-up devices 201 are engaged in operation by checking whether or not the second front work arm B has been operated and that the work load follow-up devices 202 are engaged in operation by checking whether or not the first front work arm A has been operated.

FIG. 33 is a circuit diagram pertaining to the hydraulic circuits that drive the boom cylinders 14 and 24, the arm cylinders 16 and 26, the work tool cylinders 18 and 28 and the oscillating cylinders 19 and 29 in the construction machine 100. While an explanation is given below on the hydraulic circuit that drives the boom cylinders 14 and 24, the hydraulic circuits that drive the arm cylinders 16 and 26, the work tool cylinders 18 and 28 and the oscillating cylinders 19 and 29 assume identical structures. The hydraulic circuit differs from the hydraulic circuit explained in reference to the seventh embodiment in that an ON/OFF switch 351 is connected to the controller 36. It is to be noted that the ON/OFF switches 313 and 323 are not installed at the operation levers 303 and 304 in this embodiment.

Operations of the Work Load Follow-Up Devices 201 and 202

When the ON/OFF switch 351 is in the OFF state, the operations of all the work load follow-up devices 201, each connected to the hydraulic circuit that drives one of; the hydraulic cylinders 14, 16, 18 and 19, are disallowed. Namely, when the ON/OFF switch 351 is in the OFF state, the controllers 36 demagnetize the solenoids at all the control valves 305 as the solenoids are demagnetized when the ON/OFF switch 313 is in the OFF state in the seventh embodiment.

As a result, the spools at the control valves 305 each assume the neutral position, disconnecting the oil passages 41 and 42 from the oil passages 45 and 46 and thus, the pressure oil in the bottom-side oil chambers 14*a*, 16*a*, 18*a* and 19*a* and the pressure oil in the rod-side oil chambers 14*b*, 16*b*, 18*b* and 19*b* at the individual hydraulic cylinders 14, 16, 18 and 19 do not flow into the downstream side of the control valves 305. This means that the behaviors of the individual hydraulic cylinders 14, 16, 18 and 19 are not affected by the corresponding accumulators 306. Likewise, none of the workload follow-up devices 202 at the second front work arm B are engaged in operation either and thus, the accumulators 316 do not affect the behaviors of the hydraulic cylinders 24, 26, 28 and 29.

When the ON/OFF switch 351 is in the ON state, the operations of the work load follow-up devices 201 and 202 are allowed and they are actually engaged in operation if the respective conditions are all satisfied, as described below.

The work load follow-up device 201 connected to the hydraulic circuit that drives the boom cylinder 14 is engaged in operation when the following conditions (a) through (d) are satisfied.

(a) The ON/OFF switch 351 is in the ON state;

(b) one of the hydraulic cylinders 24, 26, 27, 28 or 29 at the second front work arm B is engaged in extending/contracting operation;

(c) the boom cylinder 14 is not extending/contracting; and (d) the absolute value representing the difference between the pressures in the oil passages 41 and 42 detected via the pressure sensors 401 and 402 (i.e., the difference between the pressure in the bottom-side oil chamber 14*a* and the pressure in the rod-side oil chamber 14*b*) is equal to or greater than the threshold value ΔP1.

The work load follow-up device 201 connected to the hydraulic circuit that drives the arm cylinder 16 is engaged in operation when the following conditions (a), (b), (e) and (f) are satisfied.

(a) The ON/OFF switch 351 is in the ON state;

(b) one of the hydraulic cylinders 24, 26, 27, 28 or 29 at the second front work arm B is engaged in extending/contracting operation;

(e) the arm cylinder 16 is not extending/contracting; and (f) the absolute value representing the difference between the pressures in the oil passages 41 and 42 detected via the pressure sensors 401 and 402 (i.e., the difference between the pressure in the bottom-side oil chamber 16*a* and the pressure in the rod-side oil chamber 16*b*) is equal to or greater than the threshold value ΔP1.

The work load follow-up device 201 connected to the hydraulic circuit that drives the work tool cylinder 18 is engaged in operation when the following conditions (a), (b), (g) and (h) are satisfied.

(a) The ON/OFF switch 351 is in the ON state;

(b) one of the hydraulic cylinders 24, 26, 27, 28 or 29 at the second front work arm B is engaged in extending/contracting operation;

(g) the work tool cylinder 18 is not extending/contracting; and (h) the absolute value representing the difference between the pressures in the oil passages 41 and 42 detected via the pressure sensors 401 and 402 (i.e., the difference between the pressure in the bottom-side oil chamber 18*a* and the pressure in the rod-side oil chamber 18*b*) is equal to or greater than the threshold value ΔP1.

The work load follow-up device 201 connected to the hydraulic circuit that drives the oscillating cylinder 19 is engaged in operation when the following conditions (a), (b), (i) and (j) are satisfied.

(a) The ON/OFF switch 351 is in the ON state;

(b) one of the hydraulic cylinders 24, 26, 27, 28 or 29 at the second front work arm B is engaged in extending/contracting operation;

(i) the oscillating cylinder 19 is not extending/contracting; and (j) the absolute value representing the difference between the pressures in the oil passages 41 and 42 detected via the pressure sensors 401 and 402 (i.e., the difference between the pressure in the bottom-side oil chamber 19*a* and the pressure in the rod-side oil chamber 19*b*) is equal to or greater than the threshold value ΔP1.

The work load follow-up device 202 connected to the hydraulic circuit that drives the boom cylinder 24 is engaged in operation when the following conditions (k) through (n) are satisfied.

(k) The ON/OFF switch 351 is in the ON state;

(l) one of the hydraulic cylinders 14, 16, 17, 18 or 19 at the first front work arm A is engaged in extending/contracting operation;

(m) the boom cylinder 24 is not extending/contracting; and (n) the absolute value representing the difference between the pressures in the oil passages 43 and 44 detected via the pressure sensors 411 and 412 (i.e., the difference between the pressure in the bottom-side oil chamber 24*a* and the pressure in the rod-side oil chamber 24*b*) is equal to or greater than the threshold value ΔP1.

The work load follow-up device 202 connected to the hydraulic circuit that drives the arm cylinder 26 is engaged in operation when the following conditions (k), (l), (o), and (p) are satisfied.

(k) The ON/OFF switch 351 is in the ON state;

(l) one of the hydraulic cylinders 14, 16, 17, 18 or 19 at the first front work arm A is engaged in extending/contracting operation;

(o) the arm cylinder 26 is not extending/contracting; and (p) the absolute value representing the difference between the pressures in the oil passages 43 and 44 detected via the pressure sensors 411 and 412 (i.e., the difference between the pressure in the bottom-side oil chamber 26*a* and the pressure in the rod-side oil chamber 26*b*) is equal to or greater than the threshold value ΔP1.

The work load follow-up device 202 connected to the hydraulic circuit that drives the work tool cylinder 28 is engaged in operation when the following conditions (k), (l), (q), and (r) are satisfied.

(k) The ON/OFF switch 351 is in the ON state;

(l) one of the hydraulic cylinders 14, 16, 17, 18 or 19 at the first front work arm A is engaged in extending/contracting operation;

(q) the work tool cylinder 28 is not extending/contracting; and (r) the absolute value representing the difference between the pressures in the oil passages 43 and 44 detected via the pressure sensors 411 and 412 (i.e., the difference between the pressure in the bottom-side oil chamber 28*a* and the pressure in the rod-side oil chamber 28*b*) is equal to or greater than the threshold value ΔP1.

The work load follow-up device 202 connected to the hydraulic circuit that drives the oscillating cylinder 29 is engaged in operation when the following conditions (k), (l), (s), and (t) are satisfied.

(k) The ON/OFF switch 351 is in the ON state;

(l) one of the hydraulic cylinders 14, 16, 17, 18 or 19 at the first front work arm A is engaged in extending/contracting operation;

(s) the oscillating cylinder 29 is not extending/contracting; and (t) the absolute value representing the difference between the pressures in the oil passages 43 and 44 detected via the pressure sensors 411 and 412 (i.e., the difference between the pressure in the bottom-side oil chamber 29*a* and the pressure in the rod-side oil chamber 29*b*) is equal to or greater than the threshold value ΔP1.

Namely, the respective controllers 36 read the ON/OFF state of the ON/OFF switch 351, the operating states of the operation levers 303 and 304, the pressures detected by the pressure sensors 401, 402, 411, and 412 and make decisions as to whether or not the conditions (a) through (t) described above are satisfied. The controller 36 controlling a work load follow-up device 201 or 202 satisfying the corresponding operation conditions described above switches the spool position at the control 305 by exciting the solenoid at the control valve 305 so as to connect the oil passage with the higher pressure to the oil passage 45 or 47 and connect the oil passage with the lower pressure to the oil passage 46 or 48. Thus, the pressure oil in the high-pressure side oil chamber is absorbed into the accumulator 306 or 316.

As described above, as the ON/OFF switch 351 is turned on at the construction machine 100 achieved in the eighth embodiment, the work load follow-up devices 201 and 202 are individually engaged in operation based upon the work conditions, i.e., based upon the operating states of the front work arms A and B and the loads at the front operating arms A and B.

Flowchart

FIG. 34 presents a flowchart of the control processing operation executed to control the control valves 305 and 315 at the work load follow-up devices 201 and 202, in the eighth embodiment. A program in conformance to which the processing shown in FIG. 34 is executed is started up as an ignition switch (not shown) is turned on at the construction machine 100 and the program thus started up is executed by the controllers 36. It is to be noted that while the control executed on the work load follow-up device 201 connected to the hydraulic circuit that drives the boom cylinder 14 is explained below, similar control is executed on the work load follow-up devices 201 connected to the hydraulic circuits that drive the other hydraulic cylinders 16, 18 and 19. In addition, the work load follow-up devices 202 at the second front work arm B are controlled in a similar manner.

In step S101, information indicating the states of the various units constituting the construction machine 100 is obtained. More specifically, information indicating, at least, the on/off state of the ON/OFF switch 351, the operating state of the operation lever 304, the extent to which the lever grip 310 has been operated along the up/down direction and the pressures in the oil passages 41 and 42 detected via the pressure sensors 401 and 402 is obtained. Once step S101 is executed, the operation proceeds to step S103 to make a decision based upon the information having been obtained in step S101 as to whether or not the ON/OFF switch 351 is currently in the ON state.

If an affirmative decision is made in step S104, the operation proceeds to step S104 to make a decision based upon the information having been obtained in step S101 as to whether or not the operation lever 304 has been operated. If an affirmative decision is made in step S104, the operation proceeds to step S105 to make a decision based upon the information having been obtained in step S101 as to whether or not the lever grip 310 remains unoperated along the up/down direction. It is to be noted that the decision as to whether or not the lever grip 310 remains unoperated along the up/down direction is made in step S105 as part of the control of the work load follow-up device 201 connected to the hydraulic circuit that drives the boom cylinder 14. However, if the processing is executed to control the work load follow-up device 201 connected to the hydraulic circuit that drives the arm cylinder 16, a decision is made in step S105 by judging whether or not the lever grip 310 has been operated along the forward/rearward direction.

Likewise, if the processing is executed to control the work load follow-up device 201 connected to the hydraulic circuit that drives the work tool cylinder 18, a decision is made in step S105 by judging whether or not the lever grip 310 has been rotated. If the processing is executed to control the work load follow-up device 201 connected to the hydraulic circuit that drives the oscillating cylinder 19, a decision is made in step S105 by judging whether or not the swing operation lever 312 has been operated.

If an affirmative decision is made in step S105, the operation proceeds to step S107 to make a decision based upon the information having been obtained in step S101 as to whether or not the absolute value representing the difference between the pressure in the oil passage 41 and the pressure in the oil passage 42 is equal to or greater than the threshold value ΔP1. If an affirmative decision is made in step S107, the operation proceeds to step S109 to excite the solenoid at the control valve 305 based upon the information having been obtained in step S101 so as to connect the oil passage with the higher pressure to the oil passage 45 and connect the oil passage with the lower pressure to the oil passage 46, and then the operation makes a return.

If a negative decision is made in step S103, a negative decision is made in step S104, a negative decision is made in step S105 or a negative decision is made in step S107, the operation proceeds to step S111 to demagnetize the solenoid at the control valve 305, and then the operation makes a return.

In addition to the advantages of the seventh embodiment, the following additional operational advantages can be achieved with the construction machine 100 in the eighth embodiment.

(1) A decision is made as to whether or not one of the front operation arms is engaged in operation and if a front work arm is judged to be in operation, operation of the work load follow-up devices installed in conjunction with the other front work arm are allowed. Thus, as the ON/OFF switch 351 is turned on and one of the front work arms is judged to be engaged in operation, the other front work arm is made to perform a follow-up operation in correspondence to the load applied to the other front work arm, so as to perform work by utilizing both the first front work arm A and the second front work arm B. In addition, if one of the front work arms is not engaged in operation, the accumulator 306 or 316 do not affect the behavior of the other front work arm and, as a result, a response delay in the operating force applied to the gripping target object is prevented. Thus, even if the construction machine is often engaged in work operation performed by utilizing both gripping devices 110 and 120 to simultaneously grip the gripping target object, the number of switch operations that need to be performed to allow/disallow the operations of the work load follow-up devices 201 and 202 can be reduced over the seventh embodiment and achieve an improvement in operability.

Ninth Embodiment

Figure 35:
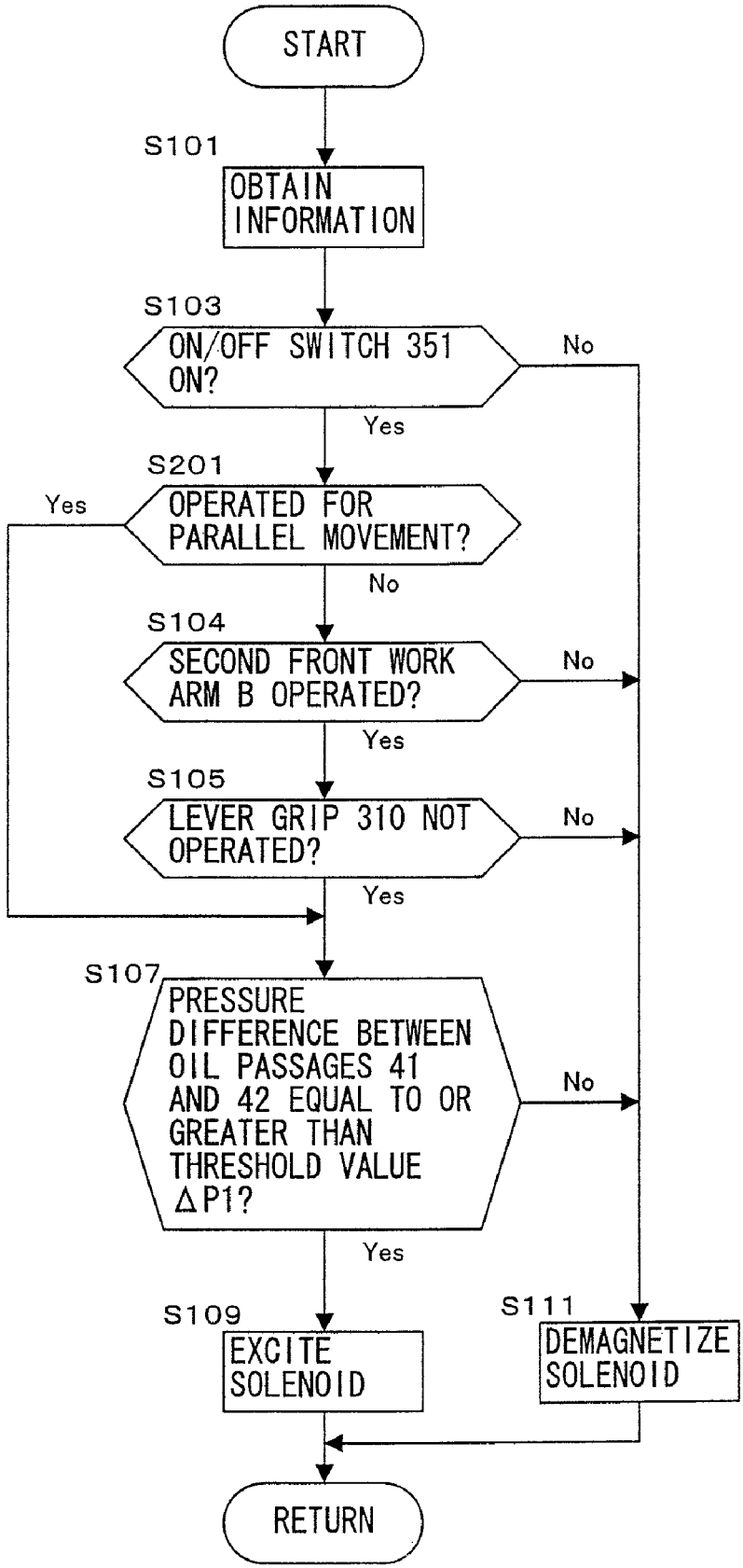
FIG. 35 presents a flowchart of the control processing operation executed to control the control valves in the work load follow-up devices in a ninth embodiment.

In reference to FIG. 35, the ninth embodiment of the construction machine according to the present invention is explained. The same reference numerals are assigned to structural elements identical to those in the seventh and eighth embodiments and the following explanation focuses on the differences from the seventh and eighth embodiments. Structural elements that are not specifically noted in the following explanation are identical to those in the seventh and eighth embodiments. The ninth embodiment differs from the seventh and eighth embodiments mainly in that the operations of the work load follow-up devices 201 and 202 are allowed when the operation levers 303 and 304 are operated so as to cause the front work arms A and B to swing in a similar manner. Namely, as the operation levers 303 and 304 are operated so as to move the gripping devices 110 and 120 along substantially the same direction over substantially equal distances at the construction machine 100 in the ninth embodiment, the construction machine is judged to be engaged in parallel displacement operation for moving the gripping target object 801 with a stable orientation, and accordingly, the pressure oil in the high-pressure side oil chamber at any hydraulic cylinder with a significant work load is absorbed at the corresponding accumulator 306 or 316.

For instance, it is not easy for the operator to operate the operation levers 303 and 304 in a precisely balanced manner to move the gripping target object 801 gripped by the gripping devices 110 and 120 in parallel. For this reason, when a double-arm construction machine in the related art is used to move a gripping target object with a stable orientation while gripped by the left-side gripping device and the right side gripping device, a difference between the extent to which the left side operation lever is operated and the extent to which the right side operation lever is operated is likely to result in a significant strain being placed on the gripping target object or on the front work arms.

Accordingly, if it is decided based upon the operating states of the operation levers 303 and 304, that the construction machine 100 in the embodiment is engaged in parallel displacement operation for moving the gripping target object 801 with a stable orientation, the pressure oil in the high-pressure side oil chamber at any hydraulic cylinder subjected to a significant work load is absorbed at the corresponding accumulator 306 or 316, as detailed later. As a result, it is ensured that no excessive load is applied to the front work arms A and B when the operation levers 303 and 304 are operated to move the gripping target object 801 with a stable orientation.

The structure of the construction machine 100 achieved in the ninth embodiment is identical to that of the construction machine 100 in the eighth embodiment, including the structure adopted in the hydraulic circuits. In addition to executing control similar to that executed on the individual work load follow-up devices 201 and 202 in the eighth embodiment as described above, the controllers 36 control the work load follow-up devices 201 and 202 as explained below. Namely, the controllers 36 detect the pressures in the oil passages 41 through 44 via the corresponding pressure sensors 401, 402, 411 and 412 if it is decided based upon the operating states of the operation levers 303 and 304, that the gripping devices 110 and 120 are being operated to move along substantially matching directions over substantially matching distances while the ON/OFF switch 351 is in the ON state. Then, the controller 36 controlling a hydraulic cylinder in correspondence to which the absolute value representing the difference between the pressures in the oil passages 41 and 42 is judged to be equal to or greater than the threshold value $\Delta P1$, excites the solenoid at the corresponding control valve 305 so as to connect the oil passage with the higher pressure to the oil passage 45 and the oil passage with the lower pressure to the oil passage 46 at the hydraulic cylinder.

Likewise, the controller 36 controlling a hydraulic cylinder, in correspondence to which the absolute value representing the difference between the pressures in the oil passages 43 and 44 is judged to be equal to or greater than the threshold value $\Delta P1$, excites the solenoid at the corresponding control valve 305 so as to connect the oil passage with the higher pressure to the oil passage 47 and the oil passage with the lower pressure to the oil passage 48 at the hydraulic cylinder. As a result, when the operation levers 303 and 304 have been operated to move the gripping target object 801 with a stable orientation, the pressure oil in the high-pressure side oil chamber at any hydraulic cylinder subjected to a significant work load is absorbed into the corresponding accumulator 306 or 316.

Flowchart

FIG. 35 presents a flowchart of the control processing operation executed to control the control valves 305 at the work load follow-up devices 201 and 202, in the ninth embodiment. The program in conformance to which the processing shown in FIG. 35 is executed is started up as an ignition switch (not shown) is turned on at the construction machine 100 and the program thus started up is executed by the controllers 36. It is to be noted that while the control executed on the work load follow-up device 201 connected to the hydraulic circuit that drives the boom cylinder 14 is explained below, similar control is executed on the work load follow-up devices 201 connected to the hydraulic circuits that drive the other hydraulic cylinders 16, 18 and 19. In addition, the work load follow-up devices 202 at the second front work arm B are controlled in a similar manner.

The operation executed from step S101 to step S103 and the operation executed from step S104 through step S111 are identical to those in the flowchart presented in FIG. 34 showing the control processing operation executed to control the control valves 305 and 315 at the workload follow-up devices 201 and 202 in the eighth embodiment.

If an affirmative decision is made in step S103, the operation proceeds to step S201 to make a decision based upon the information having been obtained in step S101 as to whether or not the operation levers 303 and 304 have been operated to move the gripping target object 801 with a stable orientation, i.e., whether or not the operation levers 303 and 304 have been operated to move the gripping devices 110 and 120 in parallel. If an affirmative decision is made in step S201, the operation proceeds to step S107, whereas if a negative decision is made in step S201, the operation proceeds to step S104.

In addition to the advantages of the seventh and eighth embodiments, the following operational advantages can be achieved with the construction machine 100 in the ninth embodiment.

(1) If the operation levers 303 and 304 are operated to move the gripping devices 110 and 120 along substantially matching directions over substantially matching distances while the ON/OFF switch 351 is in the ON state, the pressure oil in the high-pressure side oil chamber at any hydraulic cylinder subjected to a significant work load is absorbed into the corresponding accumulator 306 or 316. As a result, as the operation levers 304 and 303 are operated to move the gripping target object 801 with a stable orientation, no excessive load is applied to the front work arms A and B. This means that even an inexperienced operator is able to move the gripping target object 801 gripped with both gripping devices 110 and 120 by moving the gripping devices 110 and 120 in parallel with ease.

Figure 36:
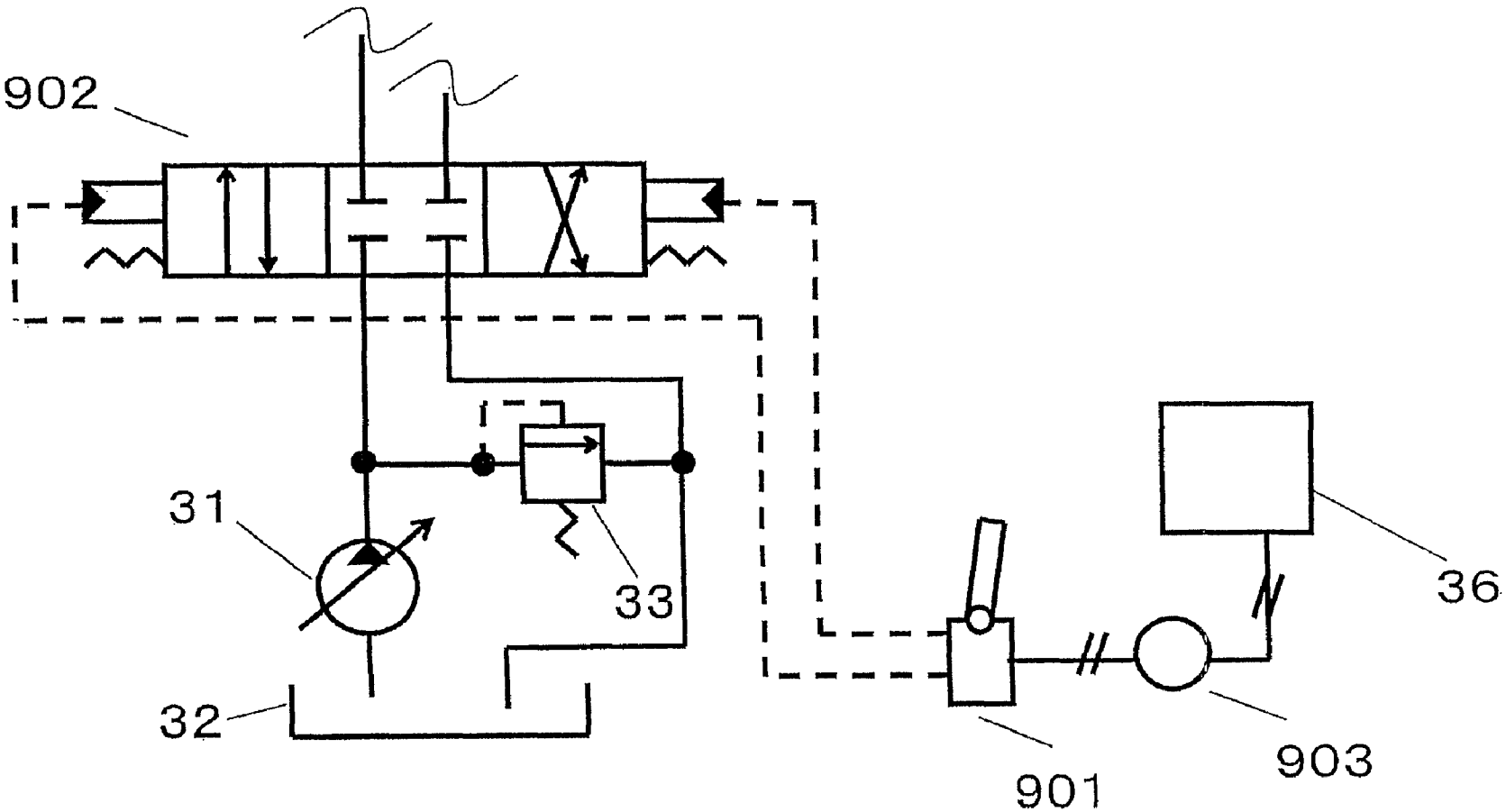
FIG. 36 shows an example of a variation that may be adopted in the hydraulic circuits.

Examples of Variations (1) While the operation levers 303 and 304 described above are operation devices widely referred to as electric levers, the present invention is not limited to this example. Advantages similar to those of the embodiments described above can be achieved by using a pilot pump (not shown), an operation device 901 which directly controls the pressure oil at the pilot pump and a control valve 902 at which the spool is driven to the extent controlled by the pilot pressure oil, as shown in FIG. 36. In this case, by detecting the extent to which the operation device 901 is operated via a potentiometer 903, control similar to that explained earlier can be executed.

(2) While an explanation is given above by assuming that a single value is commonly used as the threshold value ΔP1 for the work load follow-up devices 201 and the threshold value ΔP1 for the work load follow-up devices 202, the threshold value ΔP1 may assume different values for the work load follow-up devices 201 and the work load follow-up devices 202. In addition, while the work load follow-up devices 201 are installed each in correspondence to one of the hydraulic cylinders 14, 16, 18 and 19 at the first front work arm A, different threshold values ΔP1 may be set in correspondence to the individual work load follow-up devices 201. Likewise, different threshold values ΔP1 may be set for the individual work load follow-up devices 202.

(3) While the threshold value ΔP1 assumes a predetermined specific value in the description provided above, an adjustable threshold value that allows value adjustment by the operator may be used instead.

(4) While the description provided above does not include special reference to the sizes of the first front work arm A and the second front work arm B, the first front work arm A and the second front work arm B may be the same size or different sizes. In other words, the front work arms do not need to be symmetrical.

(5) While the operations of all the work load follow-up devices 201 installed in correspondence to the hydraulic cylinders 14, 16, 18 and 19 are allowed/disallowed in a batch via the ON/OFF switch 313 in the seventh embodiment described above, the present invention is not limited to this example. For instance, ON/OFF switches for allowing/disallowing operations may be installed each in correspondence to one of the work load follow-up devices 201 so as to individually allow/disallow operations of the work load follow-up devices 201 via these ON/OFF switches. Likewise, operations of the individual work load follow-up devices 202 may be allowed/disallowed via corresponding ON/OFF switches.

Figure 37:
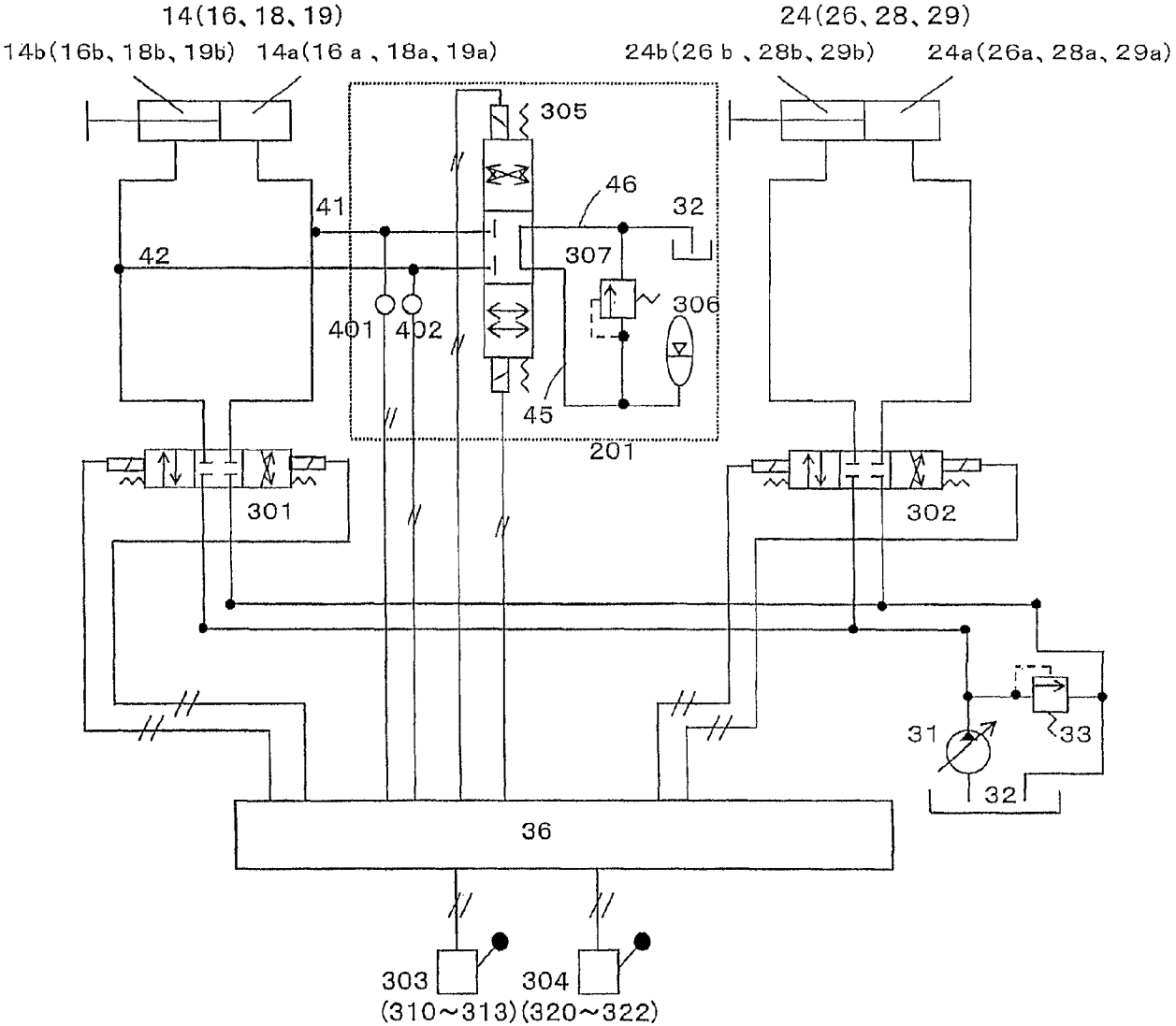
FIG. 37 shows an example of a variation that may be adopted in the hydraulic circuits.

(6) While the work load follow-up devices 201 and the work load follow-up devices 202 are installed respectively at the left-side front work arm A and the right-side front work arm B in the explanation provided above, the present invention is not limited to this example and it may be adopted in a construction machine such as that shown in FIG. 37 with work load follow-up devices 201 installed each in correspondence to one of the hydraulic cylinders 14, 16, 18 and 19 at the first front work arm A with no work load follow-up devices 202 installed in correspondence to the hydraulic cylinders 24, 26, 28 and 29 at the second front work arm B.

(7) While the hydraulic circuits for driving the hydraulic cylinders 14, 16, 18 and 19 at the first front work arm A each include a work load follow-up device 201 in the explanation provided above, the present invention is not limited to this example and advantages similar to those described above may be achieved by installing a work load follow-up device 201 in at least one of the hydraulic circuits for driving the hydraulic cylinders 14, 16, 18 and 19. Likewise, advantages similar to those described above can be achieved by installing a work load follow-up device 202 in at least one of the hydraulic circuits for driving the hydraulic cylinders 24, 26, 28 and 29.

(8) The seventh through ninth embodiments and variations thereof described above may be adopted in various combinations.

At a double-arm type construction machine equipped with articulated work arms installed on the left side and on the right side of the upper revolving superstructure, the left-side work arm and the right-side work arm can be driven independently of each other by separately driving the actuators installed at the left-side work arm and the right-side work arm. When the gripping target object is already gripped by the gripping device mounted at one of the work arms at a construction machine equipped with two arms in the related art, the gripping device mounted at the other work arm is not able to grasp the gripping target object readily due to the difficulty in aligning the gripping device mounted at the other work arm. In contrast, by adopting any of the seventh through ninth embodiments described above, the work tools can be aligned with greater ease.

The above described embodiments are examples, and various modifications can be made without departing from the scope of the invention.

What is claimed is:

1. A construction machine, comprising:

a work arm rotatably mounted at a construction machine main body;

a work tool mounted at the work arm;

an attitude adjusting device that adjusts an attitude of the work arm or the work tool relative to the construction machine main body;

an adjustment enabling device that allows the attitude of the work arm or the work tool to be adjusted by the attitude adjusting device so as to assume an attitude at least partly determined by an external force applied by a work target object to the work tool at the work arm or the work tool;

an operating state determining device that determines an operating state of the construction machine main body; and a switching device that selects, based upon the operating state determined by the operating state determining device, whether or not the adjustment enabling device is to allow the attitude adjusting device to adjust the attitude of the work arm or the work tool;

wherein the work arm rotates so as to lessen a bending moment resulting from the external force; wherein the work tool is a gripping device that grips a target object.

2. A construction machine according to claim 1, wherein:

the operating state determining device determines the operating state based upon at least one of an operating state of an operation lever by which operation instructions for the work arm or the work tool are issued, a work load applied to the work arm or the work tool, and the attitude of the work arm or the work tool.

3. A construction machine according to claim 2, wherein:

the operating state determining device determines the operating state based upon an operating state of an operation lever by which operating instructions for the gripping device are issued; and if the operating state determining device determines that the operation lever has been operated so as to grip the target object with the gripping device, the switching device switches the adjustment enabling device so as to allow the attitude adjusting device to adjust the attitude of the work arm or the work tool.

4. A construction machine according to claim 2, wherein:

the construction machine further comprises a detection device that detects a physical quantity corresponding to a gripping force imparted by the gripping device;

the operating state determining device determines the operating state based upon the physical quantity detected by the detection device; and if the operating state determining device determines that the physical quantity detected by the detection device is smaller than a predetermined value, the switching device switches the adjustment enabling device so as to allow the attitude adjusting device to adjust the attitude of the work arm or the work tool.

5. A construction machine according to claim 2, wherein:

if the operating state determining device determines, based upon the attitude of the work tool, that the work tool is positioned facing downward substantially along a vertical direction, the switching device switches the adjustment enabling device so as to allow the attitude adjusting device to adjust the attitude of the work tool.

6. A construction machine according to claim 1, wherein the adjustment enabling device enables communication between the attitude adjusting device and an accumulator by way of the switching device.

* * * * *